US008883381B2

(12) United States Patent
Nukada et al.

(10) Patent No.: US 8,883,381 B2
(45) Date of Patent: Nov. 11, 2014

(54) IMAGE FORMING APPARATUS, AND PROCESSING CARTRIDGE

(75) Inventors: Katsumi Nukada, Kanagawa (JP); Wataru Yamada, Kanagawa (JP); Tsuyoshi Miyamoto, Kanagawa (JP); Kenya Sonobe, Kanagawa (JP); Takatsugu Doi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 593 days.

(21) Appl. No.: 12/857,870

(22) Filed: Aug. 17, 2010

(65) Prior Publication Data

US 2011/0229809 A1 Sep. 22, 2011

(30) Foreign Application Priority Data

Mar. 17, 2010 (JP) ..... 2010-061360

(51) Int. Cl.

| | |
|---|---|
| ***G03G 15/00*** | (2006.01) |
| ***G03G 5/147*** | (2006.01) |
| ***G03G 9/097*** | (2006.01) |
| ***G03G 9/08*** | (2006.01) |
| ***G03G 21/00*** | (2006.01) |
| ***G03G 5/06*** | (2006.01) |
| ***G03G 5/07*** | (2006.01) |
| ***G03G 9/087*** | (2006.01) |

(52) U.S. Cl.

CPC ..... *G03G 21/0011* (2013.01); *G03G 5/14791* (2013.01); *G03G 9/09775* (2013.01); *G03G 9/0827* (2013.01); *G03G 9/0819* (2013.01); *G03G 5/0616* (2013.01); *G03G 5/071* (2013.01); *G03G 9/0825* (2013.01); *G03G 9/08782* (2013.01); *G03G 9/08795* (2013.01); *G03G 5/0614* (2013.01); *G03G 9/09733* (2013.01); *G03G 2215/00957* (2013.01); *G03G 9/08797* (2013.01); *G03G 5/075* (2013.01); *G03G 5/076* (2013.01)

USPC ..... 430/56

(58) Field of Classification Search

CPC ..... G03G 5/00; G03G 7/0006
USPC ..... 430/108.2–108.24, 56
See application file for complete search history.

(56) References Cited

U.S. PATENT DOCUMENTS 4,281,054 A 7/1981 Horgan et al.
4,599,286 A 7/1986 Limburg et al.

(Continued)

FOREIGN PATENT DOCUMENTS

CN 101025587 A 8/2007
EP 1734411 A1 * 12/2006

(Continued)

OTHER PUBLICATIONS

Tanaka et al., "Hybrid Sol-gel Coating with Dispersed Fluoropolymer Latex," The 8th Polymer Material Forum, Oct. 13, 1999, pp. 89-90, The Society of Polymer Science, Japan (with partial translation).

(Continued)

*Primary Examiner* — Mark F Huff
*Assistant Examiner* — Rashid Alam
(74) *Attorney, Agent, or Firm* — Oliff PLC

(57) ABSTRACT

The present invention provides an image forming apparatus including: an electrophotographic photoreceptor; a charging unit; an electrostatic latent image forming unit that forms an electrostatic latent image; a developing unit that develops the electrostatic latent image formed at the electrophotographic photoreceptor by a developer to form a toner image, the developing unit storing the developer containing a toner having toner particles containing a crystalline resin and having a shape factor SF1 of from 100 to 150, a volume average particle diameter of from 3 to 6 μm, and fluorocarbon-based resin particles as an external additive; a transfer unit; and a cleaning unit that cleans the surface of the electrophotographic photoreceptor with a blade containing urethane rubber, the blade disposed applying a pressure to the electrophotographic photoreceptor surface of 0.20 mN/mm or more.

6 Claims, 9 Drawing Sheets

(56) References Cited

U.S. PATENT DOCUMENTS

| | | | | |
|---|---|---|---|---|
| 5,300,414 | A | 4/1994 | Leppard et al. | |
| 5,410,048 | A | 4/1995 | Leppard et al. | |
| 5,411,827 | A | 5/1995 | Tamura et al. | |
| 5,427,880 | A | 6/1995 | Tamura et al. | |
| 5,496,671 | A | 3/1996 | Tamura et al. | |
| 6,416,915 | B1 | 7/2002 | Kikuchi et al. | |
| 2001/0008928 | A1 | 7/2001 | Nesvadba et al. | |
| 2001/0039315 | A1 | 11/2001 | Nesvadba et al. | |
| 2004/0043312 | A1 | 3/2004 | Kikuchi et al. | |
| 2004/0185361 | A1 | 9/2004 | Yoshino et al. | |
| 2004/0248024 | A1 | 12/2004 | Suzuki et al. | |
| 2004/0253527 | A1 | 12/2004 | Suzuki et al. | |
| 2006/0014096 | A1 | 1/2006 | Ohshima et al. | |
| 2007/0122724 | A1 | 5/2007 | Suzuki et al. | |
| 2007/0178400 | A1 | 8/2007 | Kikuchi et al. | |
| 2007/0201917 | A1 | 8/2007 | Teshigawara | |
| 2008/0020305 | A1 | 1/2008 | Suzuki et al. | |
| 2008/0138725 | A1 | 6/2008 | Fujiwara et al. | |
| 2008/0181666 | A1* | 7/2008 | Katahira et al. | 399/174 |
| 2008/0187855 | A1* | 8/2008 | Patel et al. | 430/109.4 |
| 2008/0305417 | A1* | 12/2008 | Sugimura et al. | 430/58.85 |
| 2009/0162763 | A1* | 6/2009 | Li et al. | 430/58.2 |

FOREIGN PATENT DOCUMENTS

| | | |
|---|---|---|
| JP | A-61-156052 | 7/1986 |
| JP | A-63-52150 | 3/1988 |
| JP | A-5-40360 | 2/1993 |
| JP | A-5-216249 | 8/1993 |
| JP | A-5-323630 | 12/1993 |
| JP | A-7-72640 | 3/1995 |
| JP | A-11-52603 | 2/1999 |
| JP | A-11-119458 | 4/1999 |
| JP | A-2000-206715 | 7/2000 |
| JP | A-2000-206717 | 7/2000 |
| JP | A-2000-264961 | 9/2000 |
| JP | A-2001-117250 | 4/2001 |
| JP | A-2001-166510 | 6/2001 |
| JP | A-2001-175016 | 6/2001 |
| JP | A-2001-510208 | 7/2001 |
| JP | A-2003-005401 | 1/2003 |
| JP | A-2004-12986 | 1/2004 |
| JP | A-2004-287151 | 10/2004 |
| JP | A-2004-302450 | 10/2004 |
| JP | A-2005-91500 | 1/2005 |
| JP | A-2005-49736 | 2/2005 |
| JP | A-2005-62300 | 3/2005 |
| JP | A-2005-62302 | 3/2005 |
| JP | A-2005-91457 | 4/2005 |
| JP | A-2006-018025 | 1/2006 |
| JP | A-2006-047869 | 2/2006 |
| JP | A-2007-072141 | 3/2007 |
| JP | A-2007-079008 | 3/2007 |
| JP | A-2007-86522 | 4/2007 |
| JP | A-2007-163577 | 6/2007 |
| JP | A-2008-116666 | 5/2008 |
| JP | A-2008-170977 | 7/2008 |
| JP | A-2009-186726 | 8/2009 |
| JP | A-2011-133805 | 7/2011 |

OTHER PUBLICATIONS

Japanese Industrial Standard: Tensile testing methods for vulcanized rubber, Japanese Standards Association (JIS K6251), 1993, pp. 417-420.

Japanese Industrial Standard: Testing methods of rebound resilience for rubber, vulcanized or thermoplastic, Japanese Standards Association (JIS K-6255), 1996, pp. 452-462.

Japanese Industrial Standard: Testing methods for Trasition Temperatures of Plastics, Japanese Standards Association (JIS K-7121), 1993, pp. 584-587.

Feb. 27, 2013 Office Action issued in Chinese Patent Application No. 201010287890.0 (with English translation).

Jan. 21, 2014 Notice of Reasons for Rejection issued in Japanese Application No. 2010-049417 with English-language translation.

Jan. 21, 2014 Notice of Reasons for Rejection issued in Japanese Application No. 2010-061360 with English-language translation.

Mar. 4, 2014 Notice of Reasons for Rejection issued in Japanese Application No. 2010-037797 with English-language translation.

May 7, 2014 Notice of Reasons for Rejection issued in Japanese Application No. 2010-061360 with partial English-language translation.

May 20, 2014 3rd Notification of Office Action issued in Chinese Application No. 201010287890.0 with English-language translation.

Jun. 17, 2014 Notice of Reasons for Rejection issue in Japanese Application No. 2010-049417 with English-language translation.

Aug. 5, 2014 Office Action issued in Japanese Patent Application No. 2010-037797 (with translation).

* cited by examiner

IMAGE FORMING APPARATUS, AND PROCESSING CARTRIDGE

CROSS-REFERENCE TO RELATED APPLICATION

This application is based on and claims priority under 35 USC 119 from Japanese Patent Application No, 2010-061360 filed on Mar. 17, 2010.

BACKGROUND

1. Field of the Invention

The present invention relates to an image forming apparatus and a processing cartridge.

2. Related Art

An electrophotographic image forming apparatus generally has the constitution and processes as follows.

That is, the surface of the electrophotographic photoreceptor is charged with a predetermined polarity and potential by a charging unit, the electrophotographic photoreceptor surface after the charging is selectively discharged by image exposure to form an electrostatic latent image, thereby adhering a toner to the electrostatic latent image by a developing unit to develop the latent image into a toner image, and transferring the toner image to a medium to be transferred by a transfer unit to discharge it as an image forming product.

Recently, organic photoreceptors using organic photoconductive materials have become mainstream. Further, it is proposed to provide the surface of the electrophotographic photoreceptor with a protective layer.

SUMMARY

According to an aspect of the invention, an image forming apparatus including: an electrophotographic photoreceptor having an outermost layer configured to include at least a cured product including a charge transporting skeleton, a charging unit that charges the electrophotographic photoreceptor, an electrostatic latent image forming unit that forms an electrostatic latent image at the charged electrophotographic photoreceptor, and a developing unit that develops the electrostatic latent image formed at the electrophotographic photoreceptor by a developer to form a toner image, the developing unit storing a developer containing a toner including toner particles including a crystalline resin and having a shape factor SF1 of from about 100 to about 150 in addition to a volume average particle diameter of from about 3 μm to about 6 μm, and fluorocarbon resin particles as an external additive, a transfer unit that transfers the toner image to a medium to be transferred, and a cleaning unit that cleans a surface of the electrophotographic photoreceptor with a blade including urethane rubber, the blade disposed applying a pressure to the electrophotographic photoreceptor surface of about 0.20 mN/mm or more.

BRIEF DESCRIPTION OF THE DRAWINGS

Exemplary embodiments of the invention will be described in detail based on the following figures, wherein.

DETAILED DESCRIPTION

Figure 1:
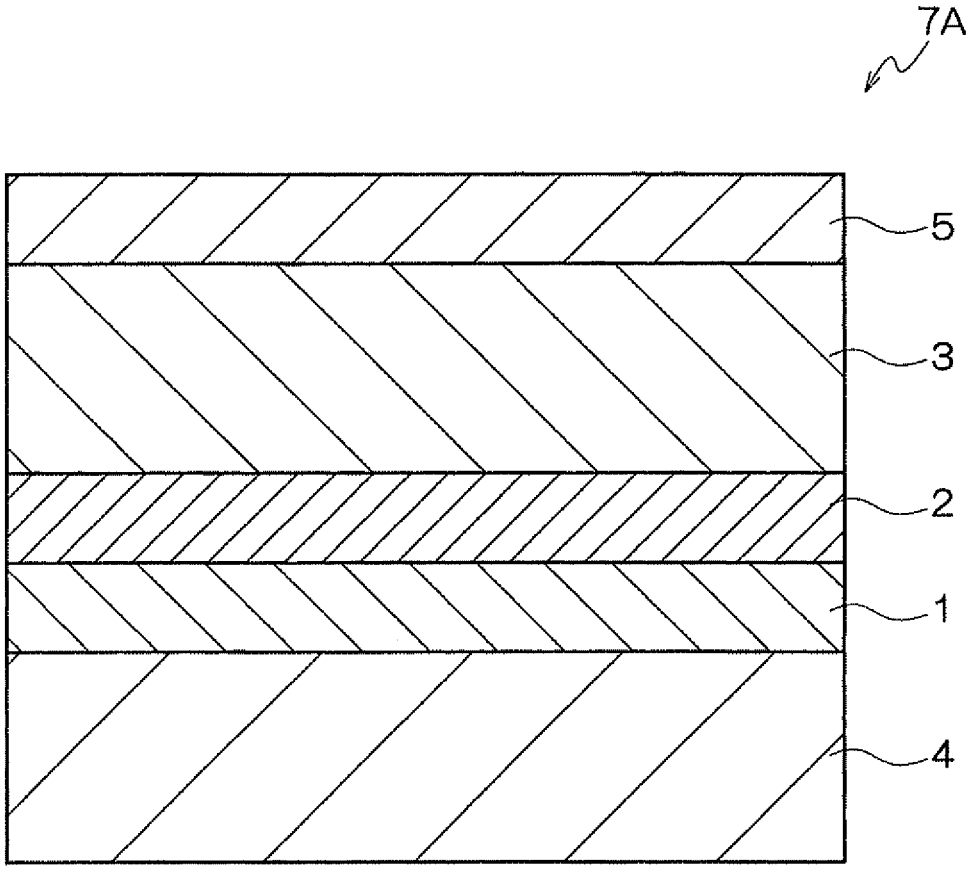
FIG. 1 is a schematic partial cross sectional drawing showing the electrophotographic photoreceptor concerning an aspect of the invention.

Exemplary embodiments according to the aspect of the invention include, but are not limited to the following items <1> to <12>.

<1>An image forming apparatus including: an electrophotographic photoreceptor having an outermost layer configured to comprise at least a cured product including a charge transporting skeleton; a charging unit that charges the electrophotographic photoreceptor; an electrostatic latent image forming unit that forms an electrostatic latent image at the charged electrophotographic photoreceptor; a developing unit that develops the electrostatic latent image formed at the electrophotographic photoreceptor by a developer to form a toner image, the developing unit storing a developer including a toner having toner particles including a crystalline resin and having a shape factor SF1 of from about 100 to about 150 in addition to a volume average particle diameter of from about 3 μm to about 6 μm, and fluorocarbon-based resin particles as an external additive; a transfer unit that transfers the toner image to a medium to be transferred; and a cleaning unit that cleans a surface of the electrophotographic photoreceptor with a blade including urethane rubber, the blade disposed applying a pressure to the electrophotographic photoreceptor surface of about 0.20 mN/mm or more.

<2> The image forming apparatus according to the item <1>, wherein the cured product is obtained from a compound including a molecule including the charge transporting skeleton and a chain polymerizable functional group in a molecule.

<3> The image forming apparatus according to the item <2>, wherein the chain polymerizable functional group comprises four or more methacryloyl groups.

<4> The image forming apparatus according to any one of the items <1> to <3>, wherein the charge transporting skeleton is derived from a nitrogen-containing compound selected from the group consisting of a triarylamine-based compound, a benzidine-based compound and a hydrazone-based compound.

<5> The image forming apparatus according to the item <4>, wherein the nitrogen-containing compound is represented by the following Formula (A):

Formula (A)

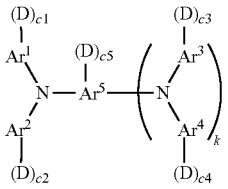

wherein, in Formula (A), each of $Ar^1$, $Ar^2$, $Ar^3$ and $Ar^4$ independently represents a substituted or unsubstituted aryl group; $Ar^5$ represents a substituted or unsubstituted aryl group or a substituted or unsubstituted arylene group; D represents a group including at the terminal at least one selected from the group consisting of an acryloyl group, a methacryloyl group, a derivative of an acryloyl group, a derivative of a methacryloyl group and a vinylphenyl group; each of c1, c2, c3, c4 and c5 independently represents 0, 1 or 2; k represents 0 or 1; and the total number of D is 1 or more.

<6> The image forming apparatus according to the item <5>, wherein, in Formula (A), D is $—(CH_2)_d—(O—CH_2—CH_2)_e—O—CO—C(CH_3)=CH_2$, $—CH=CH_2$, or $—(CH_2)_d—(C=O)_f—O—C_6H_4—CH=CH_2$, wherein d represents an integer of 1 to 5; e represents 0 or 1; and f represents 0 or 1; and the total number of D is 4 or more.

<7> A processing cartridge, including: an electrophotographic photoreceptor having an outermost layer configured to include at least a cured product including a charge transporting skeleton; a developing unit that develops an electrostatic latent image formed at the electrophotographic photoreceptor by a developer to form a toner image, the developing unit storing a developer including a toner having toner particles including a crystalline resin and having a shape factor SF1 of from about 100 to about 150 in addition to a volume average particle diameter of from about 3 μm to about 6 μm, and fluorocarbon-based resin particles as an external additive; and a cleaning unit that cleans the surface of the electrophotographic photoreceptor with a blade including urethane rubber, the blade disposed applying a pressure to the electrophotographic photoreceptor surface of about 0.20 mN/mm or more, wherein the processing cartridge is detachable from a image forming apparatus.

<8> The processing cartridge according to the item <7>, wherein the cured product is obtained from a compound including a molecule including the charge transporting skeleton and a chain polymerizable functional group in a molecule.

<9> The processing cartridge according to the item <8>, wherein the chain polymerizable functional group includes four or more methacryloyl groups.

<10> The processing cartridge according to any one of the items <7> to <9>, wherein the charge transporting skeleton is derived from a nitrogen-containing compound selected from the group consisting of a triarylamine-based compound, a benzidine-based compound and a hydrazone-based compound.

<11> The processing cartridge according to the item <10>, wherein the nitrogen-containing compound is represented by the following Formula (A):

Formula (A)

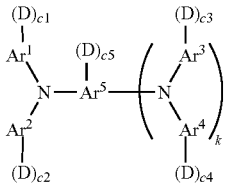

wherein, in Formula (A), each of $Ar^1$, $Ar^2$, $Ar^3$ and $Ar^4$ independently represents a substituted or unsubstituted aryl group; $Ar^5$ represents a substituted or unsubstituted aryl group or a substituted or unsubstituted arylene group; D represents a group including at the terminal at least one selected from the group consisting of an acryloyl group, a methacryloyl group, a derivative of an acryloyl group, a derivative of a methacryloyl group and a vinylphenyl group; each of c1, c2, c3, c4 and c5 independently represents 0, 1 or 2; k represents 0 or 1; and the total number of D is 1 or more.

<12> The processing cartridge according to the item <11>, wherein, in Formula (A), D is $—(CH_2)_d—(O—CH_2—CH_2)_e—O—CO—C(CH_3)=CH_2$, $—CH=CH_2$, or $—(CH_2)_d—(C=O)_f—O—C_6H_4—CH=CH_2$, wherein d represents an integer of 1 to 5, e represents 0 or 1, and f represents 0 or 1; and the total number of D is 4 or more.

[Electrophotographic Photoreceptor]

The image forming apparatus according to the present aspect includes an electrophotographic photoreceptor having an outermost layer configured to include at least a cured product containing a charge transporting skeleton; a charging unit for charging the electrophotographic photoreceptor, an electrostatic latent image forming unit for forming an electrostatic latent image at the charged electrophotographic photoreceptor; a developing unit for developing the electrostatic latent image formed at the electrophotographic photoreceptor by a developer to form a toner image, which stores a developer containing a toner having toner particles containing a crystalline resin and having a shape factor SF1 of from 100 or about 100 to 150 or about 150 in addition to a volume average particle diameter of from 3 μm or about 3 μm to 6 μm or about 6 μm, and fluorocarbon-based resin particles as an external additive; a transfer unit for transferring the toner image to a medium to be transferred; and a cleaning unit for cleaning the surface of the electrophotographic photoreceptor with a blade containing urethane rubber and disposed applying a pressure to the electrophotographic photoreceptor surface of 0.20 mN/mm or about 0.20 mN/mm or more.

In the image forming apparatus having such a constitution, it is thought that if the toner contains fluorocarbon-based resin particles, the fluorocarbon-based resin particles contained in the toner are adhered to the electrophotographic photoreceptor surface upon operation of the image forming apparatus. It is thought that when the image forming apparatus is continuously operated, a fluorocarbon-based resin film is formed on the electrophotographic photoreceptor surface.

Further, if a cured product of a compound containing a chain polymerizable functional group is used as a cured product containing a charge transporting skeleton, which constitutes the electrophotographic photoreceptor surface, the electrophotographic photoreceptor surface is not easily abraded, as compared with a case of not using the cured product of a compound containing a chain polymerizable functional group, which is particularly more evident in a case where the chain polymerizable functional groups are 4 or more methacryloyl groups. However, even in this case, by forming a fluorocarbon-based resin film on the electrophotographic photoreceptor surface, the friction between the cleaning blade and the electrophotographic photoreceptor surface can be reduced.

Furthermore, if the cured product of a compound containing chain polymerizable functional groups such as 4 or more methacryloyl groups, and the like is used as a cured product containing a charge transporting skeleton, unreacted chain polymerizable functional groups may remain in the cured product containing a charge transporting skeleton (cured film) according to the reaction conditions for polymerization or curing. These unreacted chain polymerizable functional groups are susceptible to oxidation by ozone or the like, and are liable to generate polar groups such as a carboxylic acid and the like on the surface and to adsorb the discharge products such as nitrate ions and the like. This leads to an increase in the friction coefficient with a cleaning blade, and as a result, a ghost is easily generated. However, it is thought that the unreacted chain polymerizable functional groups are covered with the fluorocarbon resin particles on the surface of the electrophotographic photoreceptor, and thereby, the discharge products such as nitrate ions or the like are prevented to be adsorbed.

Hereinafter, the image forming apparatus of the present aspect will be described in detail. First, the electrophotographic photoreceptor will be described.

[Electrophotographic Photoreceptor]

The image forming apparatus of the present aspect includes an electrophotographic photoreceptor having an outermost layer configured to include at least a cured product containing a charge transporting skeleton.

The electrophotographic photoreceptor of the present aspect may further include a conductive substrate and a photosensitive layer formed on the conductive substrate. In addition, the outermost layer may form the top surface of the electrophotographic photoreceptor itself, and is provided as a layer functioning as a protective layer or a layer functioning as a charge transporting layer.

Further, when the outermost layer is a layer functioning as a protective layer, it follows that the protective layer has lower layers such as a photosensitive layer comprising a charge-transporting layer and a charge-generating layer, or a monolayer type photosensitive layer (a charge-generating/charge-transporting layer).

When the outermost layer is a layer functioning as a protective layer, the form consisting of a conductive substrate having thereon a photosensitive layer and a protective layer as the outermost layer, wherein the protective layer includes a cured product containing a charge transporting skeleton can be exemplified.

On the other hand, when the outermost layer is a layer functioning as a charge-transporting layer, the form consisting of a conductive substrate having thereon a charge-generating layer and a charge transporting layer as the outermost layer, wherein the charge transporting layer includes a cured product containing a charge transporting skeleton can be exemplified.

The electrophotographic photoreceptor of this embodiment in the case where the outermost layer is a layer that functions as a protective layer will be described in detail below with reference to the accompanying figures. Incidentally, in the figures, the same or corresponding parts are attached with the same signs and duplicating explanations are omitted.

Figure 2:
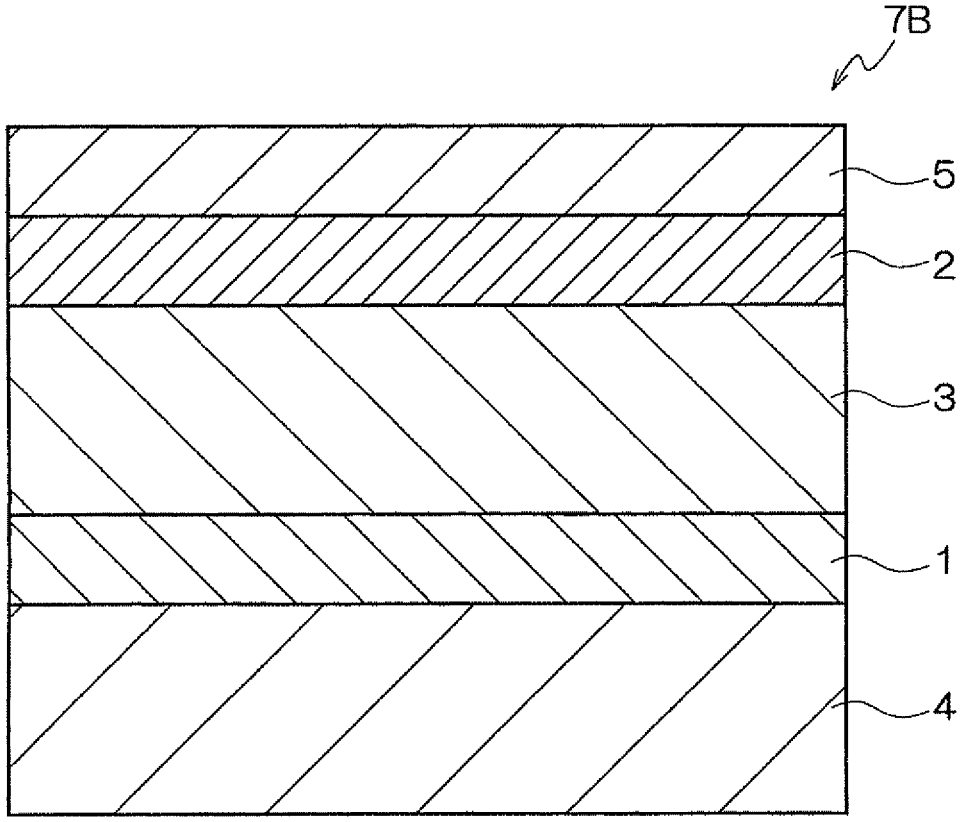
FIG. 2 is a schematic partial cross sectional drawing showing the electrophotographic photoreceptor concerning an aspect of the invention.
Figure 3:
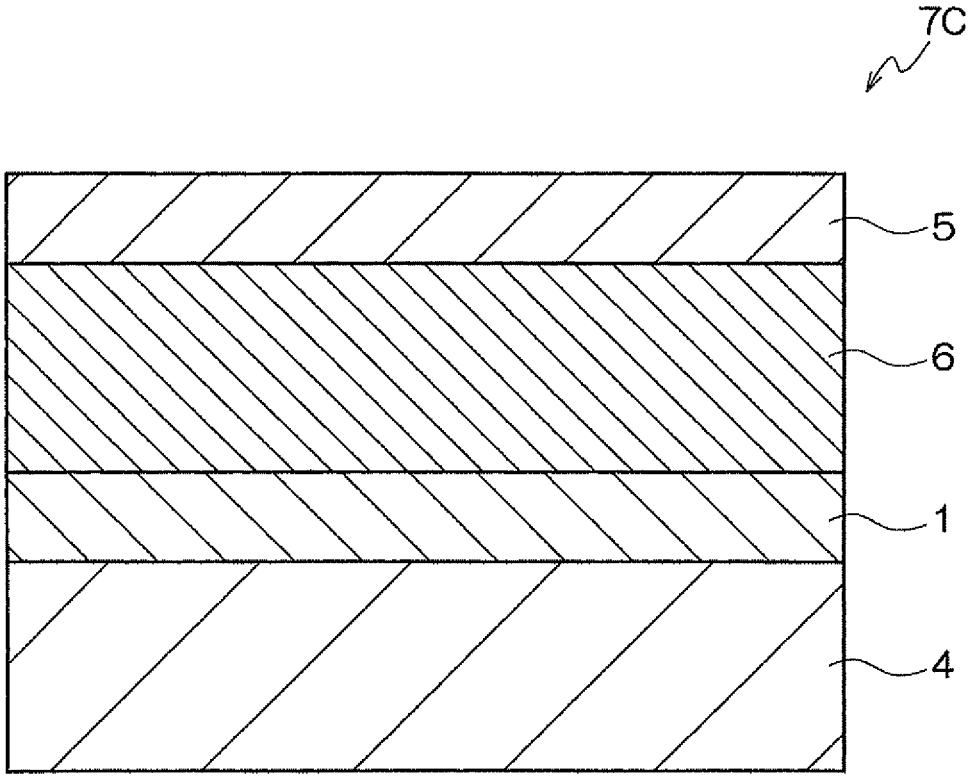
FIG. 3 is a schematic partial cross sectional drawing showing the electrophotographic photoreceptor concerning an aspect of the invention.

FIG. 1 is a typical cross sectional drawing showing a preferred embodiment of the electrophotographic photoreceptor of this embodiment. FIGS. 2 and 3 are typical cross sectional drawings of the electrophotographic photoreceptors of other embodiments.

Electrophotographic photoreceptor 7A shown in FIG. 1 is what is called a function separating type photoreceptor (or a lamination type photoreceptor) having a structure comprising conductive substrate 4 having thereon undercoating layer 1, and having formed thereon charge-generating layer 2, charge transporting layer 3, and protective layer 5 in order. In electrophotographic photoreceptor 7A, a photosensitive layer is comprised of charge generating layer 2 and charge transporting layer 3.

Electrophotographic photoreceptor 7B shown in FIG. 2 is a function separating type photoreceptor similar to electrophotographic photoreceptor 7A shown in FIG. 1, wherein the functions are separated to charge generating layer 2 and charge transporting layer 3. Electrophotographic photoreceptor 7C shown in FIG. 3 is a photoreceptor containing a charge generating material and a charge transporting material in the same layer [monolayer type photosensitive layer 6 (a charge-generating/charge-transporting layer)].

Electrophotographic photoreceptor 7B shown in FIG. 2 has a structure comprising conductive substrate 4 having thereon undercoating layer 1, and having formed thereon charge transporting layer 3, charge generating layer 2, and protective layer 5 in order. In electrophotographic photoreceptor 7B, a photosensitive layer is comprised of charge transporting layer 3 and charge generating layer 2.

Electrophotographic photoreceptor 7C shown in FIG. 3 has a structure comprising conductive substrate 4 having thereon undercoating layer 1, and having formed thereon monolayer type photosensitive layer 6 and protective layer 5 in order.

In electrophotographic photoreceptors 7A to 7C shown in FIGS. 1 to 3, protective layer 5 is the outermost layer arranged farthest, from conductive substrate 4, and the outermost layer has the prescribed structure.

In the electrophotographic photoreceptors shown in FIGS. 1 to 3, undercoating layer 1 may be provided or may not be provided.

Each element will be explained below based on electrophotographic photoreceptor 7A shown in FIG. 1 as a representative example.

<Protective Layer>

The protective layer is an outermost layer in the electrophotographic photoreceptor and is configured to include a cured product containing a charge transporting skeleton. That is, the protective layer is configured with a cured product obtained by curing a compound having a charge transporting skeleton by thermal polymerization, photopolymerization, or irradiation of radiation. In addition, the cured product may be a cured product including a polymerization initiator, a binder resin, and monomer, in addition to the compound having a charge transporting skeleton.

First, the cured product containing a charge transporting skeleton will be described.

The cured product containing a charge transporting skeleton used in the protective layer (outermost layer) is a cured product obtained by curing a compound having a charge transporting skeleton in its molecules by thermal polymerization, photopolymerization, or irradiation of radiation, and may be any one satisfying the conditions regarding these structures.

Herein, the charge transporting skeleton is a skeleton derived from a nitrogen-containing hole-transporting compound such as a triarylamine-based compound, a benzidine-based compound, a hydrazone-based compound, and the like, wherein a structure conjugated with the nitrogen atom corresponds to the charge transporting skeleton.

The cured product containing a charge transporting skeleton is preferably a cured product of a compound containing a charge transporting skeleton and chain polymerizable functional groups in the same molecule. By such an aspect, an outermost layer which has a high crosslinking density and is difficult to abrade can be formed, and therefore, it is not necessary to add a multifunctional monomer not having charge transportability, whereby increase in the thickness of the outermost layer can be facilitated without reduction of the electrical characteristics due to the addition of the multifunctional monomer.

Hereinafter, the "compound having a charge transporting skeleton and chain polymerizable functional groups in the same molecule" may also be referred to as a specific charge transporting material (a).

Herein, examples of the chain polymerizable functional group include an acryloyl group, a methacryloyl group, a derivative of the acryloyl group, a derivative of the methacryloyl group, a vinylphenyl group, and the like, and particularly preferred are a methacryloyl group and a derivative thereof.

The reason is not clear, but it is presumed to be as follows.

Typically, it is thought that a highly reactive acrylic group is often used for a curing reaction, but if the highly reactive acrylic group is used as a substituent in the bulky charge transporting skeleton, it is liable to form a micro- (or macro-) sea-island structure since uneven curing reactions easily occur. This sea-island structure has no particular problem outside the field of electronic photography, but when used as an electrophotographic photoreceptor, unevenness/wrinkles of the outermost layer easily occur and portions having different charge transporting properties are generated in the macro, leading to problems such as image unevenness and the like. Furthermore, it is thought that the formation of such a sea-island structure becomes particularly evident when plural functional groups are attached to one charge transporting skeleton.

Furthermore, a specific charge transporting material (a) is preferably a structure in which the charge transporting skeleton and the acryloyl group or methacryloyl group are linked via one or more carbon atoms. That is, it is a preferred aspect that the specific charge transporting material (a) has a carbon chain having one or more carbon atoms between the charge transporting skeleton and the acryloyl group or methacryloyl group as a linking group. Particularly, it is the most preferred aspect that the linking group is an alkylene group.

The reason that the above embodiment is preferred is not necessarily clearly known, but it is presumably due to the following reason.

That is, if electron-attractive methacryloyl groups or acryloyl groups are present too near to a charge transporting structure, density of electric charge of the charge transporting structure lowers and ionization potential rises, so that there are cases where injection of carriers from the lower layer does not smoothly advance. Further, when radical polymerizable substituents such as methacryloyl groups are polymerized, if radicals generating at the time of polymerization have a structure easily movable to the charge transporting structure, the generated radicals deteriorate the charge transporting function, which presumably causes degradation of electric characteristics. In addition, in connection with mechanical strength in the outermost layer, when a bulky charge transporting structure and polymerization sites (acryloyl groups or methacryloyl groups) are near and rigid, the polymerization sites are mutually difficult to move and there is presumably the possibility that probability of reaction lowers.

From these facts, a structure such that a flexible carbon chain intervenes between the charge transporting structure and the acryloyl groups or the methacryloyl group is preferred.

Further, it is a preferred aspect that the specific charge transporting material (a) is a compound (a') of a structure having a triphenylamine skeleton and 3 or more methacryloyl groups, and more preferably 4 or more methacryloyl groups in the same molecule. In this aspect, the stability of the compound in the synthesis is secured, and thus, the compound can be produced on an industrial scale. Further, a crosslinking film having a sufficient strength can be made therefrom, and accordingly, it is not necessary to add a multifunctional monomer not having charge transportability. Therefore, since sufficient electrical characteristics are secured even with the thick film, the life time can be increased. In addition, by securing the electrical characteristics and the strength, it becomes easy to add a binding resin or monomers to a composition containing the specific charge transporting material (a), and therefore, gas barrier properties and adhesiveness can be improved by curing the above composition to make a cured product.

The compound which has a structure having a triphenylamine skeleton and 3 or more methacryloyl groups, and more preferably 4 or more methacryloyl groups in the same molecule has a charge transporting structure, unlike the multifunctional monomers not having charge transportability, and therefore, it is excellent in compatibility with conventional charge transporting materials having no reactive group, and thus, it is possible to dope the conventional charge transporting materials having no reactive group, which is considered to further improve the electrical characteristics.

In order to obtain the cured product (a cured product of a composition containing the specific charge transporting material (a) in the case where polymerization initiators, monomers, or the like are used in combination), the specific charge transporting material (a) (or the composition containing the specific charge transporting material (a)) may be cured by a known curing method.

Examples of the curing method include radical polymerization by heating, exposure to light, irradiation of radiation, or the like, but if the reaction proceeds too fast, the unevenness or wrinkles of the film easily occur. Therefore, by carrying out the thermal polymerization with selection of a methacryloyl group allowing radical generation to occur relatively slowly and having lower reactivity than that of an acryloyl group as a chain polymerization functional group, relaxation of the structure is facilitated by heat, and therefore a stable film that has high uniformity can be obtained.

In the present aspect, the specific charge transporting material (a) is preferably a compound represented by Formula (A) below from the viewpoint of excellent charge transportability.

Formula (A):

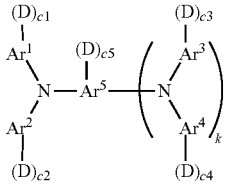

In Formula (A), each of $Ar^1$, $Ar^2$, $Ar^3$ and $Ar^4$ independently represents a substituted or unsubstituted aryl group;

$Ar^5$ represents a substituted or unsubstituted aryl group or a substituted or unsubstituted arylene group; D represents a group including at the terminal at least one selected from the group consisting of an acryloyl group, a methacryloyl group, a derivative of the acryloyl group, a derivative of the methacryloyl group and a vinylphenyl group; each of c1, c2, c3, c4 and c5 independently represents 0, 1 or 2; k represents 0 or 1; and the total number of D is 1 or more.

D in Formula (A) is preferably $—(CH_2)_d—(O—CH_2—CH_2)_e—O—CO—C(CH_3)=CH_2$, $—CH=CH_2$, or $—(CH_2)_d—(C=O)_f—O—C_6H_4—CH=CH_2$. Herein, d represents an integer of 1 to 5; e represents 0 or 1; f represents 0 or 1; and the total number of D is 4 or more.

Hereinafter, Formula (A) will be described in detail.

In Formula (A), each of $Ar^1$, $Ar^2$, $Ar^3$ and $Ar^4$ independently represents a substituted or unsubstituted aryl group. Each of $Ar^1$, $Ar^2$, $Ar^3$ and $Ar^4$ may be the same as or different from.

As the substituents of the substituted aryl group other than D, an alkyl group and an alkoxy group each having 1 to 4 carbon atoms, or a substituted or unsubstituted aryl group having 6 to 10 carbon atoms are exemplified.

$Ar^1$ to $Ar^4$ are preferably any of the following formulae (1) to (7). In formulae (1) to (7), "$-(D)_{c1}$" to "$-(D)_{c4}$" capable of bonding to each of $Ar^1$ to $Ar^4$ are generally shown as "$-(D)_c$".

(1)

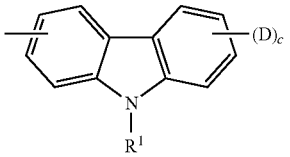

(2)

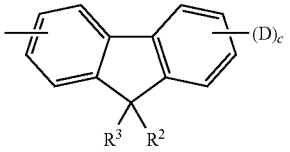

(3)

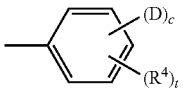

(4)

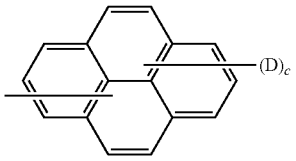

(5)

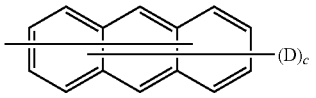

(6)

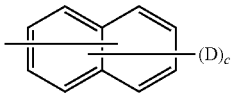

(7)

$—Ar—(Z')_s—Ar—(D)_c$

In formulae (1) to (7), $R^1$ represents the one selected from the group consisting of a hydrogen atom, an alkyl group having 1 to 4 carbon atoms, a phenyl group substituted with an alkyl group having 1 to 4 carbon atoms or an alkoxy group having 1 to 4 carbon atoms, an unsubstituted phenyl group, and an aralkyl group having 7 to 10 carbon atoms; each of $R^2$, $R^3$ and $R^4$ independently represents the one selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom; Ar represents a substituted or unsubstituted arylene group; D represents $—(CH_2)_d—(O—CH_2—CH_2)_e—O—CO—C(CH_3)=CH_2$, $CH=CH_2$, or $—(CH_2)_d—(CO)_f—O—C_6H_4—CH=CH_2$; d represents an integer of 1 to 5; e represents 0 or 1; f represents 0 or 1; c represents 1 or 2; s represents 0 or 1; and t represents an integer of 0 to 3.

Here, Ar in formula (7) is preferably represented by the following formula (8) or (9).

(8)

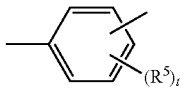

(9)

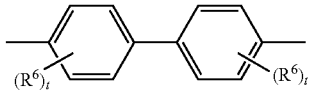

In formulae (8) and (9), each of $R^5$ and $R^6$ independently represents the one selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom; and each t' represents an integer of 0 to 3.

In formula (7), Z' represents a divalent organic linking group, and is preferably represented by any of the following formulae (10) to (17); and s represents 0 or 1.

(10) $—(CH_2)_q—$

(11) $—(CH_2CH_2O)_r—$ (12)

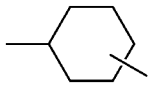

(13)

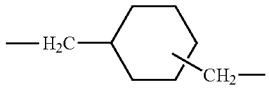

(14)

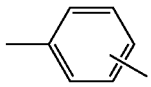

(15)

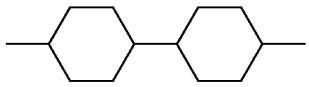

(16)

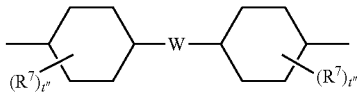

-continued (17)

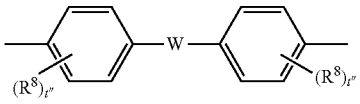

In formulae (10) to (17), each of $R^7$ and $R^8$ independently represents the one selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom; W represents a divalent group; each of q and r independently represents an integer of 1 to 10; and each of t" represents an integer of 0 to 3.

W in formulae (16) and (17) is preferably any of divalent groups represented by the following formulae (18) to (26). In formula (25), u represents an integer of 0 to 3.

(18) $-CH_2-$

(19) $-C(CH_3)_2-$

(20) $-O-$

(21) $-S-$

(22) $-C(CF_3)_2-$

-continued

(23) $-Si(CH_3)_2-$ (24)

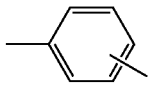

(25)

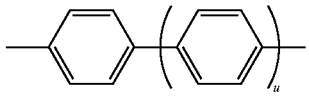

(26)

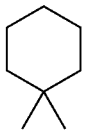

In formula (A), $Ar^5$ represents a substituted or unsubstituted aryl group when k is 0. As the aryl group, the same aryl groups shown in the description of $Ar^1$ to $Ar^4$ are exemplified. $Ar^5$ represents a substituted or unsubstituted arylene group when k is 1, and as the arylene group, arylene groups obtained by subtracting one hydrogen atom at a prescribed position from the aryl groups shown in the description of $Ar^1$ to $Ar^4$ are exemplified.

The specific examples of the compounds represented by formula (A) are shown below. However, the compounds represented by formula (A) are not restricted thereto.

A-1

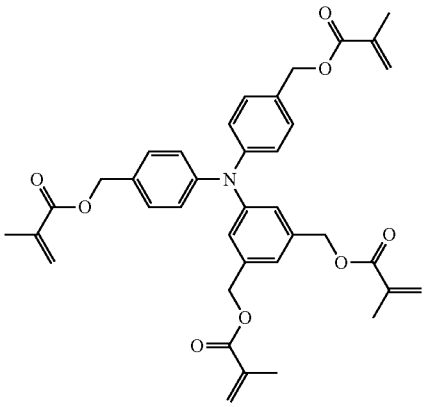

A-2

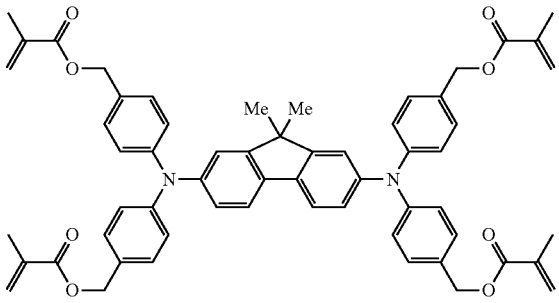

A-3

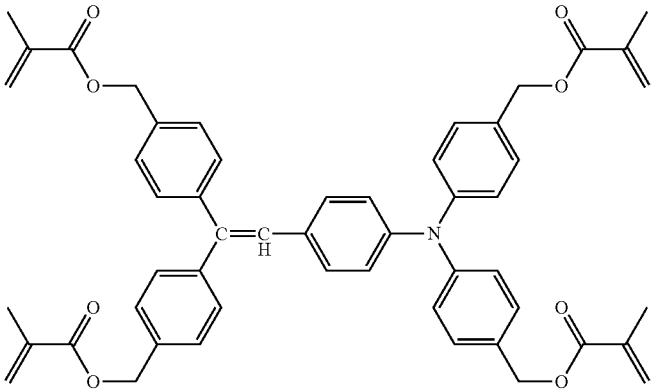

-continued
A-4
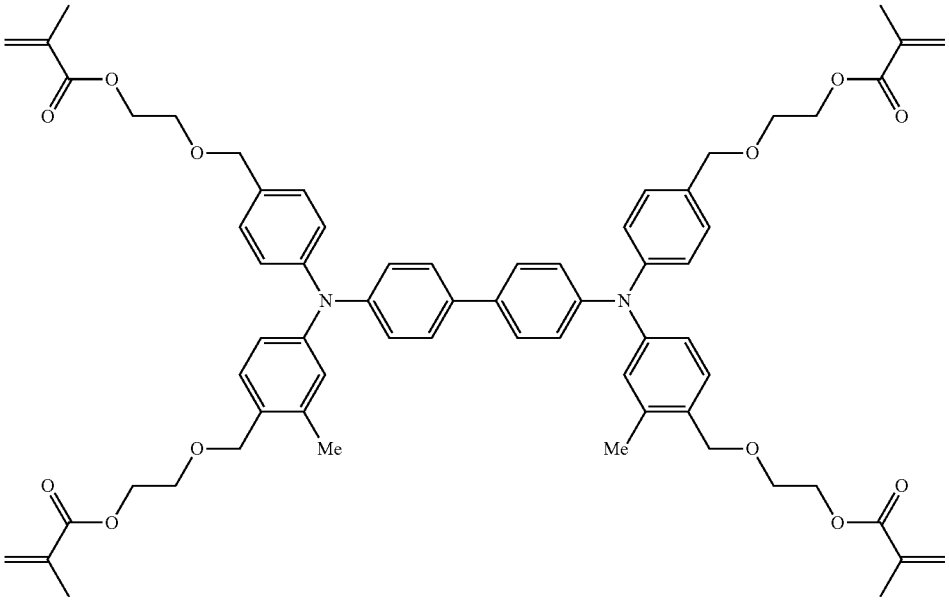
A-5
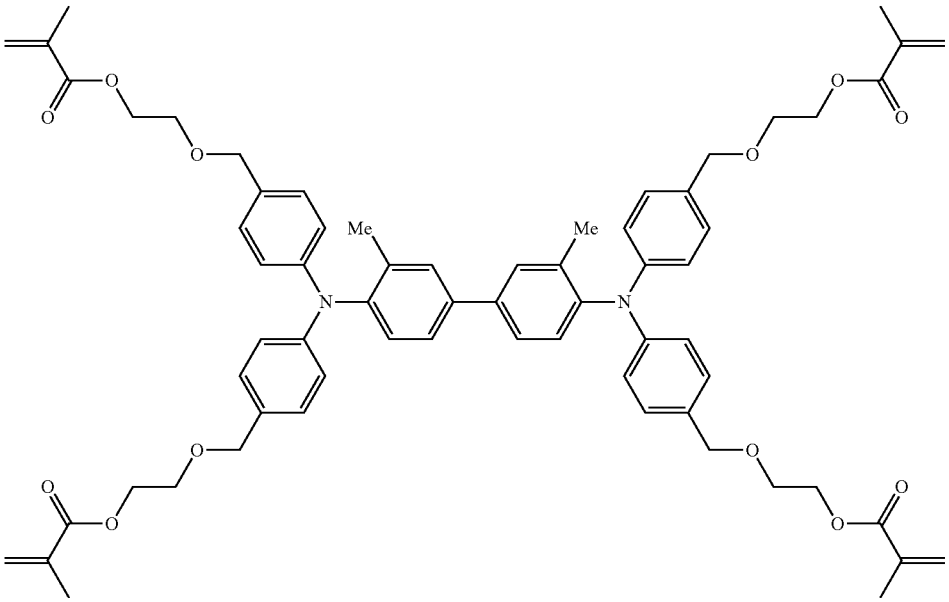

-continued
A-6
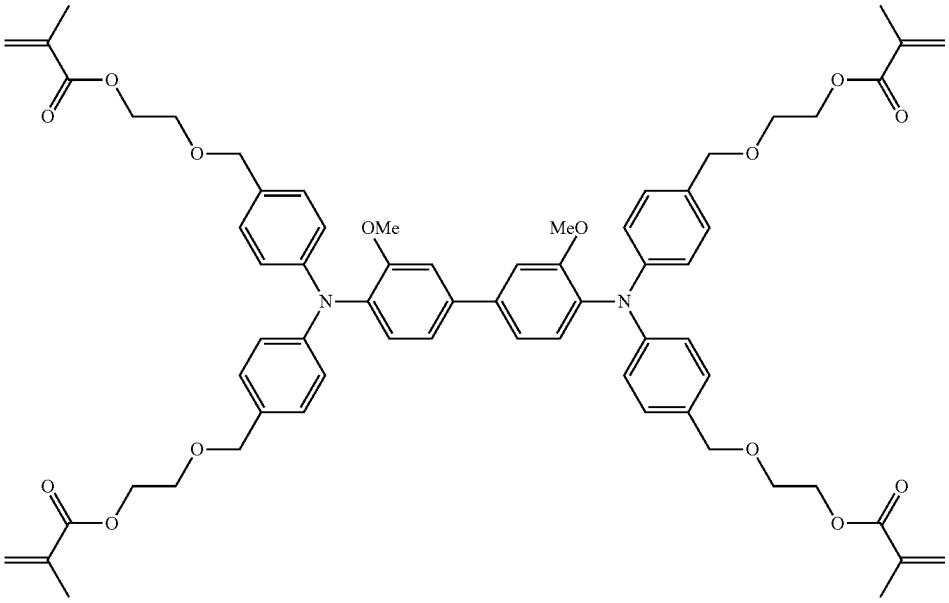
A-7
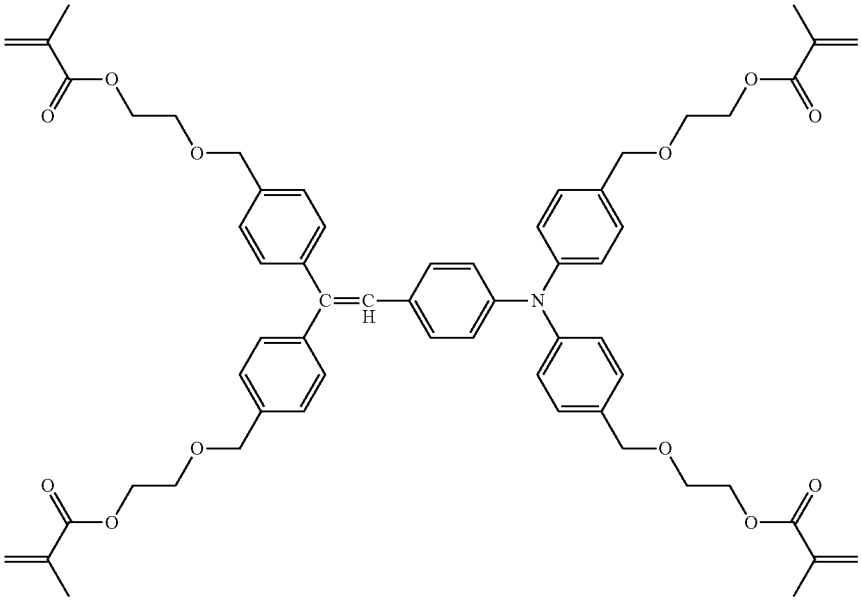

-continued
A-8
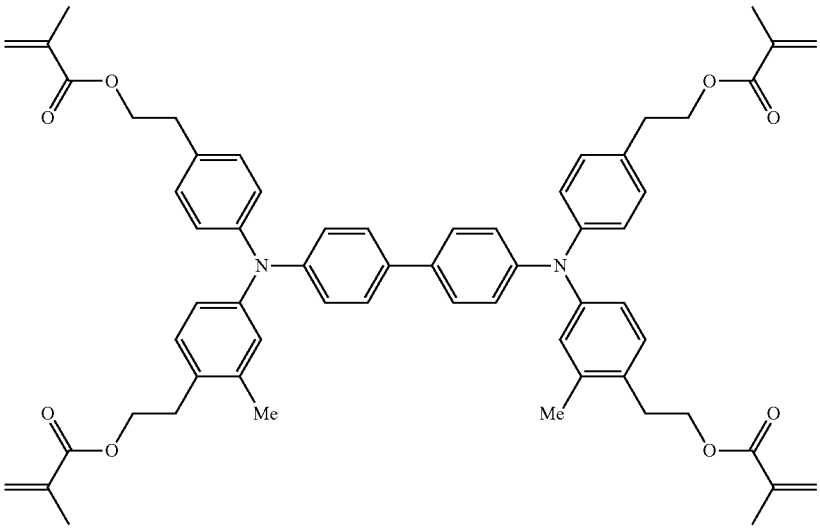
A-9
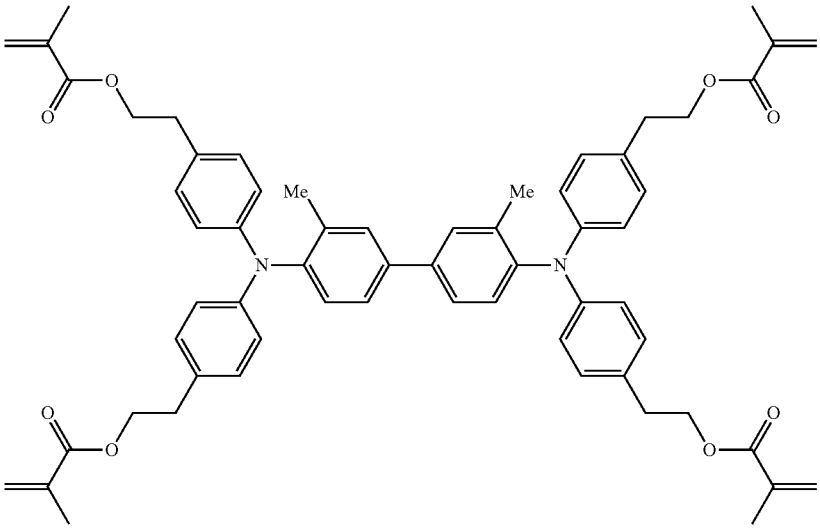
A-10
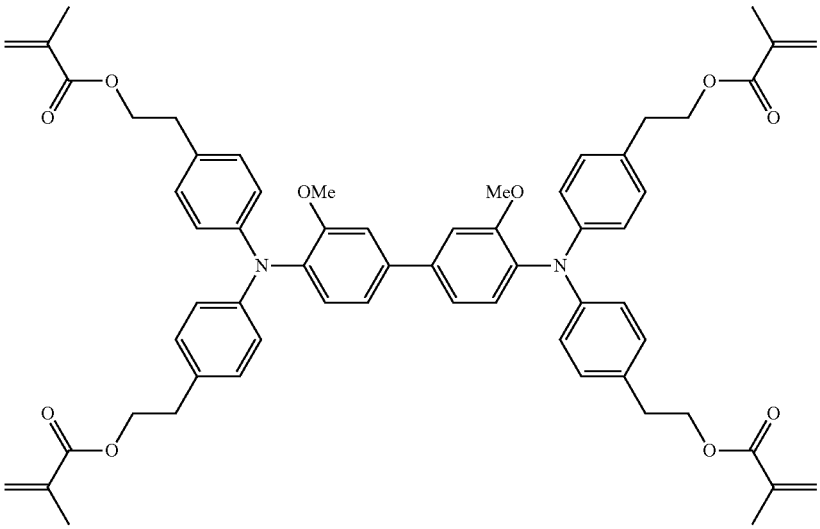

-continued
A-11
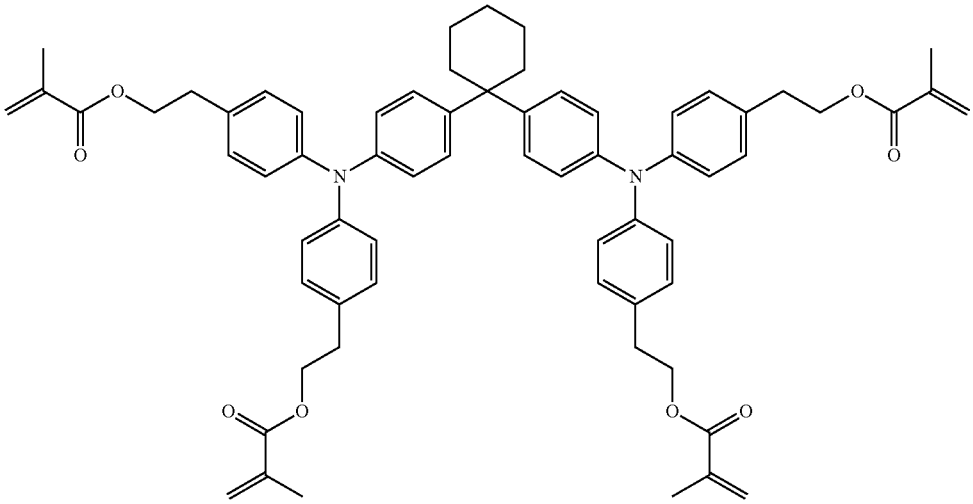
A-12
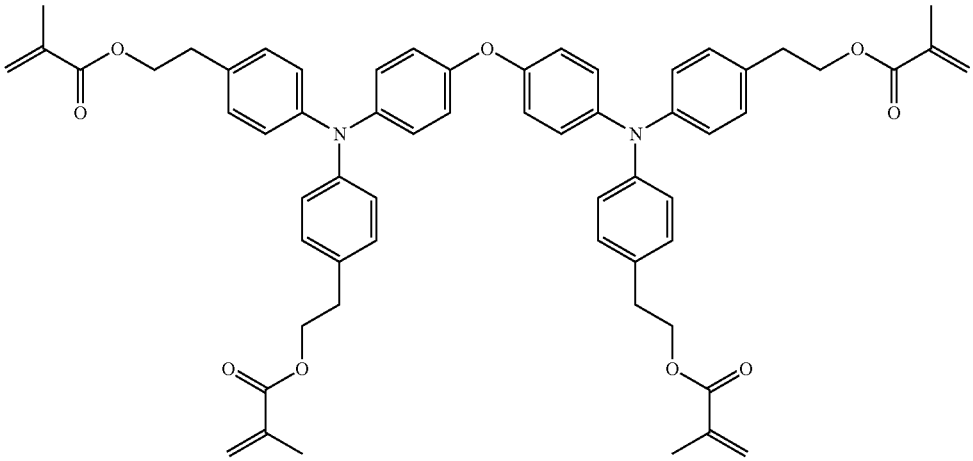
A-13
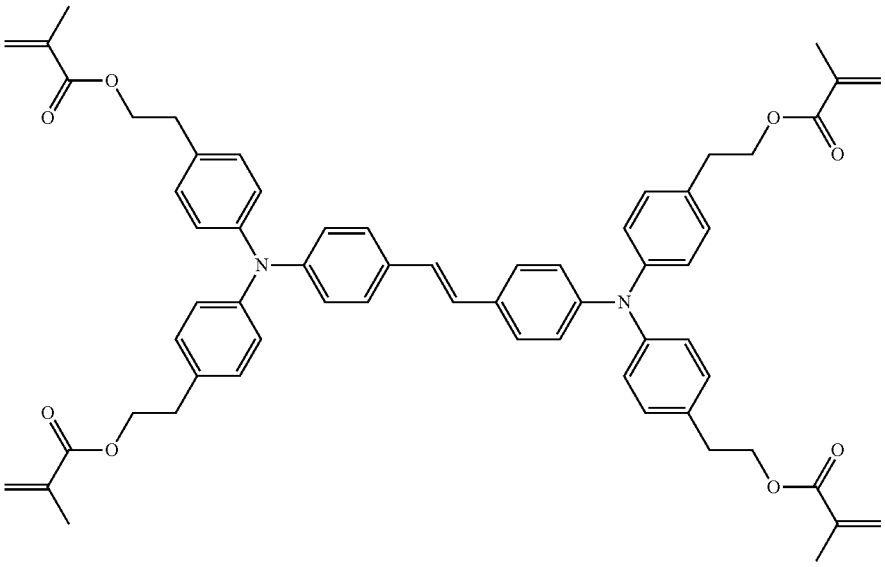

-continued
A-14
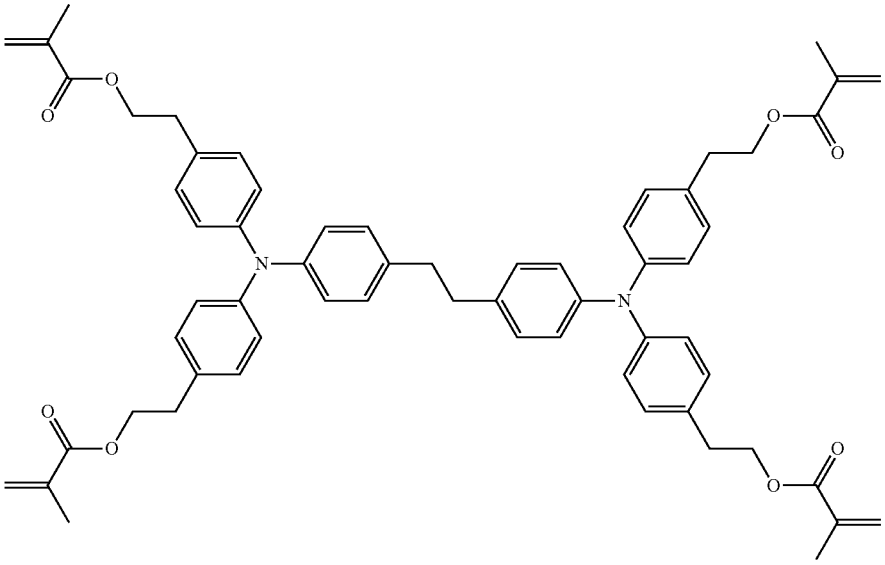
A-15
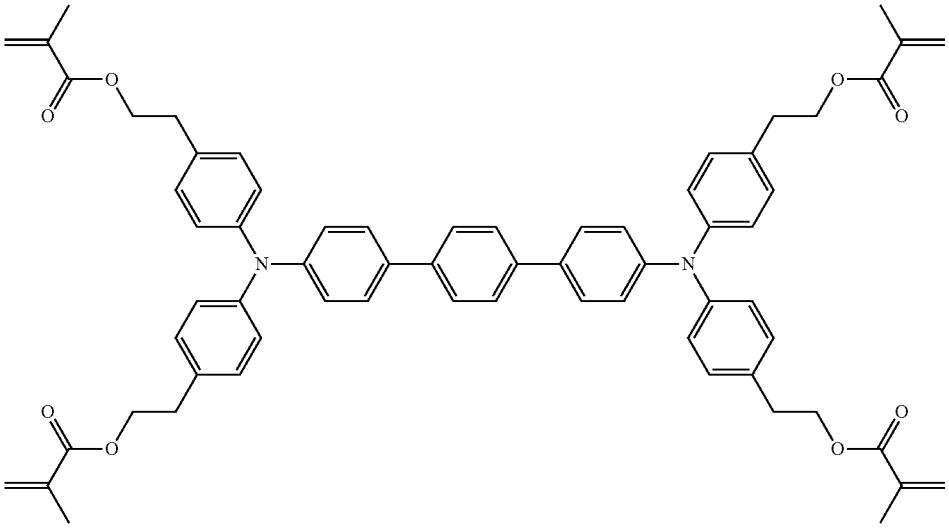
A-16
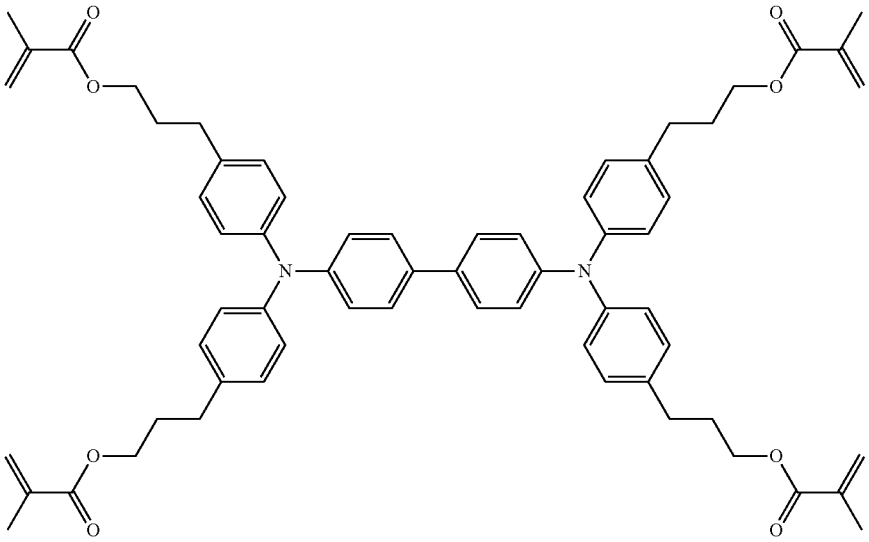

-continued
A-17
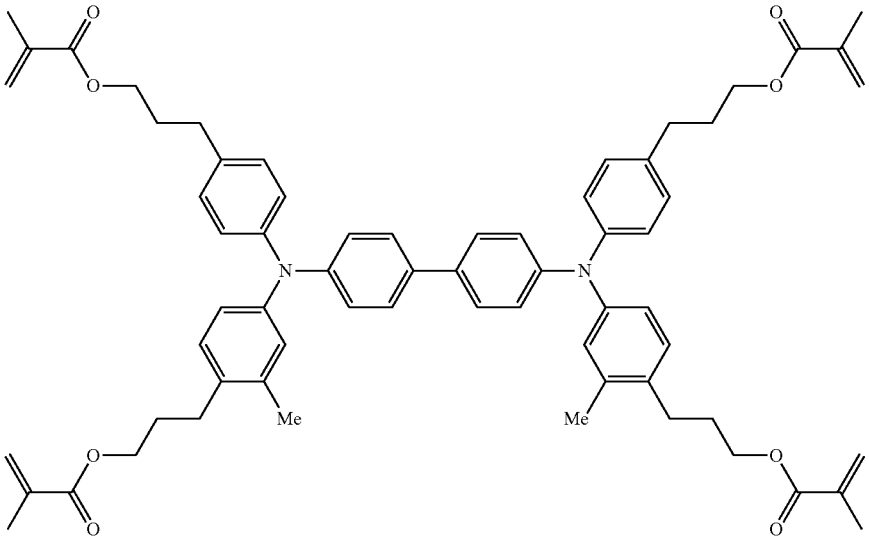
A-18
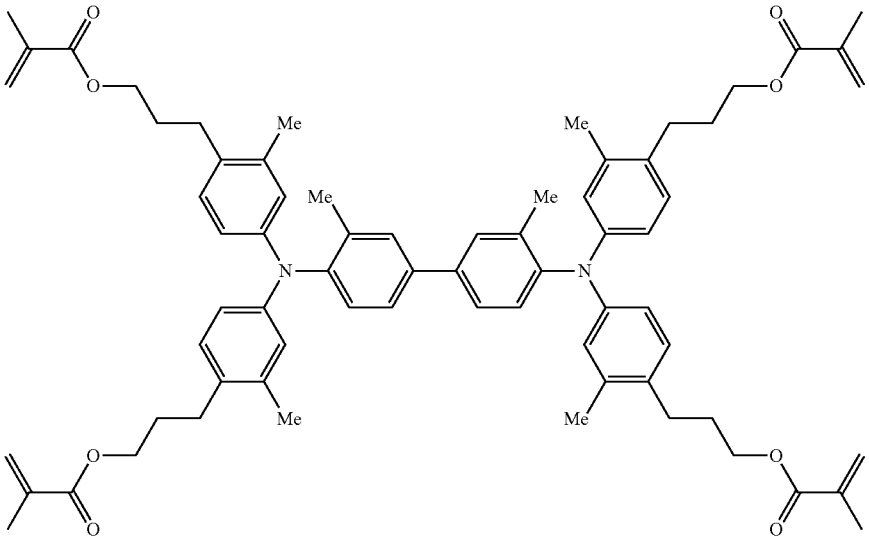

-continued
A-19
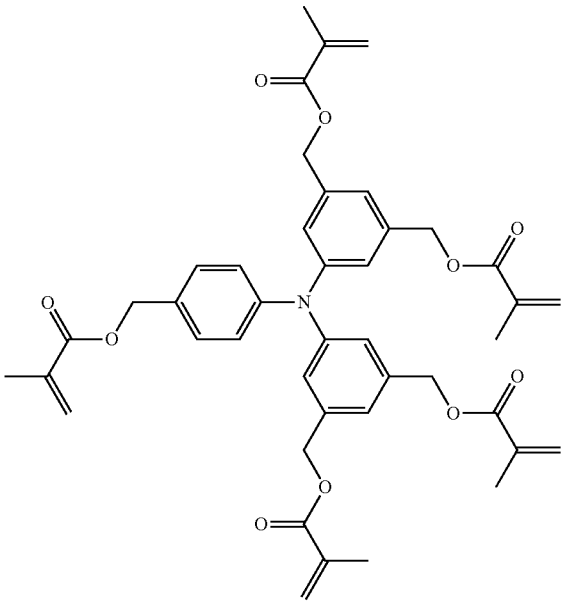
A-20
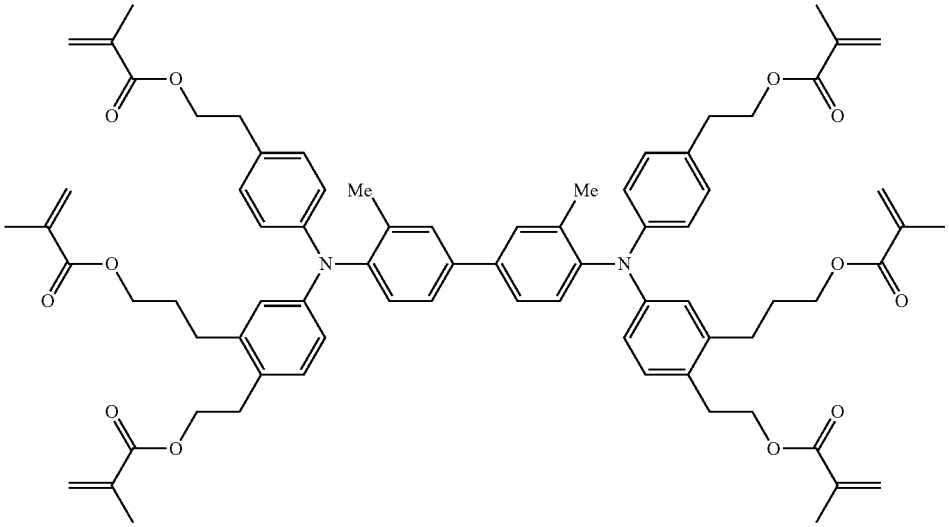

-continued
A-21
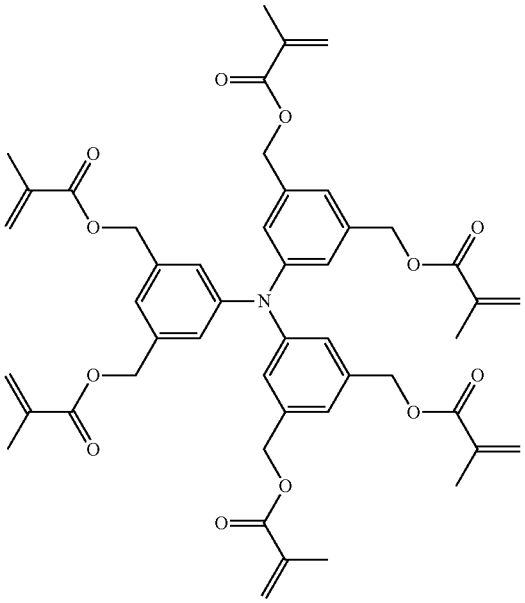
A-22
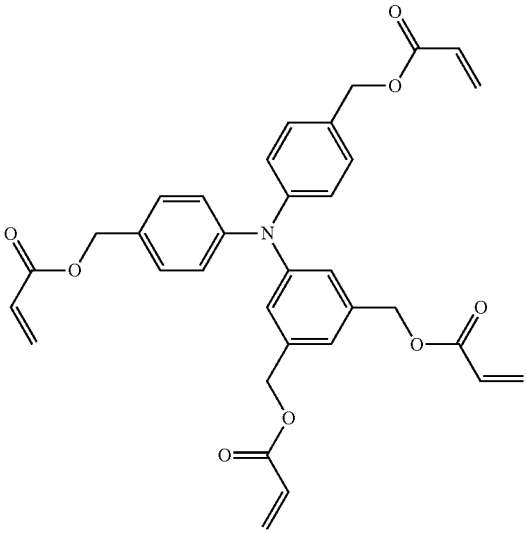
A-23
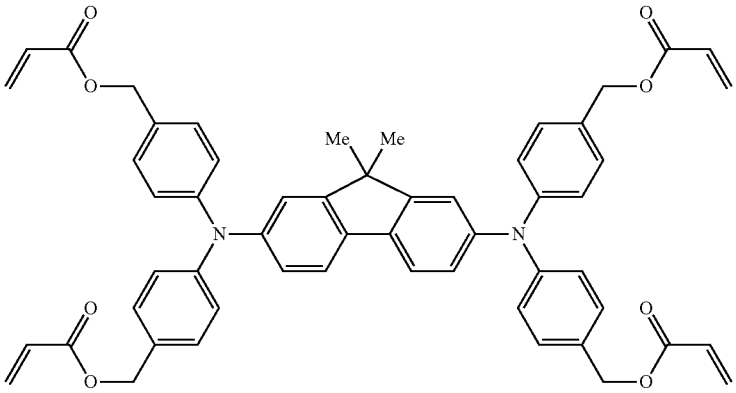
A-24
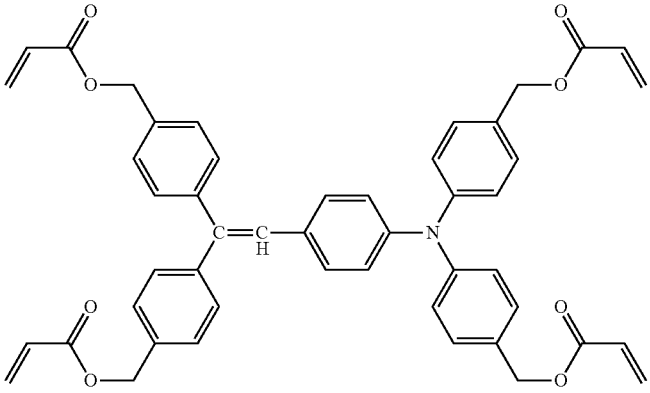

-continued
A-25
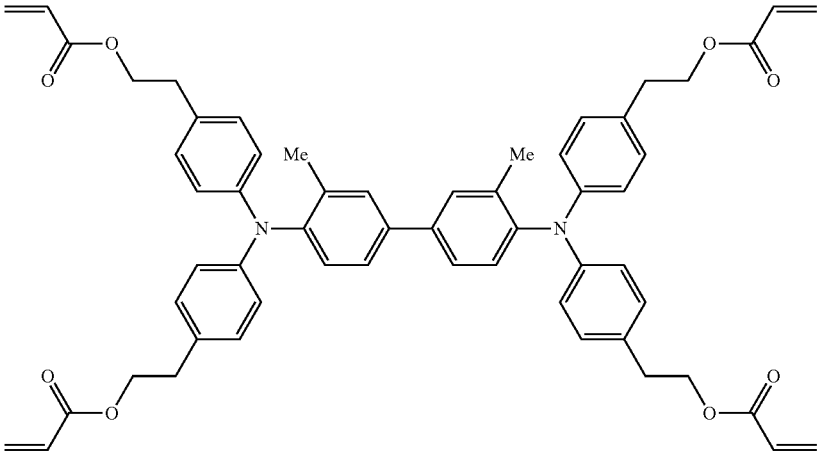
A-26
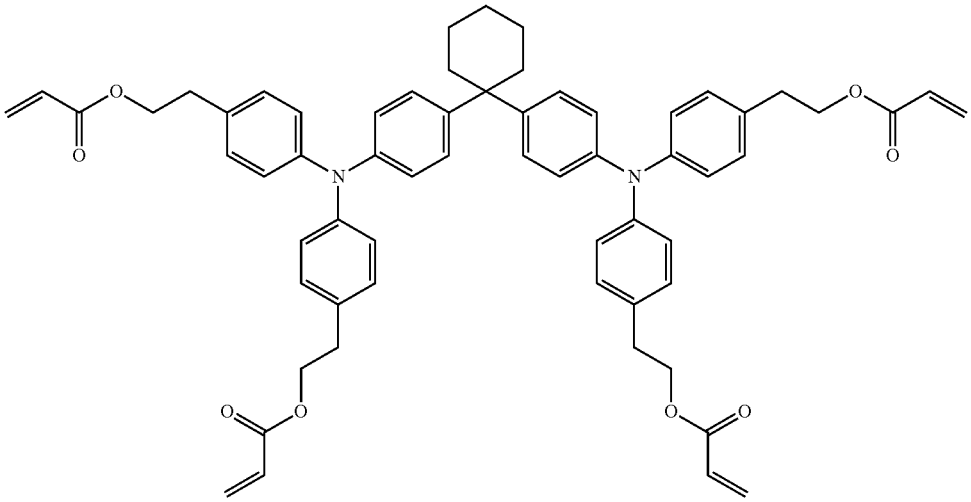
A-27
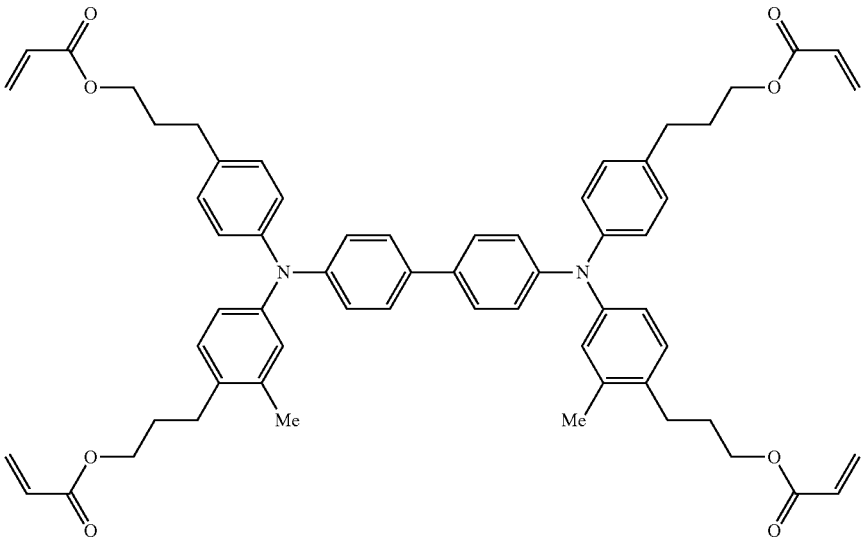

-continued
A-28
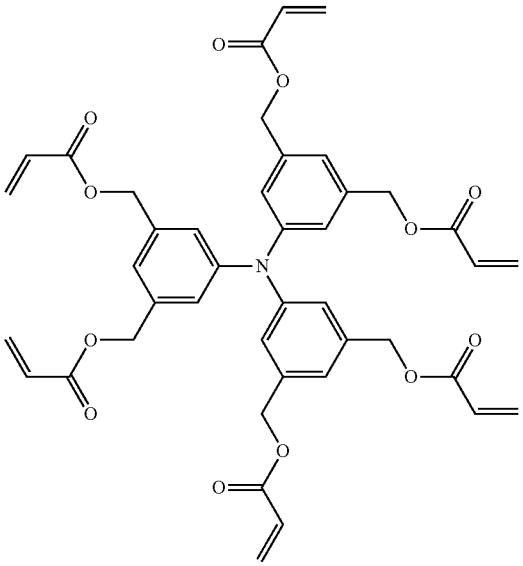
A-29
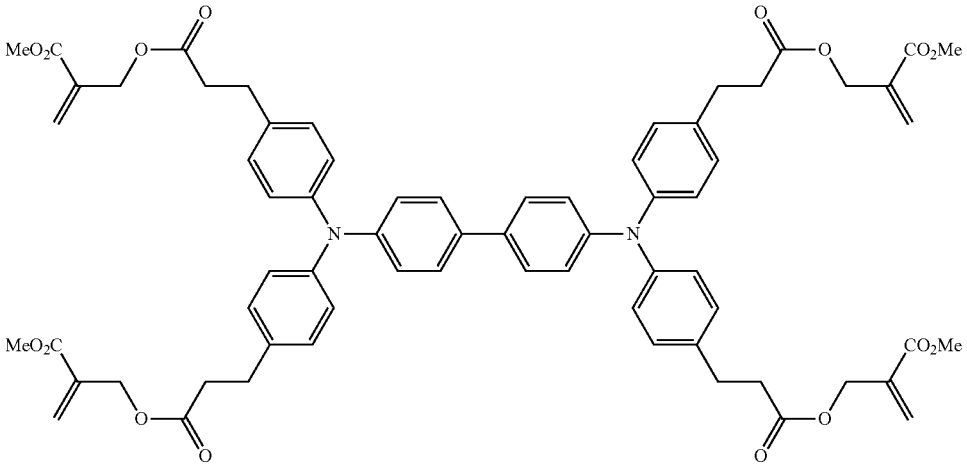
A-30
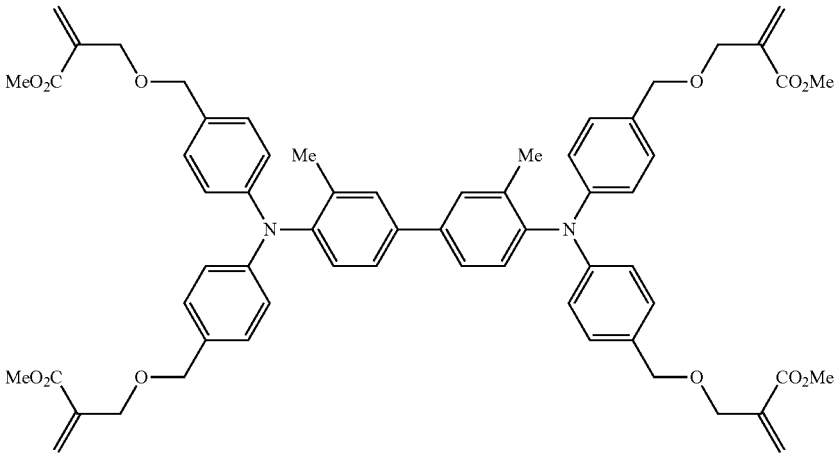

-continued
A-31
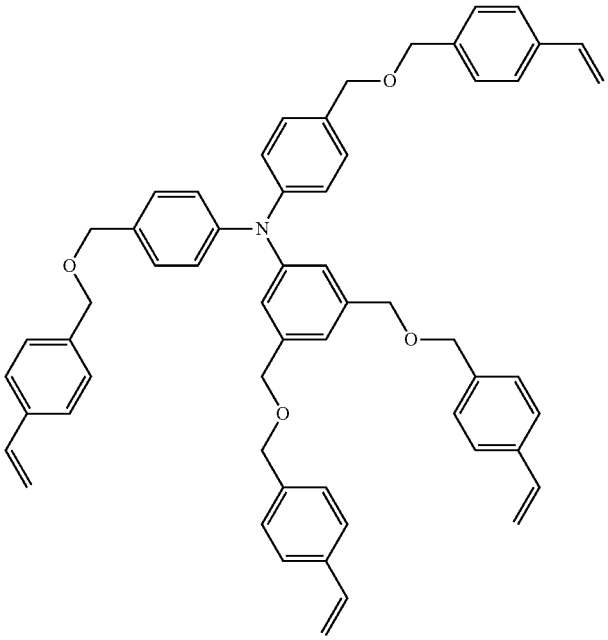
A-32
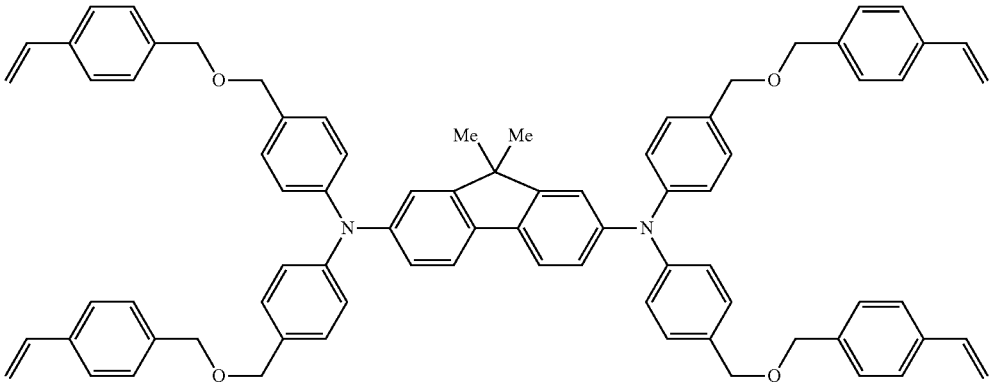
A-33
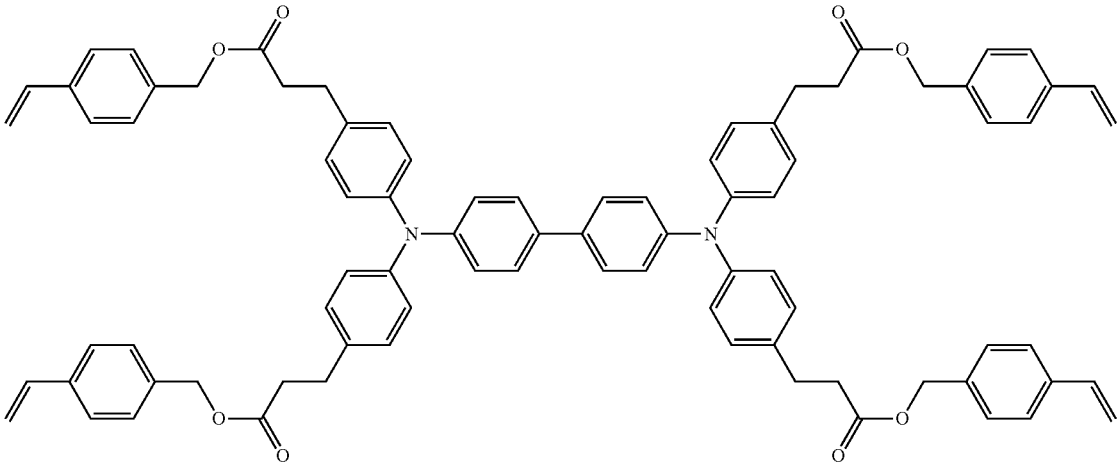

-continued

A-34

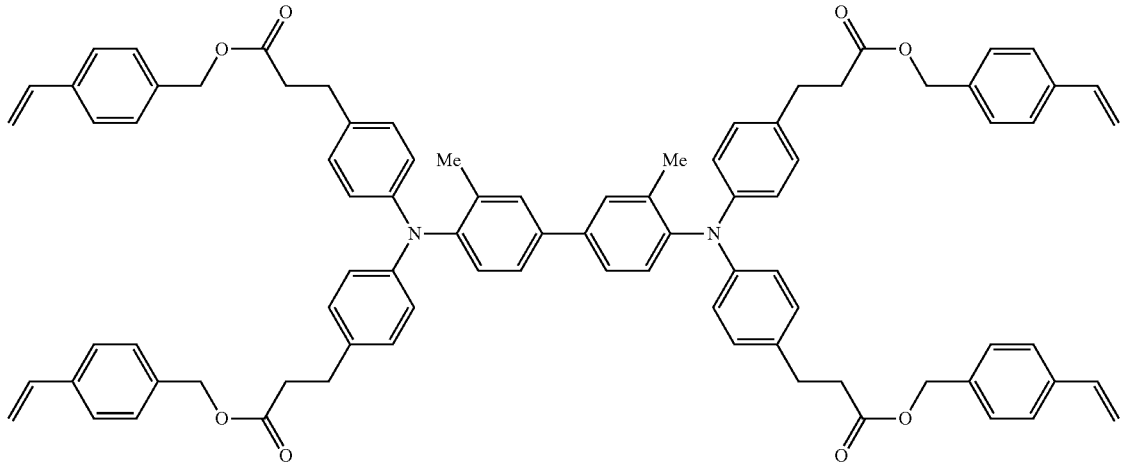

The compound represented by formula (A) is synthesized as follows.

That is, the compound represented by formula (A) can be synthesized by the condensation of alcohol of the precursor and corresponding methacrylic acid, or methacrylic acid halide, or when alcohol of the precursor is a benzyl alcohol structure, the compound can be synthesized by dehydration etherification with a methacrylic acid derivative having a hydroxy group such as hydroxyethyl methacrylate.

The synthesis routes of Compound A-4 and Compound A-17 for use in this embodiment are shown below as examples.

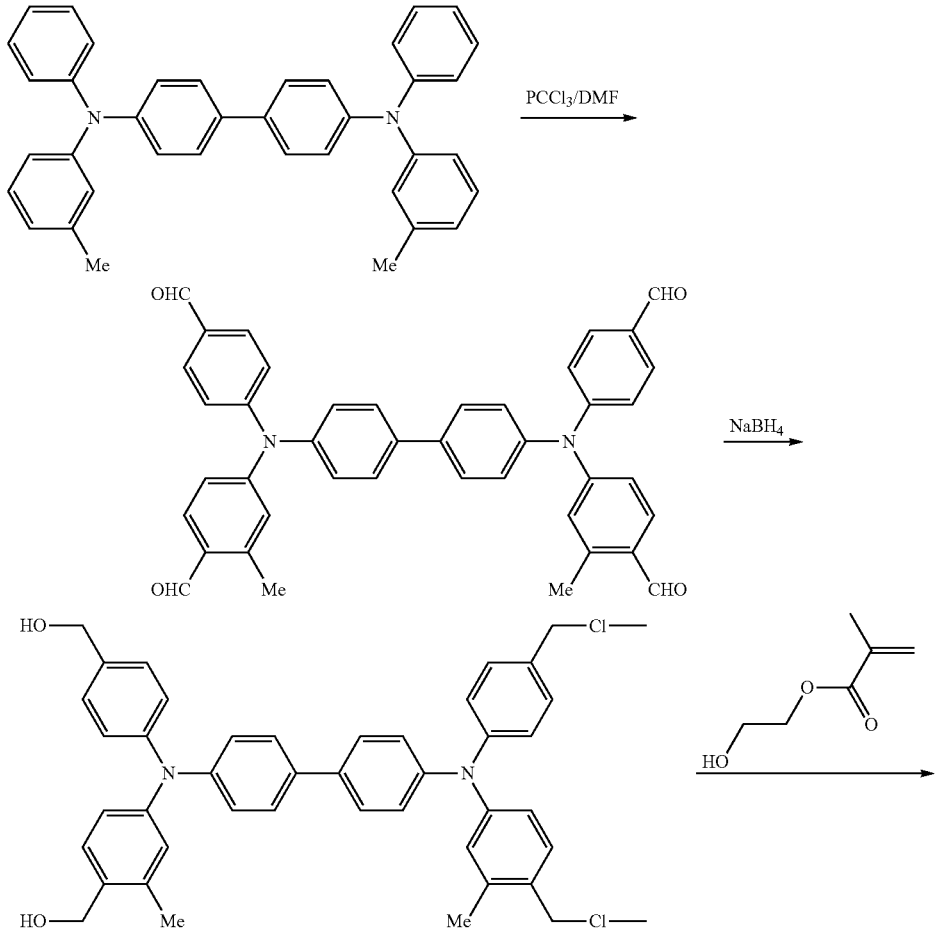

-continued
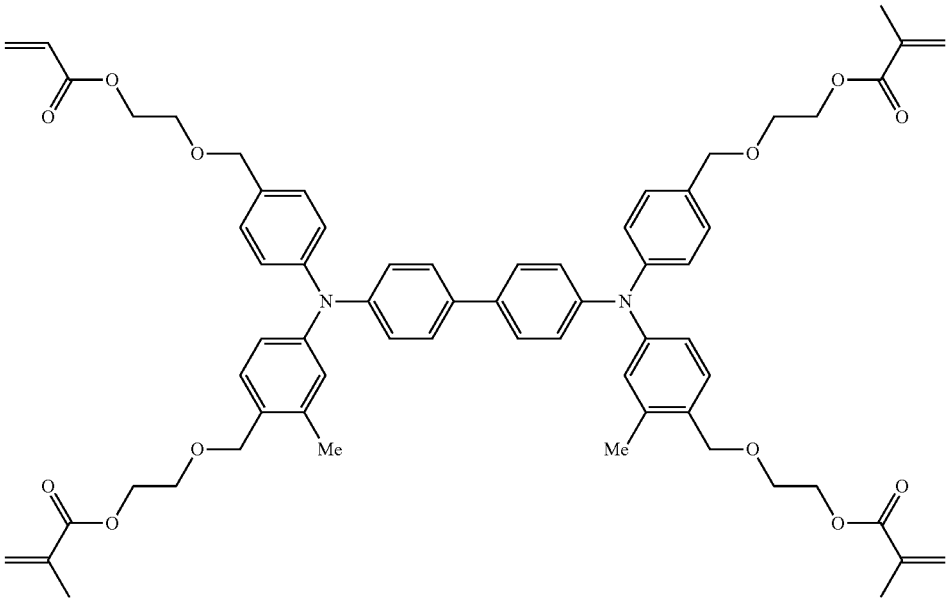
(A-4)
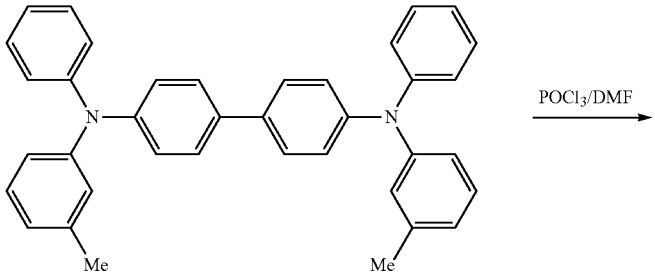
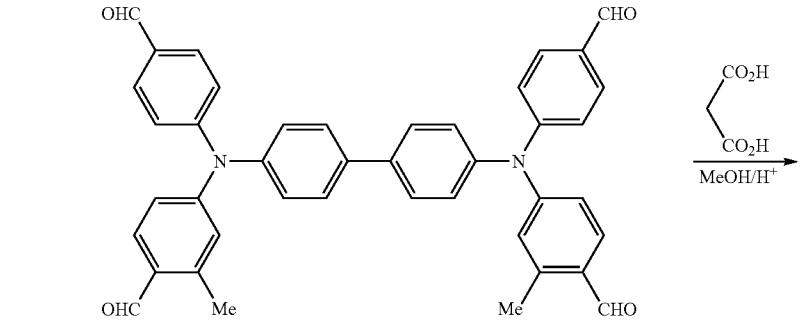
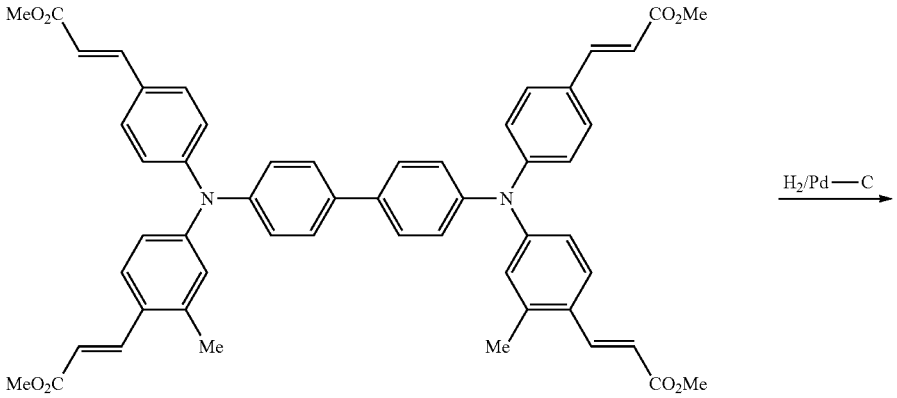

-continued
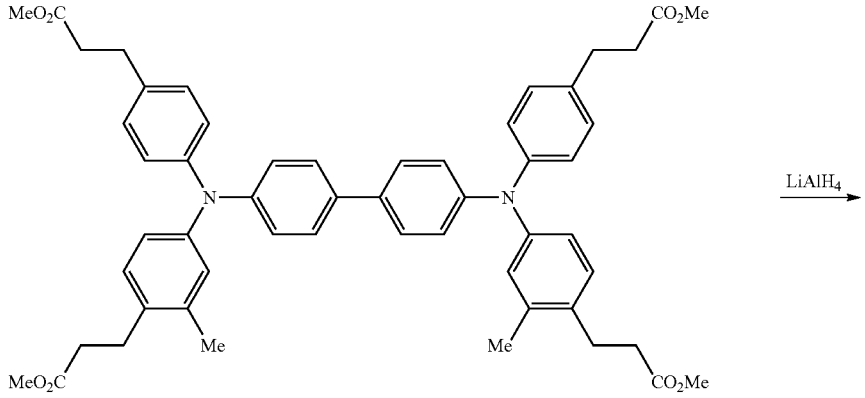
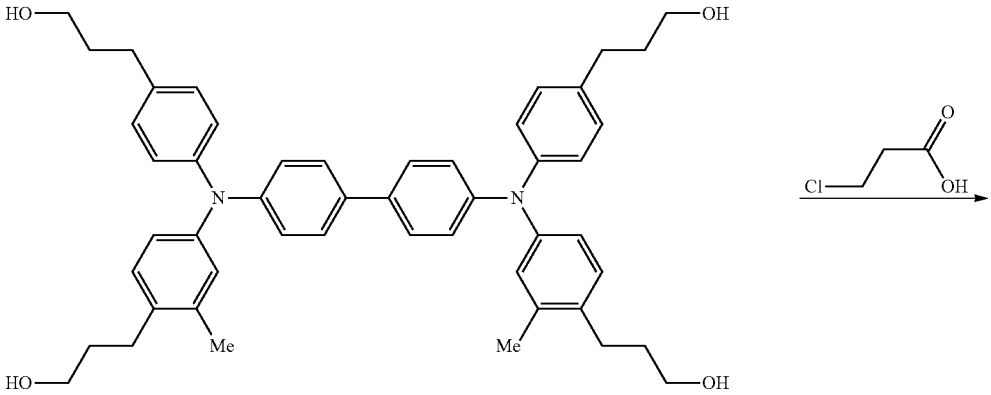
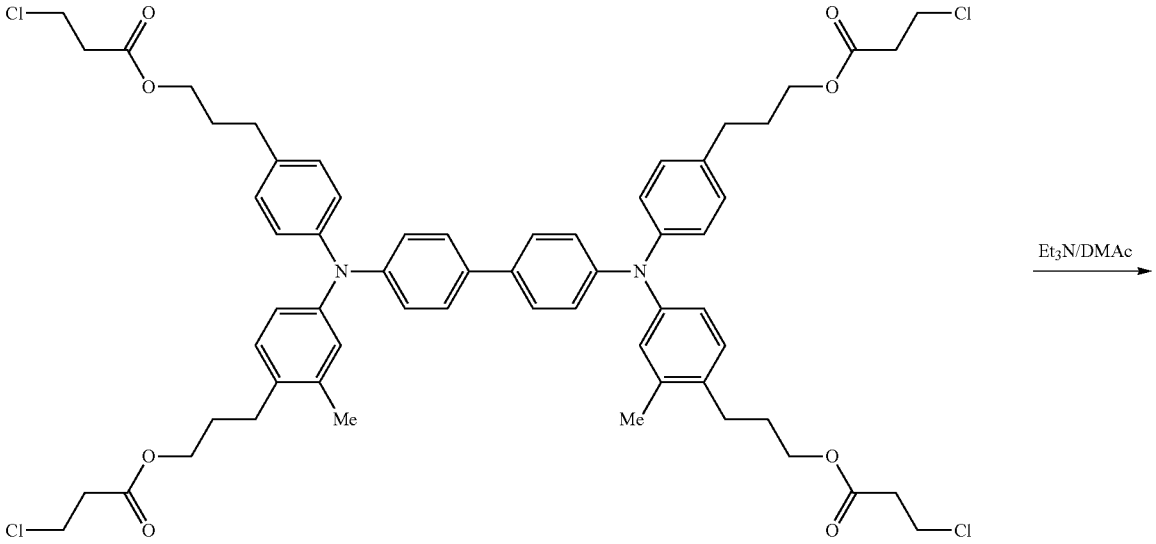

-continued

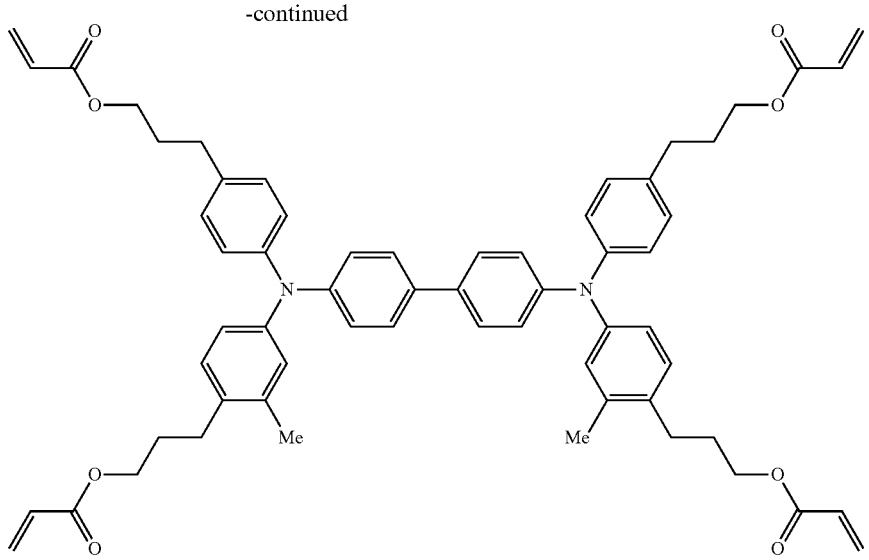

(A-27)

The total content of the specific charge transporting materials (a) (,which is a compound having a charge transporting structure and a radical polymerizable functional group in a molecule) is preferably 30% by weight or more and 100% by weight or less, based on the total solid of the composition for use in forming protective layer (outermost layer), more preferably 40% by weight or more and 100% by weight or less, and even more preferably 50% by weight or more and 100% by weight or less.

When the total content is in this range, a cured film (an outermost layer) having excellent electric characteristics can be obtained and thickening of the cured film is possible.

As described above, it is preferable that the specific charge transporting material (a) have two or more acryloyl groups, methacryloyl groups, derivatives of the acryloyl groups, derivatives of the methacryloyl groups, vinylphenyl groups, or the like, which are chain polymerizable functional groups, in the same molecule in order to attain high strength. Furthermore, it is more preferable to use a compound having a triphenylamine skeleton and three methacryloyl groups, and more preferably 4 or more methacryloyl groups in the same molecule.

If the specific charge transporting material (a) is a compound having a triphenylamine skeleton and 4 or more methacryloyl groups in the same molecule, the total content of the compound is preferably from 5% by weight to 100% by weight, more preferably 10% by weight to 100% by weight, and even more preferably 15% by weight to 100% by weight, with respect to the weight of the entire solid contents of the composition used in the formation of the protective layer (outermost layer) from the viewpoint of strength. Within the above range, a protective layer having a surface which is even more difficult to be abraded can be obtained.

(Other Charge Transporting Materials)

The cured film constituting protective layer (outermost layer) 5 may be a cured film using known charge transporting materials not having a reactive group, and charge transporting materials having 1 to 3 reactive groups in the molecule other than the specific charge transporting materials (a), if necessary. The reactive group here means an acryl group or a methacryl group.

Since known charge transporting materials not having a reactive group do not have a reactive group not functioning charge transporting, when these known charge transporting materials are used in combination, for example, they substantially increase the concentration of the charge transporting components and improve the electric characteristics of the cured film (outermost layer). Further, known charge transporting materials not having a reactive group can contribute to the adjustment of the strength of the cured film (outermost layer). Furthermore, because the specific charge transporting materials (a) have a charge transporting structure and they are excellent in compatibility with known charge transporting materials not having a reactive group, it is possible to further improve electric characteristics by doping of conventional charge transporting materials not having a reactive group.

On the other hand, when charge transporting materials having 1 to 3 reactive groups in the molecule are used in combination, the strength of the cured film (outermost layer) can be regulated while maintaining electric characteristics, since crosslinking density of the specific charge transporting materials (a) having four or more methacryloyl groups (reactive groups) can be lessened without reducing the amount of the charge transporting structures present.

Charge transporting materials usable in combination with the specific charge transporting materials (a) are described below.

As known charge transporting materials not having a reactive group, for example, the materials exemplified later as charge transporting materials constituting charge transporting layer 3 can be used. Of these materials, those having a triphenylamine structure are preferred in view of mobility and compatibility.

As charge transporting materials having 1 to 3 reactive groups in the molecule, materials obtained by introducing 1 to 3 reactive groups to known charge transporting materials are exemplified. Of such materials, compounds having a triphenylamine structure and 1 to 3 acryl groups or methacryloyl groups in one and the same molecule are preferred in view of mobility and compatibility. In particular, compounds represented by formula (A), wherein D represents $—(CH_2)_f—(O—CH_2—CH_2)_g—O—CO—C(R)=CH_2$, f represents an integer of 0 to 5, g represents 0 or 1, R represents a hydrogen atom or a methyl group, and the total number of D is 1 or more and 3 or less are preferred, and compounds in which f in D is an integer of 1 to 5, and R represents a methyl group are especially preferred.

The specific examples of charge transporting materials having 1 to 3 reactive groups in the molecule are shown below.

As the specific examples of the charge transporting materials having one reactive group in the molecule, the following Compounds I-1 to I-12 are exemplified, but the invention is not restricted thereto.

I-1

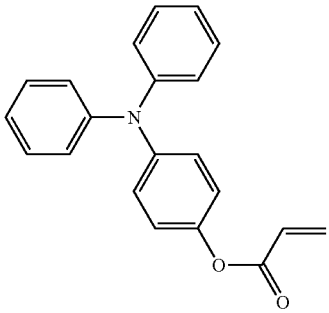

I-2

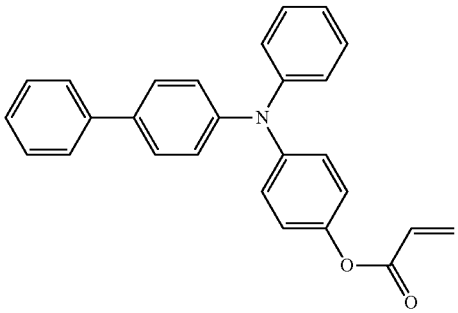

I-3

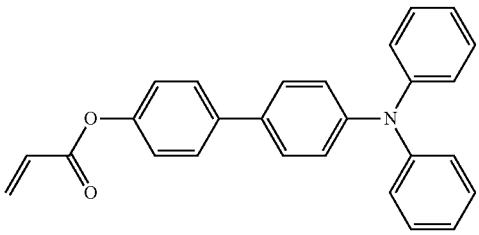

I-4

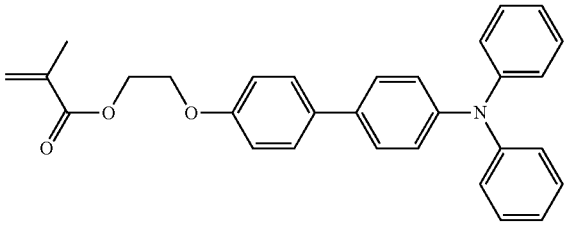

-continued

I-5

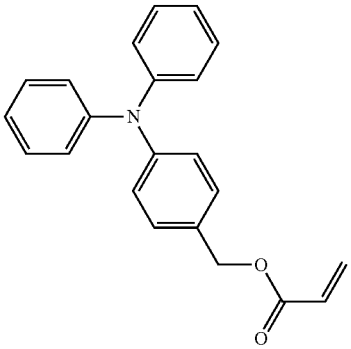

I-6

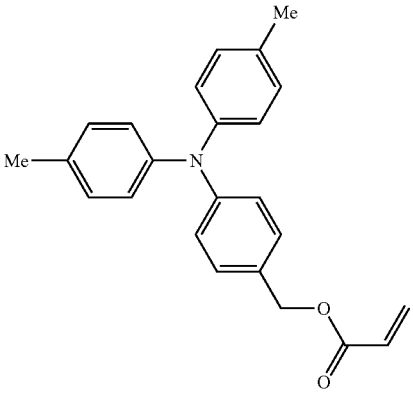

I-7

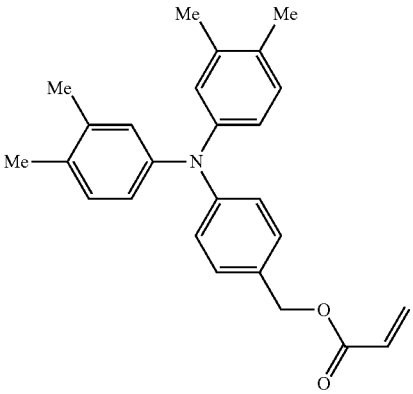

I-8

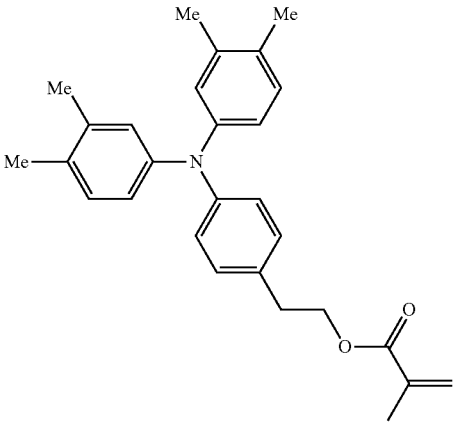

-continued
I-9
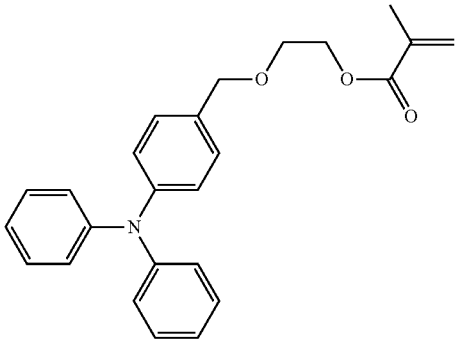
I-10
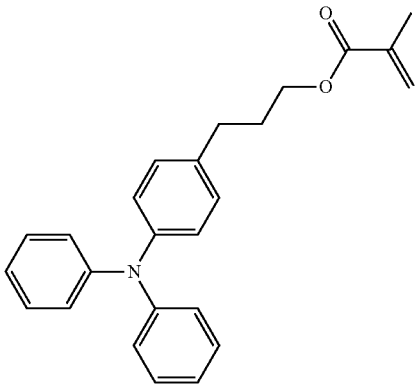
I-11
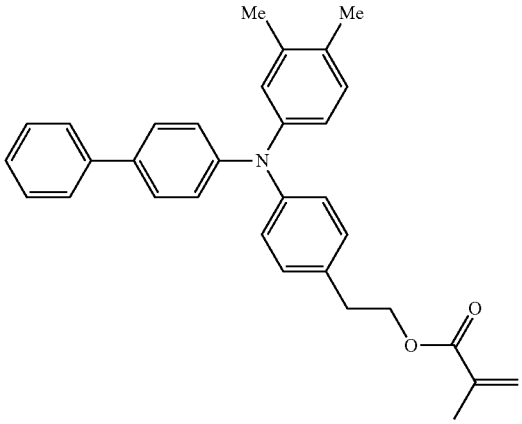
-continued
I-12
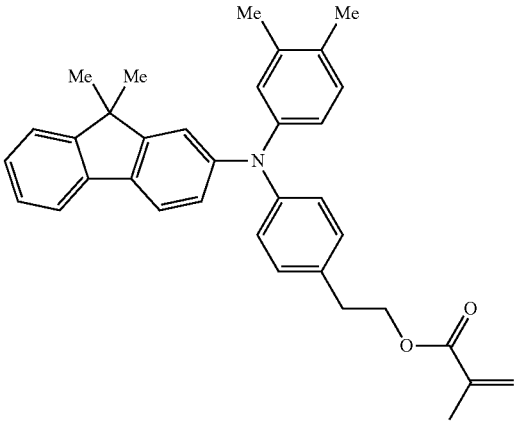
I-13
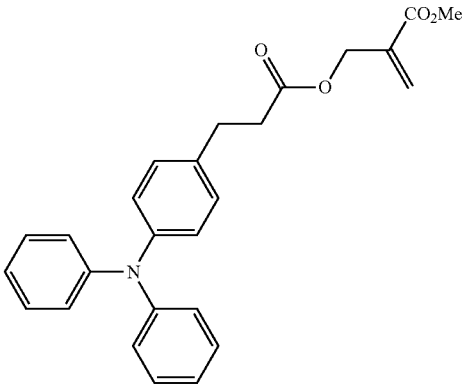
As the specific examples of the charge transporting materials having two reactive groups in the molecule, the following Compounds II-1 to II-22 are exemplified, but the invention is not restricted thereto.
II-1
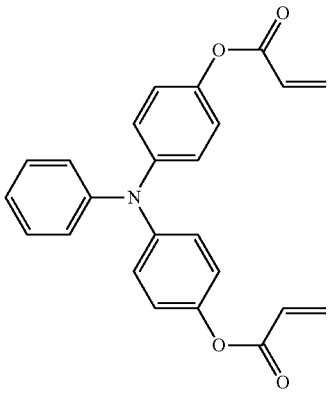
II-2
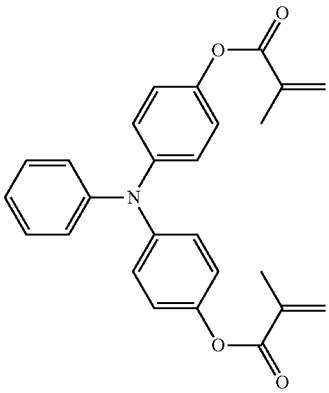

-continued
II-3
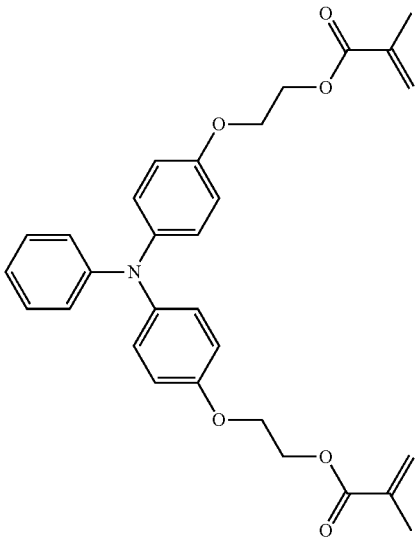
II-4
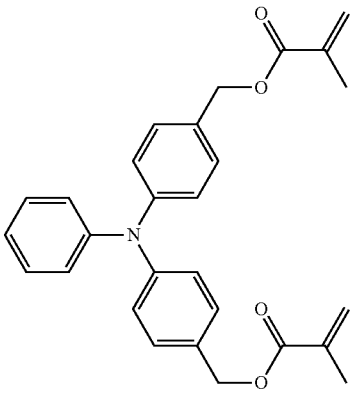
II-5
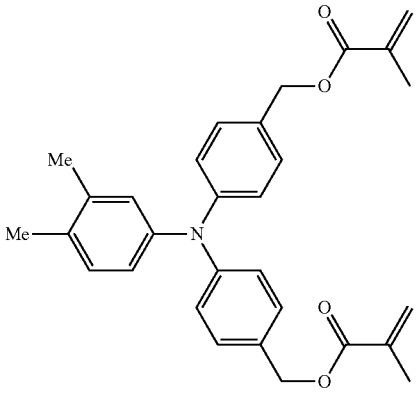
II-6
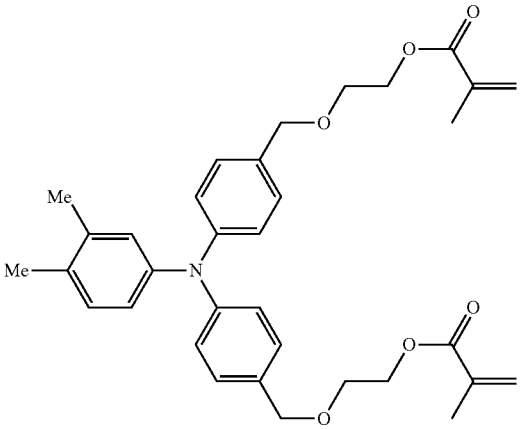
II-7
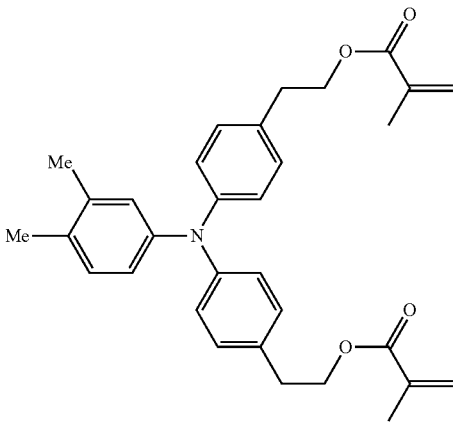
II-8
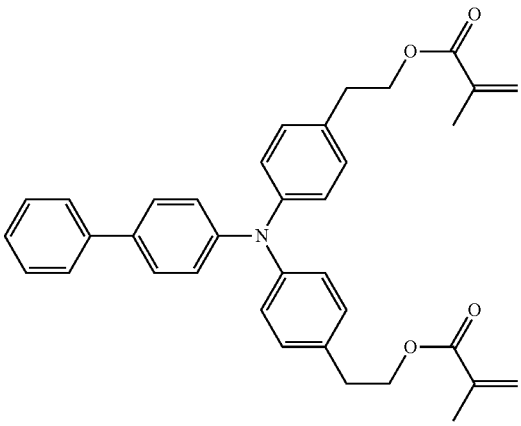

-continued
II-9
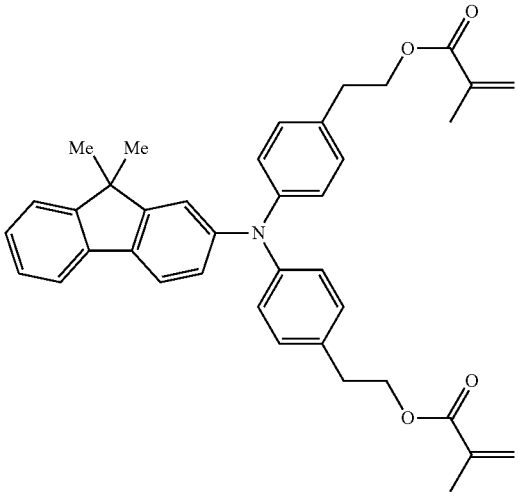
II-10
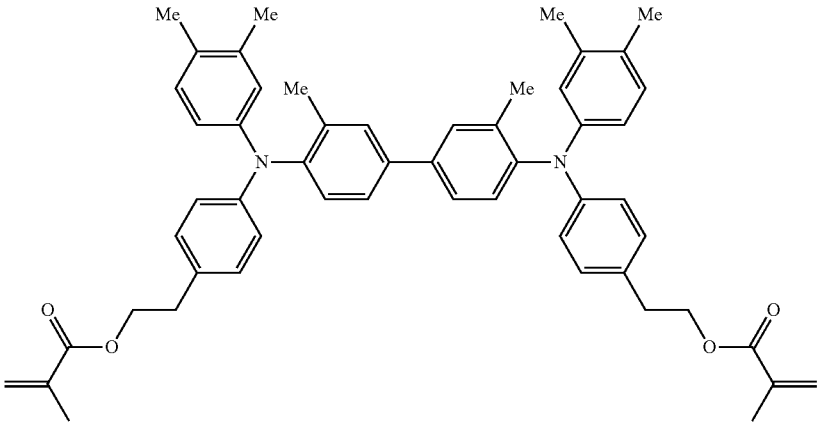
II-11
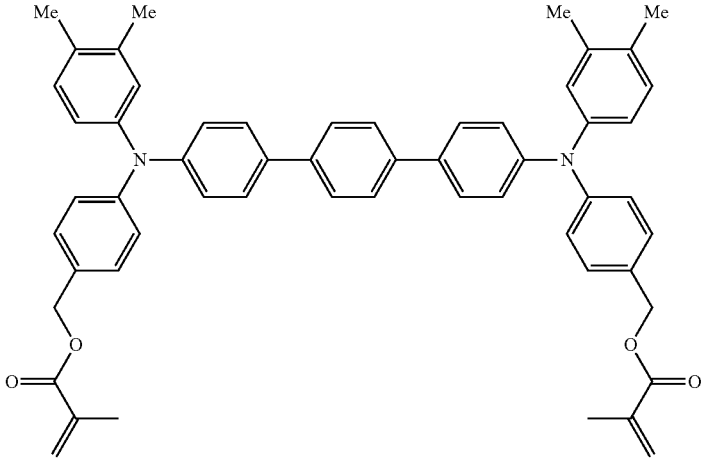

-continued
II-12
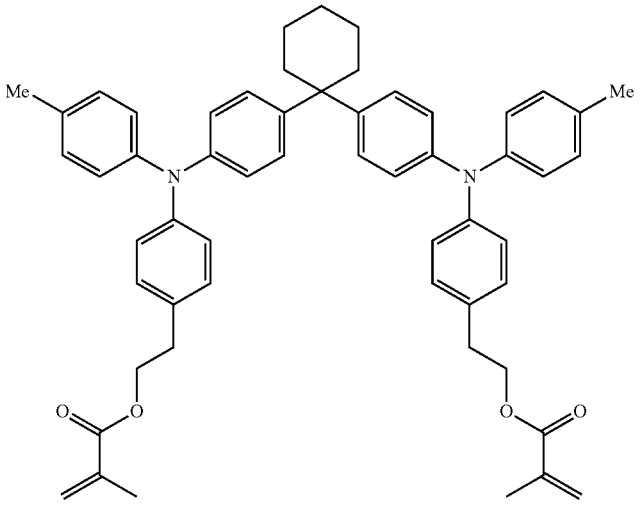
II-13
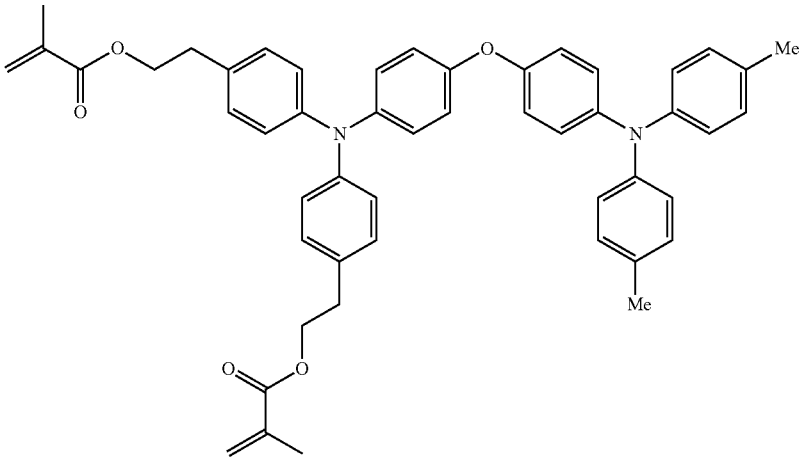
II-14
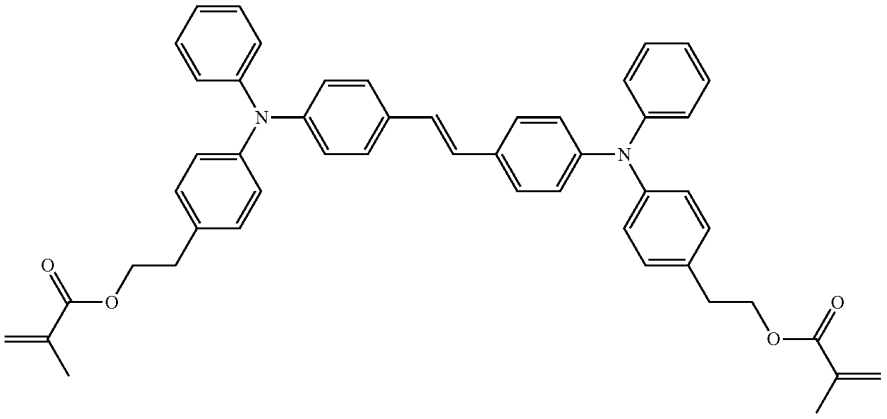

-continued
II-15
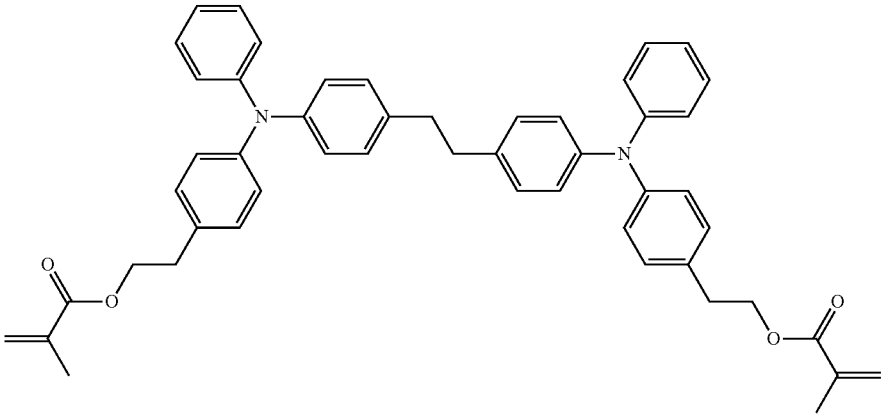
II-16
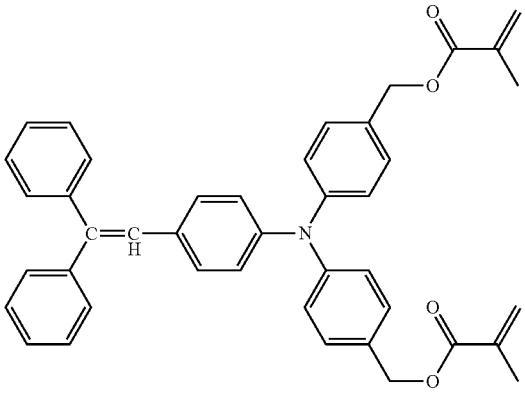
II-17
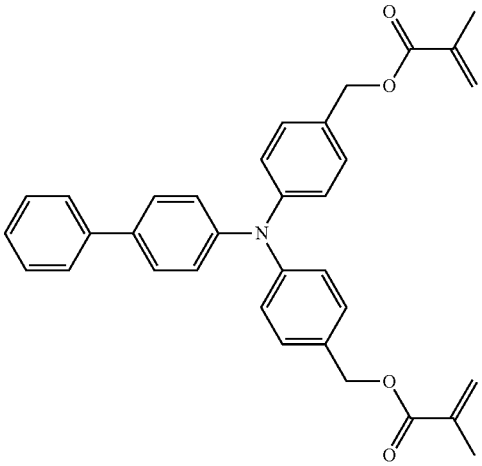
II-18
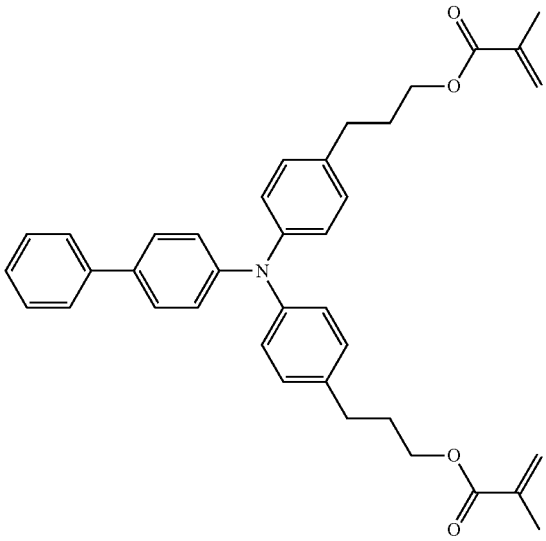

-continued
II-19
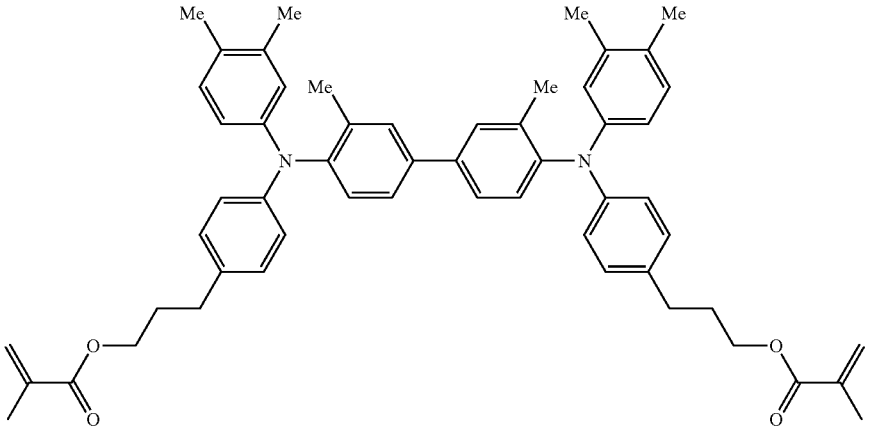
II-20
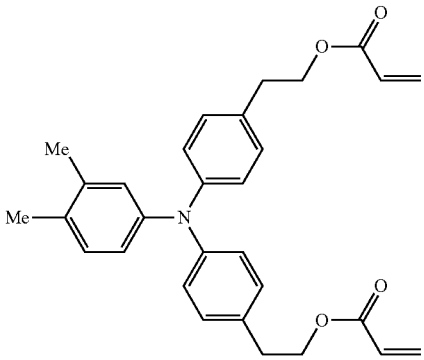
II-21
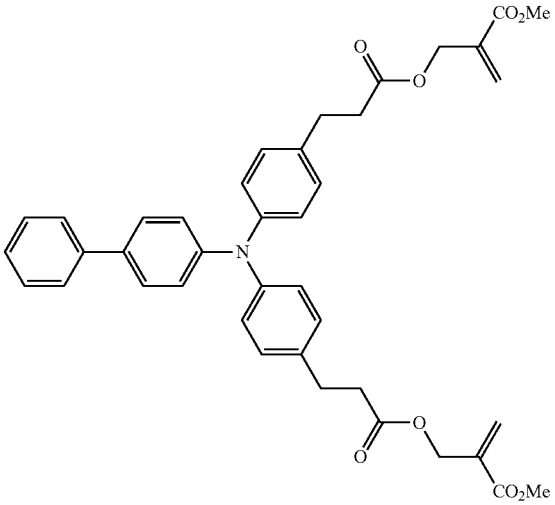
II-22
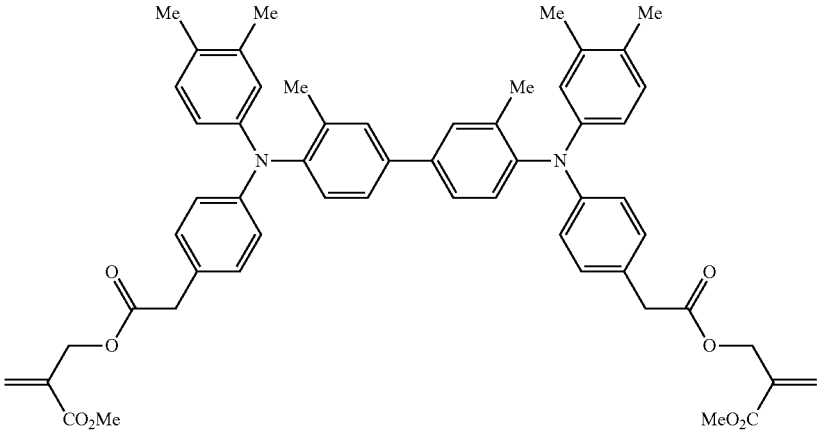
As the specific examples of the charge transporting materials having three reactive groups in the molecule, the following Compounds III-1 to III-13 are exemplified, but the invention is not restricted thereto.

III-1
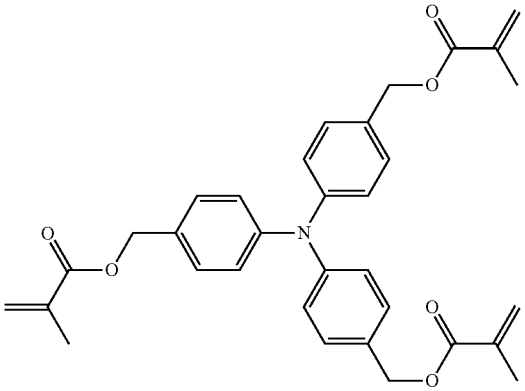
III-2
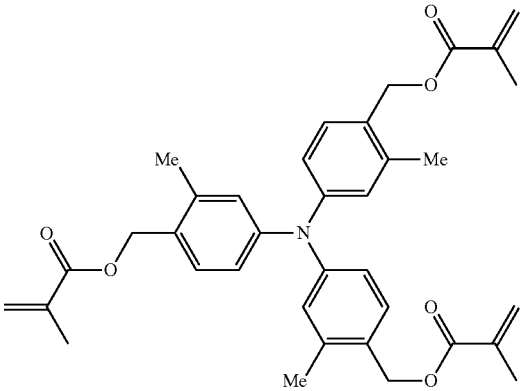
III-3
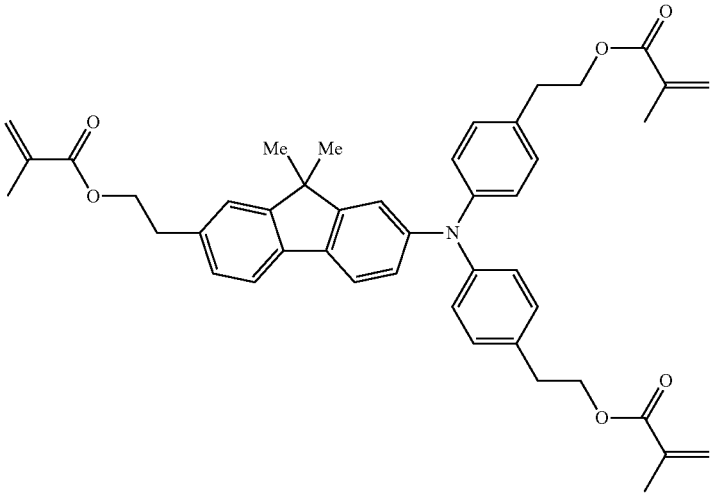
III-4
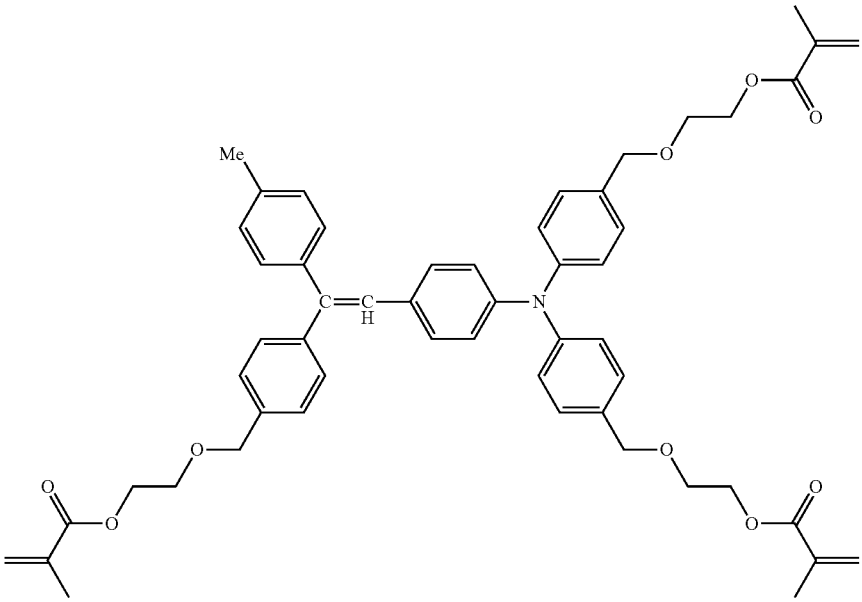

-continued
III-5
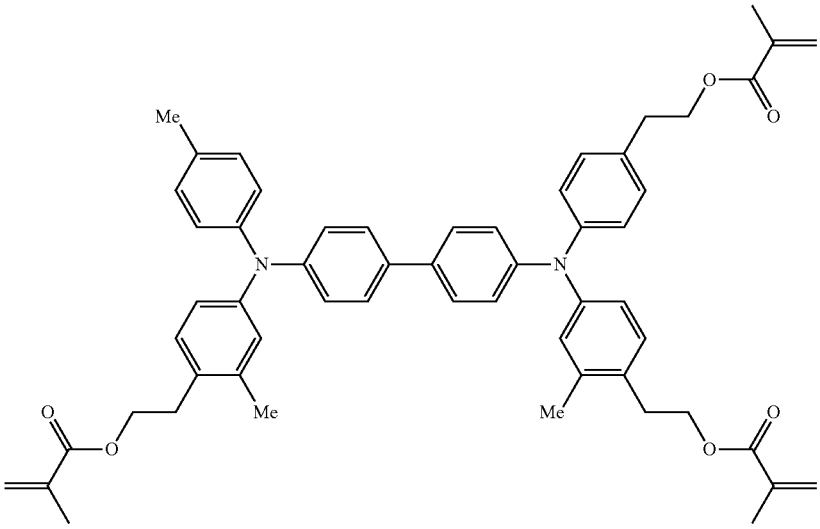
III-6
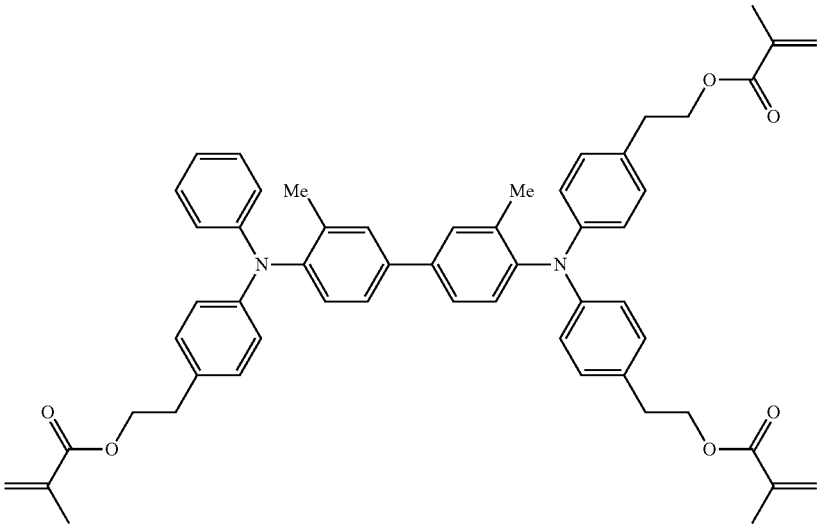
III-7
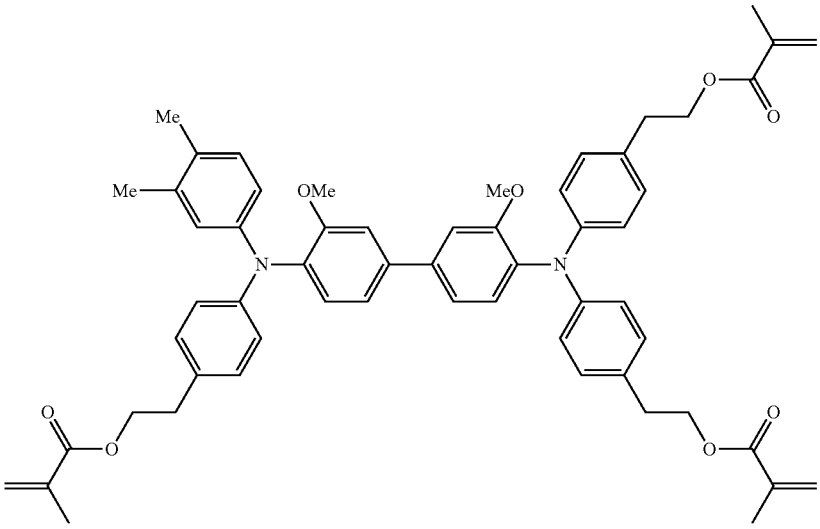

-continued
III-8
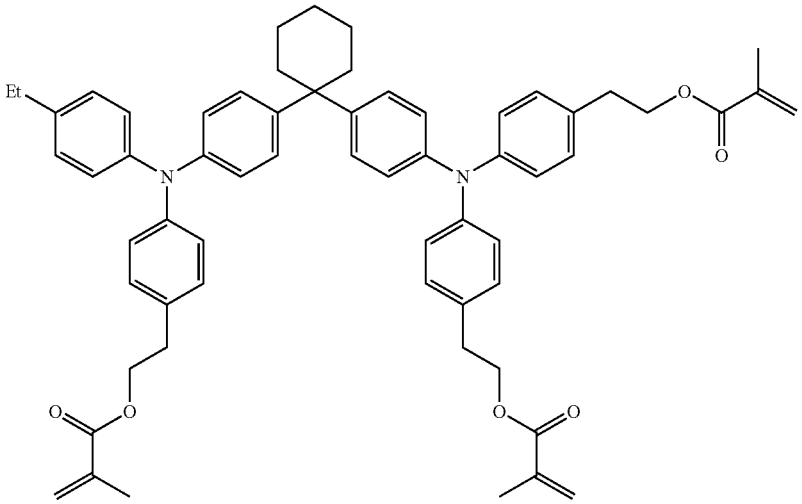
III-9
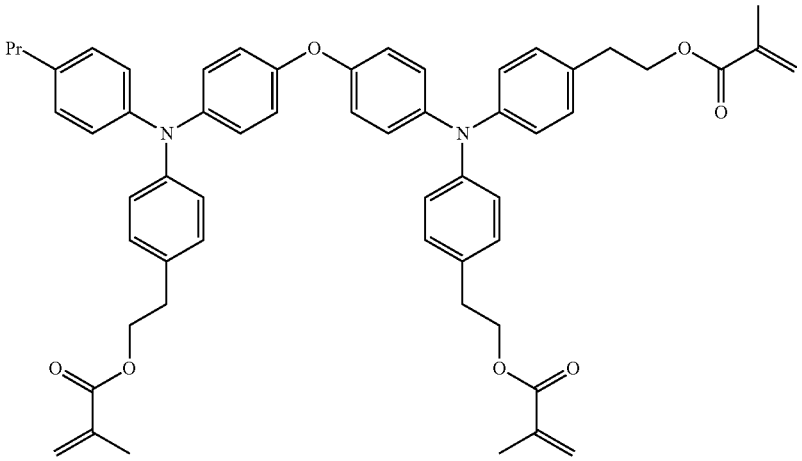
III-10
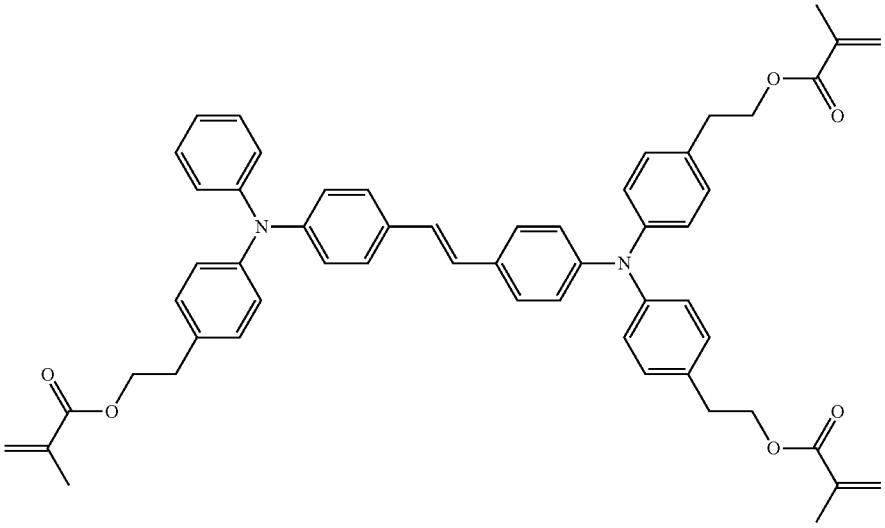

-continued

III-11

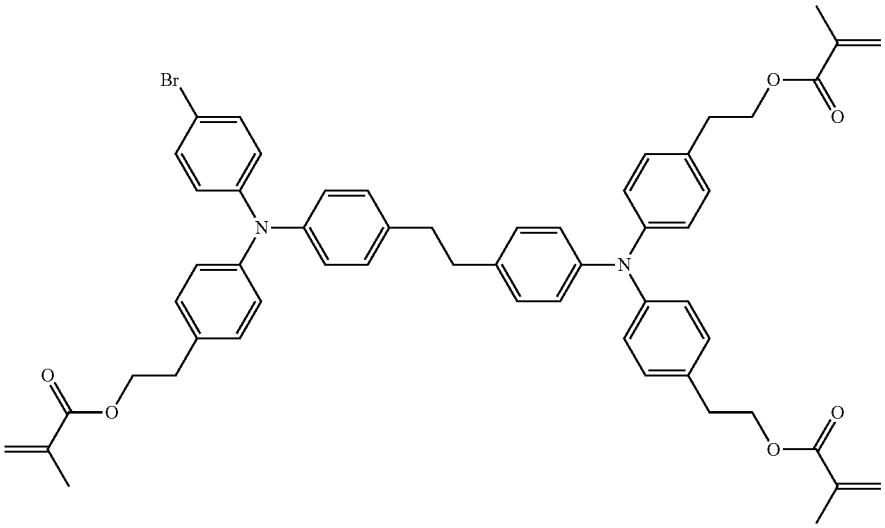

III-12

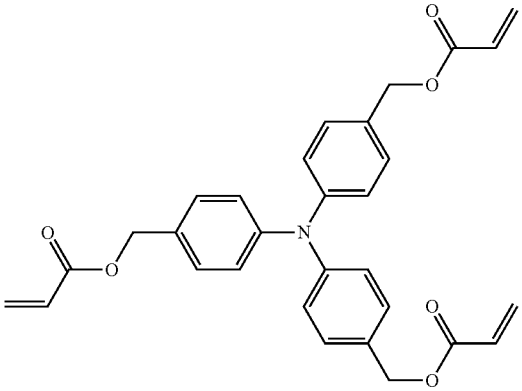

III-13

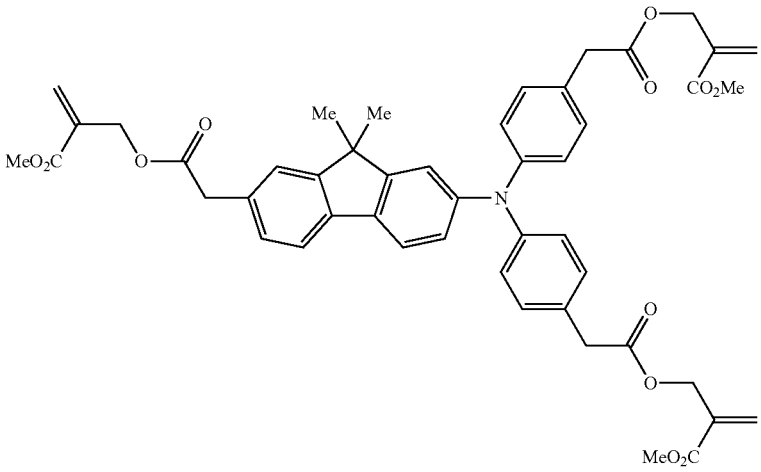

Other charge transporting materials as described above are preferably used in an amount of 0% by weight or more and 70% by weight or less based on the specific charge transporting materials (a), more preferably 0% by weight or more and 65% by weight or less, and still more preferably 0% by weight or more and 60% by weight or less.

In this embodiment, when compounds (e) that react with the specific charge transporting materials (a) are used in combination in the composition containing the specific charge transporting materials (a), it is preferred that all the compounds (e) are compounds having charge transportability.

Specifically, when compounds (e) that react with the specific charge transporting materials (a) are contained in the composition containing the specific charge transporting materials (a), it is preferred that all the compounds (e) comprise charge transporting materials having reactive groups as described above, and especially preferably charge transporting materials having 1 to 3 reactive groups.

By this constitution, mechanical strength of protective layer (outermost layer) may be regulated and the surface of the protective layer having scratch resistance may be obtained, without lowering electric characteristics.

(Catalyst)

The cured product containing a charge transporting skeleton is obtained by polymerizing and curing a compound having a charge transporting skeleton such as the specific charge transporting material (a) and the like, or a composition containing the compound having a charge transporting skeleton by light, electron beam, or heat. For this polymerization and curing reaction, a curing catalyst (polymerization initiator) need not be used, but the reaction efficiently proceeds using the curing catalyst as exemplified below.

As photo-curing catalysts, intramolecular cleavage type and hydrogen drawing type curing catalysts are exemplified.

As the intramolecular cleavage type curing catalysts, benzyl ketal-based, alkylphenone-based, aminoalkylphenone-based, phosphine oxide-based, titanocene-based, and oxime-based curing catalysts are exemplified.

Specifically, as benzyl ketal-based curing catalyst, 2,2-dimethoxy-1,2-diphenylethan-1-one is exemplified.

As alkylphenone-based photo-curing catalysts, 1-hydroxycyclohexyl phenyl ketone, 2-hydroxy-2-methyl-1-phenylpropan-1-one, 1-[4-(2-hydroxyethoxy)phenyl]-2-hydroxy-2-methyl-1-propan-1-one, 2-hydroxy-1-{4-[4-(2-hydroxy-2-methylpropionyl)benzyl]phenyl}-2-methylpropan-1-one, acetophenone, and 2-phenyl-2-(p-toluenesulfonyloxy)-acetophenone are exemplified.

As aminoalkylphenone-based curing catalysts, p-dimethylaminoacetophenone, p-dimethylaminopropiophenone, 2-methyl-1-(4-methylthiophenyl)-2-morpholinopropan-1-one, and 2-benzyl-2-dimethylamino-1-(4-morpholinophenyl)-butanone-1,2-(dimethylamino)-2-[(4-methylphenyl) methyl]-1-[4-(4-morpholinyl)phenyl]-1-butanone are exemplified.

As phosphine oxide-based curing catalysts, 2,4,6-trimethylbenzoyl-diphenyl phosphineoxide, and bis(2,4,6-trimethylbenzoyl)phenyl phosphineoxide are exemplified.

As titanocene-based curing catalyst, bis(η5-2,4-cyclopentadien-1-yl)-bis[2,6-difluoro-3-(1H-pyrrol-1-yl)-phenyl]titanium is exemplified.

As oxime-based curing catalysts 1,2-octanedione, 1-[4-(phenylthio)-, 2-(O-benzoyloxime), ethanone, 1-[9-ethyl-6-(2-methylbenzoyl)-9H-carbazol-3-yl]-, 1-(O-acetyloxime) are exemplified.

As the hydrogen drawing type curing catalysts, benzophenone-based, thioxanthone-based, benzyl-based, and Michler's ketone-based catalysts are exemplified.

As the hydrogen drawing type curing catalysts, specifically as benzophenone-based catalysts, 2-benzoyl benzoic acid, 2-chlorobenzophenone, 4,4'-dichlorobenzo-phenone, 4-benzoyl-4'-methyldiphenyl sulfide, and p,p'-bisdiethylaminobenzophenone are exemplified.

As thioxanthone-based curing catalysts, 2,4-diethylthioxanthen-9-one, 2-chlorothioxanthone, and 2-isopropylthioxanthone are exemplified.

As benzyl-based curing catalysts, benzyl, (±)-camphorquinone, and p-anisyl are exemplified.

These photo-curing catalysts may be used singly, or in a combination of two or more kinds.

As the curing catalysts for use in thermal curing, well-known thermal polymerization initiators can be used and specifically the following shown commercially available curing catalysts (thermal polymerization initiators) are preferably used.

That is, as commercially available thermal polymerization initiators, azo-based initiators, e.g., V-30, V-40, V-59, V601, V65, V-70, VF-096, Vam-110 and Vam-111 (manufactured by Wako Pure Chemical Industries), $OT_{AZO}$-15, $OT_{AZO}$-30, AIBN, AMBN, ADVN and ACVA (manufactured by Otsuka Pharmaceutical Co., Ltd.) are exemplified.

In addition, PERTETRA A, PERHEXA HC, PERHEXA C, PERHEXA V, PERHEXA 22, PERHEXA MC, PERBUTYL H, PERCUMYL H, PERCUMYL P, PERMENTA H, PEROCTA H, PERBUTYL C, PERBUTYL D, PERHEXYL D, PEROYL IB, PEROYL 355, PEROYL L, PEROYL SA, NYPER BW, NYPER BMT-K40/M, PEROYL IPP, PEROYL NPP, PEROYL TCP, PEROYL OPP, PEROYL SBP, PERCUMYL ND, PEROCTA ND, PERHEXYL ND, PERBUTYL ND, PERBUTYL NHP, PERHEXYL PV, PERBUTYL PV, PERHEXA 250, PEROCTA O, PERHEXYL O, PERBUTYL O, PERBUTYL L, PERBUTYL 355, PERHEXYL I, PERBUTYL I, PERBUTYL E, PERHEXA 25Z, PERBUTYL A, PERHEXYL Z, PERBUTYL ZT, and PERBUTYL Z (manufactured by NOF CORPORATION), Kayaketal AM-C55, Trigonox 36-C75, Laurox, Perkadox L-W75, Perkadox CH-50L, Trigonox TMBH, Kayacumene H, Kayabutyl H-70, Perkadox BC-FF, Kayahexa AD, Perkadox 14, Kayabutyl C, Kayabutyl D, Kayahexa YD-E85, Perkadox 12-XL25, Perkadox 12-EB20, Trigonox 22-N70, Trigonox 22-70E, Trigonox D-T50, Trigonox 423-C70, Kayaester CND-C70, Kayaester CND-W50, Trigonox 23-C70, Trigonox 23-W50N, Trigonox 257-C70, Kayaester P-70, Kayaester TMPO-70, Trigonox 121, Kayaester O, Kayaester HTP-65W, Kayaester AN, Trigonox 42, Trigonox F-C50, Kayabutyl B, Kayacarbon EH-C70, Kayacarbon EH-W60, Kayacarbon I-20, Kayacarbon BIC-75, Trigonox 117, and Kayalen 6-70 (manufactured by Kayaku Akzo Corporation), Luperox 610, Luperox 188, Luperox 844, Luperox 259, Luperox 10, Luperox 701, Luperox 11, Luperox 26, Luperox 80, Luperox 7, Luperox 270, Luperox P, Luperox 546, Luperox 554, Luperox 575, Luperox TANPO, Luperox 555, Luperox 570, Luperox TAP, Luperox TBIC, Luperox TBEC, Luperox JW, Luperox TAIC, Luperox TAEC, Luperox DC, Luperox 101, Luperox F, Luperox DI, Luperox 130, Luperox 220, Luperox 230, Luperox 233, and Luperox 531 (manufactured by ARKEMA YOSHITOMI, LTD.) are exemplified.

These curing catalysts are added in an amount of preferably 0.2% by weight or more and 10% by weight or less based on all the solids content in the composition containing the specific charge transporting materials (a), more preferably 0.5% by weight or more and 8% by weight or less, and still more preferably 0.7% by weight or more and 5% by weight or less.

The composition containing the specific charge transporting materials (a) of this embodiment may contain reactive compound (b) not having charge transportability. Since protective layer (outermost layer) having sufficient electric characteristics and mechanical strength can be obtained by the use of the specific charge transporting materials (a), the mechanical strength of protective layer (outermost layer) may be adjusted by using the reactive compound (b) not having charge transportability in combination.

The terminology "not having charge transportability" means that transportation of the carrier is not observed by the time of flight method.

As such reactive compounds, monofunctional or polyfunctional polymerizable monomers, oligomers, and polymers, e.g., monomers, oligomers, and polymers of acrylate or methacrylate are exemplified.

Specifically, as monofunctional monomers, e.g., isobutyl acrylate, t-butyl acrylate, isooctyl acrylate, lauryl acrylate, stearyl acrylate, isobornyl acrylate, cyclohexyl acrylate, 2-methoxyethyl acrylate, methoxy triethylene glycol acrylate, 2-ethoxyethyl acrylate, tetrahydrofurfuryl acrylate, benzyl acrylate, ethylcarbitol acrylate, phenoxyethyl acrylate, 2-hydroxy acrylate, 2-hydroxypropyl acrylate, 4-hydroxybutyl acrylate, methoxy polyethylene glycol acrylate, methoxy polyethylene glycol methacrylate, phenoxy polyethylene glycol acrylate, phenoxy polyethylene glycol methacrylate, hydroxyethyl o-phenyl-phenol acrylate, and o-phenylphenol glycidyl ether acrylate are exemplified.

As difunctional monomers, oligomers and polymers, e.g., diethylene glycol di(meth)acrylate, polyethylene glycol di(meth)acrylate, polypropylene glycol di(meth)acrylate, neopentyl glycol di(meth)acrylate, and 1,6-hexanediol di(meth)acrylate are exemplified.

As trifunctional monomers, oligomers and polymers, e.g., trimethylolpropane tri(meth)acrylate, pentaerythritol tri (meth)acrylate, and aliphatic tri(meth)acrylate are exemplified.

As tetrafunctional monomers, oligomers and polymers, e.g., pentaerythritol tetra(meth)acrylate, ditrimethyloipropane tetra(meth)acrylate, and aliphatic tetra(meth)acrylate are exemplified.

As pentafunctional or higher monomers, oligomers and polymers, e.g., dipentaerythritol penta(meth)acrylate, dipentaerythritol hexa(meth)acrylate, in addition, (meth)acrylates having a polyester structure, a urethane structure, and a phosphazen structure are exemplified.

These monomers, oligomers and polymers may be used singly, or as a mixture of two or more kinds thereof.

These monomers, oligomers and polymers are used in an amount of 100% by weight or less based on all the amounts of the compounds having charge transportability in the composition containing the specific charge transporting materials (the specific charge transporting materials and other charge transporting materials), preferably 50% by weight or less, and more preferably 30% by weight or less.

Further, polymer (c) that reacts with or polymer (d) that does not react with the specific charge transporting materials (a) can be blended with the composition containing the specific charge transporting materials (a) for the purpose of dispersibility of particles, viscosity control, and for the purpose of resistance to discharged gas, mechanical strength, scratch resistance, reduction of torque, control of abrasion loss, and elongation of pot life of the cured film (outermost layer).

As the polymers (c) reacting with the specific charge transporting materials (a), polymers having a radical-polymerizable unsaturated bond as the reactive group are sufficient. As such polymers, in addition to the above polymers of acrylate and methacrylate, those disclosed in JP-A No. 5-216249, paragraphs [0026] to [0059], JP-A No. 5-323630, paragraphs [0027] to [0029], JP-A No. 11-52603, paragraphs [0089] to [0100], and JP-A No. 2000-264961, paragraphs [0107] to [0128] are exemplified.

As the polymers (d) not reacting with the specific charge transporting materials (a), polymers not having a radical polymerizable unsaturated bond are sufficient. Specifically, well-known resins such as polycarbonate resin, polyester resin, polyallylate resin, methacrylic resin, acrylic resin, polyvinyl chloride resin, polyvinylidene chloride resin, and polystyrene resin are exemplified as such polymers.

These polymers are used in an amount of 100% by weight or less based on the total amount of the compounds having charge transportability in the composition containing the specific charge transporting materials (a) (the specific charge transporting materials (a) and other charge transporting materials), preferably 50% by weight or less, and more preferably 30% by weight or less.

The composition containing the specific charge transporting materials (a) may further contain a coupling agent, a hard coat agent, and a fluorine-containing compound for the purpose of regulating a film-forming property, flexibility, lubricity and an adhesive property. As these additives, various silane coupling agents and commercially available silicone hard coat agents are specifically used.

As the silane coupling agents, vinyl trichlorosilane, vinyl trimethoxysilane, vinyl triethoxysilane, γ-glycidoxy-propylmethyldiethoxysilane, γ-glycidoxypropyltrimethoxy-silane, γ-aminopropyltriethoxysilane, γ-aminopropyl-trimethoxysilane, γ-aminopropylmethyldimethoxysilane, N-β-(aminoethyl)-γ-aminopropyltriethoxysilane, tetramethoxysilane, methyltrimethoxysilane, and dimethyldimethoxysilane are used.

As the commercially available hard coat agents, KP-85, X-40-9740, X-8239 (manufactured by Shin-Etsu Silicones), AY42-440, AY42-441, and AY49-208 (manufactured by Dow Corning Toray Co., Ltd.) are used.

For giving water repellency, fluorine-containing compounds such as (tridecafluoro-1,1,2,2-tetrahydrooctyl)-triethoxysilane, (3,3,3-trifluoropropyl)trimethoxysilane, 3-(heptafluoroisopropoxy)propyltriethoxysilane, 1H,1H,2H,2H-perfluoroalkyltriethoxysilane, 1H,1H,2H,2H-perfluorodecyltriethoxysilane, and 1H,1H,2H,2H-perfluoro-octyltriethoxysilane may be added. Further, reactive fluorine-containing compounds disclosed in JP-A No. 2001-166510 may be blended.

Silane coupling agents can be used in an optional amount, but the amount of fluorine-containing compounds is preferably 0.25 times or less by weight with respect to an amount of compounds not containing fluorine atom. If the amount exceeds this range, there are cases where problems arise in a film forming ability of a crosslinked film.

To the composition containing the specific charge transporting material (a), the reactive fluorine compounds described in JP-A No. 2001-166510, etc., and the like may be further mixed.

Alcohol-soluble resins may be added to protective layer (outermost layer) for the purpose of resistance to discharged gas, mechanical strength, scratch resistance, reduction of torque, control of abrasion loss, and elongation of pot life of the protective layer (outermost layer).

It is desired to add an antioxidant to protective layer (outermost layer) for the purpose of prevention of deterioration due to oxidizing gas, e.g., ozone and the like, generating in a charging apparatus of the protective layer. When mechanical strength of the surface of a photoreceptor is heightened and the photoreceptor has a long duration of life, the photoreceptor comes to be brought into contact with oxidizing gas for a long time, and so oxidation resistance stronger than before is required.

As antioxidants, hindered phenol-based and hindered amine-based antioxidants are preferred, but well-known antioxidants such as organic sulfur-based antioxidants, phosphite-based antioxidants, dithiocarbamate-based antioxidants, thiourea-based antioxidants, and benzimidazole-based antioxidants may also be used. The addition amount of antioxidants is preferably 20% by weight or less based on all the solids content in the coating solution (composition) for forming a protective layer, and more preferably 10% by weight or less.

As the hindered phenol-based antioxidants, "IRGANOX 1076", "IRGANOX 1010", "IRGANOX 1098", "IRGANOX 245", "IRGANOX 1330", "IRGANOX 3114", "IRGANOX 1076" (trade name, all manufactured by Ciba Japan KK), and "3,5-di-t-butyl-4-hydroxybiphenyl" are exemplified.

As the hindered amine-based antioxidants, "SANOL LS2626", "SANOL LS765", "SANOL LS770", "SANOL LS744" (trade name, all manufactured by Sankyo Lifetech Co., Ltd), "TINUVIN 144", "TINUVIN 622LD" (trade name, all manufactured by Ciba Japan KK.), "MARK LA57", "MARK LA67", "MARK LA62", "MARK LA68", and "MARK LA63" (trade name, all manufactured by Adeka Corporation) are exemplified. As the thioether-based antioxidants, "SUMILIZER TPS" and "SUMILIZER TP-D" (trade name, all manufactured by Sumitomo Chemical Co. Ltd.) are exemplified. As the phosphite-based antioxidants, "MARK 2112", "MARK PEP-8", "MARK PEP-24G", "MARK PEP-36", "MARK 329K" and "MARK HP-10" (trade name, all manufactured by Adeka Corporation) are exemplified.

Further, for the purpose of lowering residual potential or improving strength of a protective layer, various particles may be added to protective layer (outermost layer).

As an example of the particles, silicon-containing particles are exemplified. Silicon-containing particles are particles that silicon is contained in the constitutional elements, and specifically colloidal silica and silicone particles are exemplified. Colloidal silica used as silicon-containing particles is selected from acidic or alkaline aqueous dispersion, or dispersion in an organic solvent such as alcohol, ketone or ester, of silica having an average particle size of 1 nm or more and 100 nm or less, preferably 10 nm or more and 30 nm or less, and commercially available products may be used.

The solids content of colloidal silica in protective layer is not especially restricted, but the content is generally 0.1% by weight or more and 50% by weight or less based on all the solids content of protective layer in view of a film-forming property, electric characteristics and strength, and preferably used in the range of 0.1% by weight or more and 30% by weight or less.

Silicone particles used as silicon-containing particles are selected from silicone resin particles, silicone rubber particles, silica particles surface treated with silicone, and commercially available products are generally used. These silicone particles are spherical, and the volume average particle size is preferably 1 nm or more and 500 nm or less, and more preferably 10 nm or more and 100 nm or less. Silicone particles are minute particles chemically inert and excellent in dispersibility in a resin, and further the content necessary to obtain sufficient characteristics is low, so that the surface property of an electrophotographic photoreceptor is improved without hindering crosslinking reaction. That is, lubricating ability and water repellency of the surface of an electrophotographic photoreceptor are improved, and good abrasion resistance and resistance to adhesion of contaminants are maintained for long in the state of silicone particles being surely taken in without causing unevenness in a tenacious crosslinking structure.

The content of silicone particles in protective layer is preferably 0.1% by weight or more and 30% by weight or less based on all the solids content of protective layer, and more preferably 0.5% by weight or more and 10% by weight or less.

The examples of other particles include fluorocarbon-based particles such as particles of ethylene tetrafluoride, ethylene trifluoride, propylene hexafluoride, vinyl fluoride, and vinylidene fluoride, particles comprising a resin obtained by copolymerization of a fluorocarbon-based monomer with a monomer having a hydroxyl group as shown in the proceeding of The $8^{th}$ Polymer Material Forum, Lecture, p. 89-90, and semiconductive metal oxides such as $ZnO—Al_2O_3$, $SnO_2—Sb_2O_3$, $In_2O_3—SnO_2$, $ZnO_2—TiO_2$, $ZnO—TiO_2$, $MgO—Al_2O_3$, $FeO—TiO_2$, $TiO_2$, $SnO_2$, $In_2O_3$, ZnO, and MgO are exemplified.

Oils such as silicone oil may be added to protective layer (outermost layer) in the same purpose. As the silicone oils, silicone oils such as dimethylpolysiloxane, diphenylpolysiloxane, and phenylmethylsiloxane; reactive silicone oils such as amino-modified polysiloxane, epoxy-modified polysiloxane, carboxyl-modified polysiloxane, carbinol-modified polysiloxane, methacryl-modified polysiloxane, mercapto-modified polysiloxane, and phenol-modified polysiloxane; cyclic dimethylcyclosiloxanes such as hexamethylcyclotrisiloxane, octamethylcyclotetrasiloxane, decamethylcyclopentasiloxane, and dodecamethylcyclohexa-siloxane; cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane, and 1,3,5,7,9-pentamethyl-1,3,5,7,9-pentaphenylcyclopentasiloxane; cyclic phenylcyclosiloxanes such as hexaphenyl-cyclotrisiloxane; fluorine-containing cyclosiloxanes such as (3,3,3-trifluoropropyl)methylcyclotrisiloxane; hydrosilyl group-containing cyclosiloxanes such as methylhydrosiloxane mixture, pentamethylcyclopentanesiloxane, and phynylhydro-cyclosiloxane; and vinyl group-containing cyclosiloxanes such as pentavinylpentamethylcyclopentasiloxane are exemplified.

Metals, metal oxides and carbon blacks may be added to protective layer (outermost layer). As the metals, aluminum, zinc, copper, chromium, nickel, silver, stainless steel, and plastic particles the surfaces of which are deposited with these metals are exemplified. The examples of the metal oxides include zinc oxide, titanium oxide, tin oxide, antimony oxide, indium oxide, bismuth oxide, indium oxide doped with tin, tin oxide doped with antimony and tantalum, and zirconium oxide doped with antimony. These metals and metal oxides may be used alone, or may be used in combination of two or more kinds thereof. When two or more kinds are used in combination, they may be used as mere mixture, or may be the form of a solid solution or fusion. The volume average particle size of conductive particles is preferably 0.3 μm or less in view of transparency of the protective layer, and especially preferably 0.1 μm or less.

It is preferred that the composition containing the specific charge transporting materials (a) which is used for forming protective layer is prepared as a coating solution for forming a protective layer.

The coating solution for forming a protective layer may be free of solvents, or the solution is prepared with an aromatic solvent, e.g., toluene or xylene, a ketone solvent, e.g., methyl ethyl ketone, methyl isobutyl ketone, or cyclohexanone, an ester solvent, e.g., ethyl acetate or butyl acetate, an ether solvent, e.g., tetrahydrofuran or dioxane, a cellosolve solvent, e.g., ethylene glycol monomethyl ether, or an alcohol solvent, e.g., isopropyl alcohol or butanol, alone or as a mixed solvent.

When a coating solution is prepared by the reaction of the above components, they may be merely mixed and dissolved, but preferably they are heated on the condition of room temperature or higher and 100° C. or lower, more preferably 30° C. or higher and 80° C. or lower for 10 minutes or longer and 100 hours or shorter, and still more preferably for 1 hour or longer and 50 hours or shorter. At this time, it is also preferred to use ultrasonic wave irradiation.

By the above processing, partial reaction presumably advances in the coating solution, and homogeneity of the coating solution is bettered and a uniform film free from coating defects is liable to be obtained.

The coating solution for forming a protective layer comprising the composition containing the specific charge transporting materials (a) is coated on charge transporting layer 3 forming a coating surface according to an ordinary method, such as a blade coating method, a wire bar coating method, a spray coating method, a dip coating method, a bead coating method, an air knife coating method, or a curtain coating method.

After that, light, electron beam or heat is applied to the obtained film to polymerize and cure the film.

When the film is polymerized and cured by light, a known light source such as a mercury lamp or a metal halide lamp is used.

When the film is polymerized and cured by heat, the heating condition is preferably 50° C. or higher. If the temperature is lower than this temperature, the duration of life of the cured film is shorter and so not preferred. In particular, it is preferred that the heating temperature is 100° C. or higher and 170° C. or lower from the point of reactivity, strength and electric characteristics of the manufactured photoreceptor.

Further, when the film is polymerized and cured by electron beam, an electron beam irradiation apparatus is used. For the acceleration of reaction, heating may also be performed at the same time.

In the case of irradiation with electron beams, any type accelerator of a scanning type, an electron curtain type, a broad beam type, a pulse type, a laminar type, and other types can be used. In the case of irradiation with electron beams, the acceleration voltage is preferably 250 kV or less, and optimally 150 kV or less. Further, the amount of irradiation is preferably from 1 Mrad to 100 Mrad, and more preferably from 3 Mrad to 50 Mrad.

If the acceleration voltage is more than 250 kV, damage of the electron beam irradiation on the characteristics of the electrophotographic photoreceptor tends to increase. Further, if the amount of irradiation is less than 1 Mrad, the curing becomes insufficient, whereas if the amount of irradiation is more than 100 Mrad, the characteristics of the electrophotographic photoreceptor are susceptible to deterioration, which thus requires carefulness.

In polymerization and curing reaction as above, the reaction is carried out in vacuum or an inert gas atmosphere of oxygen concentration of preferably 10% or less, more preferably 5% or less, still more preferably 2% or less, and most preferably low oxygen concentration of 500 ppm or lower, so that chain reaction can be performed without deactivation of generated radicals by light, electron beam or heat.

In this embodiment, as described above, a film is cured by radical polymerization caused by the application of heat, light or radiation, but if the reaction advances too rapidly, it is difficult to bring about structural relaxation of the film by crosslinking, and unevenness and wrinkles of the film are liable to occur. Accordingly, it is preferred to use curing by heat to cause radical generation relatively slowly. In particular, the specific charge transporting materials (a) contains a methacryloyl group that is lower in reactivity than an acryloyl group. Structural relaxation of the film is expedited by the combination of the methacryloyl group with curing by heat, and protective layer (outermost layer) excellent in a surface property and uniformity can be obtained.

On the other hand, when a cured film is formed through curing the film by applying light and electron beam, reaction speed is rapid and molecular movement is liable to be congealed in a short time, and unreacted functional groups tend to remain in the cured film. Further, since crosslinking reaction occurs before generation of structural relaxation, the obtained film is liable to be a film with much residual distortion, and insufficient in film uniformity of the surface and internal uniformity of the composition.

The amount of the residual monomers having unreacted functional groups remaining in the cured film are measured by peeling off the cured film, immersing it in tetrahydrofuran at 50° C. for 3 hours, and quantifying the eluted residual monomers by GPC, GPLC, or the like. In particular, the amount of the residual monomers is 0.5% by weight or more based on the total weight of the cured film, the friction between the protective layer (outermost layer) and the blade increases, and thus tends to cause friction charging. The ghost due to friction charging or friction charging can be reduced by adding particles containing a fluorocarbon-based resin to a composition having the specific charge transporting material (a).

The film thickness of the protective layer (outermost layer) is preferably from 5 μm to 40 μm, and more preferably from 7 μm to 30 μm.

The example of a function-separating type photosensitive layer was explained above with reference to electrophotographic photoreceptor 7A shown in FIG. 1. In the case of a monolayer type photosensitive layer 6 (a charge generating/charge transporting layer) of electrophotographic photoreceptor 7C shown in FIG. 3, the following embodiment is preferred.

That is, the content of a charge generating material in monolayer type photosensitive layer is 10% by weight or more and 85% by weight or less or the like, and preferably 20% by weight or more and 50% by weight or less. The content of a charge transporting material is preferably 5% by weight or more and 50% by weight or less. The method of forming the monolayer type photosensitive layer (a charge generating/charge transporting layer) is the same as the forming methods of charge generating layer and charge transporting layer. The thickness of monolayer type photosensitive layer (a charge generating/charge transporting layer) is preferably 5 μM or more and 50 μm or less or the like, and more preferably 10 μm or more and 40 μm or less.

Also, in the monolayer-type photosensitive layer (charge generating/charge transporting layer), the content of the specific charge transporting material (a), particularly, a compound having a triphenylamine skeleton and at least one chain polymerizable functional group selected from a group consisting of an acryloyl group, a methacryloyl group, a derivative of the acryloyl group, a derivative of the methacryloyl group, and a styryl group in the same molecule, and even more preferably, a compound having a triphenylamine skeleton and 4 or more methacryloyl groups in the same molecule is preferably 5% or more, more preferably 10% or more, and even more preferably 15% or more, with respect to the weight of the entire solid contents of the composition for forming a monolayer type photosensitive layer, from the viewpoint of the strength.

In the above, the embodiment in which the outermost layer comprising the cured film of the composition containing the specific charge transporting materials (a) is protective layer is explained, but in the case of the layer constitution where protective layer is not present, the charge transporting layer positioned on the outermost surface in the layer constitution is the outermost layer.

When the outermost layer is a charge transporting layer, the thickness of the layer is preferably 7 μm or more and 60 μm or less, and more preferably 8 μm or more and 55 μm or less.

The following will be described, but the symbols are omitted.

<Conductive Substrate>

As the conductive substrate, any conventionally used one may be used. Examples of the conductive substrate include plastic films having a thin film (for example, metals such as aluminum, nickel, chromium, stainless steel, or the like, and films having aluminum, titanium, nickel, chromium, stainless steel, gold, vanadium, tin oxide, indium oxide, indium-tin oxide (ITO), or the like), and the like, paper coated or impregnated with a conductivity-imparting material, plastic films coated or impregnated with a conductivity-imparting material, and the like. The shape is not restricted to a cylindrical form and it may be a sheet shape or a plate shape.

When a metal pipe is used as the conductive substrate, the surface of the pipe may be in an untreated state or may be subjected to a treatment such as mirror surface cutting, etching, anodic oxidation, rough cutting, centerless grinding, sandblast, wet honing, or the like.

<Undercoating Layer>

The undercoat layer may be provided for the purpose of preventing light reflection on the surface of the conductive substrate or preventing the inflow of unnecessary carriers from the conductive substrate into the photosensitive layer, or the like, as necessary.

In addition, other additives, for example, binding resin may be contained in the undercoating layer, if necessary. Examples of the binding resin contained in the undercoating layer include known polymer resin compounds, e.g. acetal resins such as polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenolic resins, phenol-formaldehyde resins, melamine resins and urethane resins; charge transporting resins having charge transporting groups; and conductive resins such as polyaniline. Particularly preferred examples are resins which are insoluble in the coating solvent for the upper layer, specifically phenolic resins, phenol-formaldehyde resins, melamine resins, urethane resins, epoxy resins and the like.

The undercoating layer may contain metal compounds such as a silicone compound, an organic zirconium compound, an organic titanium compound, an organic aluminum compound, and the like, or other compounds.

The ratio of the metal compound to the binding resin is not particularly restricted and is arbitrarily set within a range for obtaining desired characteristics of the electrophotographic photoreceptor.

Resin particles may also be added to the undercoat layer in order to adjust the surface roughness of the undercoat layer. Examples of the resin particles include silicone resin particles, crosslinked poly methyl methacrylate (PMMA) resin particles, and the like. Further, after forming the undercoating layer, the surface thereof may be polished for adjusting the surface roughness. As the polishing method, buff polishing, sandblast treatment, wet honing, grinding treatment, or the like may be used.

Herein, examples of the constitution of the undercoating layer include a constitution including at least a binder resin and conductive particles. In addition, the conductive particles desirably have conductivity, for example, a volume resistivity of less than $10^7$ Ωcm.

Examples of the conductive particle include metal particles (particles of aluminum, copper, nickel, silver, or the like), conductive metal oxide particles (particles of antimony oxide, indium oxide, tin oxide, zinc oxide, or the like), conductive material particles (particles of carbon fiber, carbon black, graphite powder, or the like), and other particles, and among theses, conductive metal oxide particles are preferable. Two or more kinds of the conductive particles may be mixed and used.

Further, the conductive particle may be used after performing a surface treatment with a hydrophobilizing agent (for example, a coupling agent) and the like, and then a resistance adjustment.

The content of the conductive particles is, for example, preferably from 10% by weight to 80% by weight, and more preferably from 40% by weight to 80% by weight, with respect to the binding resin.

When the undercoating layer is formed, a coating liquid for forming an undercoating layer obtained by adding the above-described components to the solvent is used. Further, for a method for dispersing the particles in a coating liquid for forming an undercoat layer, media dispersers such as a ball mill, a vibration ball mill, an attritor, a sand mill, a lateral sand mill, or the like, and medialess dispersers such as an agitator, an ultrasonic disperser, a roll mill, a high-pressure homogenizer, or the like are used. Herein, the high-pressure homogenizer includes a collision-type homogenizer in which a dispersion is dispersed under high pressure by liquid-liquid collision or liquid-wall collision, a passing-through-type homogenizer in which a dispersion is dispersed by passing the dispersion through thin flow paths under high pressure, and the like.

Examples of the method of coating the coating liquid for forming an undercoat layer on the conductive substrate include a dip coating method, an extrusion coating method, a wire bar coating method, a spray coating method, a blade coating method, a knife coating method, a curtain coating method, and the like.

The film thickness of the undercoat layer is preferably 15 μm or more, and more preferably from 20 μm to 50 μm.

Here, although not shown in the drawings, an intermediate layer may be provided between the undercoating layer and the photosensitive layer. Examples of the binder resins used for the intermediate layer include organic metal compounds containing zirconium atoms, titanium atoms, aluminum atoms, manganese atoms, silicon atoms, or the like, etc., in addition to polymer resin compounds, for example, an acetal resin such as polyvinyl butyral, a polyvinyl alcohol resin, casein, a polyamide resin, a cellulose resin, gelatin, a polyurethane resin, a polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a phenol-formaldehyde resin, a melamine resin, or the like. These compounds can be used singly or as a mixture or polycondensation product of plural compounds. Among them, organic metal compounds containing zirconium or silicon are suitable from the viewpoints of a low residual potential, a low potential fluctuation due to environment, a small change in potential due to repetitive use, and the like.

When the intermediate layer is formed, a coating liquid for forming an intermediate layer obtained by adding the above-described components to the solvent is used.

Examples of the coating method for forming the intermediate layer include usual methods such as a dip coating method, an extrusion coating method, a wire bar coating method, a spray coating method, a blade coating method, a knife coating method, a curtain coating method, and the like.

In addition, the intermediate layer also functions as an electric blocking layer, in addition to functioning to improve the coating property of a layer formed thereon. However, when the film thickness of the intermediate layer is too large, an electric hindrance may become too strong, causing desensitization or increase in an electric potential due to repetitive use. Accordingly, when the intermediate layer is formed, the film thickness is preferably set in the range from 0.1 μm to 3 μm. Further, in this case, the intermediate layer may also be used as the undercoat layer.

<Charge Generating Layer>

The charge generating layer is configured to contain, for example a charge generating material and a binding resin. Examples of such a charge generating material include phthalocyanine pigments such as non-metal phthalocyanine, chlorogallium phthalocyanine, hydroxygallium phthalocyanine, dichlorotin phthalocyanine, titanyl phthalocyanine, and the like, and in particular, chlorogallium phthalocyanine crystals having strong diffraction peaks at least at 7.4°, 16.6°, 25.5°, and 28.3° of Bragg angles (2θ±0.2°) with respect to CuKα characteristic X rays, non-metal phthalocyanine crystals having strong diffraction peaks at least at 7.7°, 9.3°, 16.9°, 17.5°, 22.4°, and 28.8° of Bragg angles (2θ+0.2°) with respect to CuKα characteristic X rays, hydroxygallium phthalocyanine crystals having strong diffraction peaks at least at 7.5°, 9.9°, 12.5°, 16.3°, 18.6°, 25.1°, and 28.3° of Bragg angles (2θ±0.2°) with respect to CuKα characteristic X rays, and titanyl phthalocyanine crystals having strong diffraction peaks at least at 9.6°, 24.1°, and 27.2° of Bragg angles (2θ±0.2°) with respect to CuKα characteristic X rays. In addition, examples of other charge generating materials include a quinone pigment, a perylene pigment, an indigo pigment, a bisbenzoimidazole pigment, an anthrone pigment, a quinacridone pigment, and the like. These charge generating materials may be used singly or as a mixture of two or more kinds thereof.

Examples of the binder resins used in the charge generating layer include polycarbonate resins such as a bisphenol A-type resin, a bisphenol Z-type resin, and the like, an acrylic resin, a methacrylic resin, a polyallylate resin, a polyester resin, a polyvinyl chloride resin, a polystyrene resin, an acrylonitrile-styrene copolymer resin, an acrylonitrile-butadiene copolymer, a polyvinyl acetate resin, a polyvinyl formal resin, a polysulfone resin, a styrene-butadiene copolymer resin, a vinylidene chloride-acrylonitrile copolymer resin, a vinyl chloride-vinyl acetate-maleic anhydride resin, a silicone resin, a phenol-formaldehyde resin, a polyacrylamide resin, a polyamide resin, a poly-N-vinylcarbazole resin, and the like. These binder resins may be used singly or as a mixture of two or more kinds thereof.

Also, the blending ratio of the charge generating material and the binding resin is preferably, for example, in the range from 10:1 to 1:10.

When the charge generating layer is formed, a coating liquid for forming a charge generating layer obtained by adding the above-described components to the solvent is used.

For the method for dispersing the particles (for example, a charge generating material) in the coating liquid for forming a charge generating layer, media dispersers such as a ball mill, a vibration ball mill, an attritor, a sand mill, a lateral sand mill, or the like, and medialess dispersers such as an agitator, an ultrasonic disperser, a roll mill, a high-pressure homogenizer, or the like are used. Examples of the high-pressure homogenizer include a collision-type homogenizer in which a dispersion is dispersed by liquid-liquid collision, or liquid-wall collision under high pressure, a passing-through-type homogenizer in which a dispersion is dispersed by passing the dispersion through thin flow paths under high pressure, and the like.

Examples of the method for coating the coating liquid for forming a charge generating layer on the undercoat layer include a dip coating method, an extrusion coating method, a wire bar coating method, a spray coating method, a blade coating method, a knife coating method, a curtain coating method, and the like.

The film thickness of the charge generating layer is preferably set in the range from 0.01 μm to 5 μm, and more preferably from 0.05 μm to 2.0 μm.

<Charge Transporting Layer>

The charge transporting layer is configured to include the charge transporting material and an appropriate binder resin. Further, if the charge transporting layer corresponds to the outermost layer, the charge transporting layer contains fluorocarbon resin particles having the above-described specific surface area, as described above.

Examples of the charge transporting materials include but are not limited to oxadiazole derivatives such as 2,5-bis(p-diethylaminophenyl)-1,3,4-oxadiazole, and the like, pyrazoline derivatives such as 1,3,5-triphenylpyrazoline, 1-[pyridyl-(2)]-3-(p-diethylaminostyryl)-5-(p-diethylaminostyryl) pyrazoline, and the like, aromatic tertiary amino compounds such as triphenylamine, N,N'-bis(3,4-dimethylphenyl)-biphenyl-4-amine, tri(p-methylphenyl)-aminyl-4-amine, dibenzylaniline, and the like, aromatic tertiary diamino compounds such as N,N'-bis(3-methylphenyl)-N,N'-diphenylbenzidine and the like, 1,2,4-triazine derivatives such as 3-(4'-diethylaminophenyl)-5,6-di-(4'-methoxyphenyl)-1,2,4-triazine, and the like, hydrazone derivatives such as 4-diethylaminobenzaldehyde-1,1-diphenylhydrazone, and the like, quinazoline derivatives such as 2-phenyl-4-styrylquinazoline, and the like, benzofuran derivatives such as 6-hydroxy-2,3-di(p-methoxyphenyl)benzofuran, and the like, α-stilbene derivatives such as p-(2,2-diphenylvinyl)-N—N-diphenylaniline, and the like, carbazole derivatives such as such as enamine derivatives, N-ehtylcarbazole, and the like, hole transporting materials such as poly-N-vinylcarbazole and a derivative thereof, and the like, quinone-based compounds such as chloranil, broanthraquinone, and the like, a tetracyanoquinodimethane-based compound, fluorenone compounds such as 2,4,7-trinitrofluorenone, 2,4,5,7-tetranitro-9-fluorenone, and the like, electron transporting materials such as a xanthone-based compound, a thiophene-based compound, and the like, polymers having a group formed of the above compounds in the main chain or side chain thereof, and the like. These charge transporting materials may be used singly or in combination of two or more kinds thereof.

Examples of the binding resin constituting the charge transporting layer include insulating resins such as polycarbonate resins such as a bisphenol A-type resin, a bisphenol Z-type resin, and the like, an acrylic resin, a methacrylic resin, a polyallylate resin, a polyester resin, a polyvinyl chloride resin, a polystyrene resin, an acrylonitrile-styrene copolymer resin, an acrylonitrile-butadiene copolymer, a polyvinyl acetate resin, a polyvinyl formal resin, a polysulfone resin, a styrene-butadiene copolymer resin, a vinylidene chloride-acrylonitrile copolymer resin, a vinyl chloride-vinyl acetate-maleic anhydride resin, a silicone resin, a phenol-formaldehyde resin, a polyacrylamide resin, a polyamide resin, chorine rubber, and the like, organic photoconductive polymers such as polyvinylcarbazole, polyvinylanthracene, polyvinylpyrene, and the like, and others. These binding resins may be used singly or as a mixture of two or more kinds thereof.

Moreover, the blending ratio of the charge transporting material to the binding resin is preferably from 10:1 to 1:5.

The charge transporting layer is formed by using the coating liquid for forming a charge transporting layer obtained by adding the above-described components to the solvent.

For the method for dispersing particles (for example, fluorocarbon resin particles) in a coating liquid for forming a charge transporting layer, media dispersers such as a ball mill, a vibration ball mill, an attritor, a sand mill, a lateral sand mill, or the like, and medialess dispersers such as an agitator, an ultrasonic disperser, a roll mill, a high-pressure homogenizer, or the like are used. Herein, the high-pressure homogenizer includes a collision-type homogenizer in which a dispersion is dispersed under high pressure by liquid-liquid collision or liquid-wall collision, a passing-through-type homogenizer in which a dispersion is dispersed by passing the dispersion through thin flow paths under high pressure, and the like.

As the method for coating the coating liquid forming a charge transporting layer on the charge generating layer, usual methods such as a dip coating method, an extrusion coating method, a wire bar coating method, a spray coating method, a blade coating method, a knife coating method, a curtain coating method, or the like are used.

The film thickness of the charge transporting layer is preferably set in the range from 5 μm to 50 μm, and more preferably from 10 μm to 40 μm.

[Image Forming Apparatus/Processing Cartridge]

The image forming apparatus according to the present aspect includes an electrophotographic photoreceptor having an outermost layer configured to include at least a cured product containing a charge transporting skeleton; a charging unit for charging the electrophotographic photoreceptor; an electrostatic latent image forming unit for forming an electrostatic latent image at the charged electrophotographic photoreceptor; a developing unit for developing the electrostatic latent image formed at the electrophotographic photoreceptor by a developer to form a toner image, which stores a developer containing a toner having toner particles containing a crystalline resin and having a shape factor SF1 of from 100 or about 100 to 150 or about 150 in addition to a volume average particle diameter of from 3 μm or about 3 μm to 6 μm or about 6 μm, and fluorocarbon resin particles as an external additive; a transfer unit for transferring the toner image to a medium to be transferred; and a cleaning unit for cleaning the surface of the electrophotographic photoreceptor with a blade containing urethane rubber and disposed applying a pressure to the electrophotographic photoreceptor surface of 0.20 mN/mm or about 0.20 mN/mm or more.

Further, the processing cartridge according to the present aspect includes at least an electrophotographic photoreceptor having an outermost layer configured to include at least a cured product containing a charge transporting skeleton; a developing unit for developing the electrostatic latent image formed at the electrophotographic photoreceptor by a developer to form a toner image, which stores a developer containing a toner having toner particles containing a crystalline resin and having a shape factor SF1 of from 100 or about 100 to 150 or about 150 in addition to a volume average particle diameter of from 3 μm or about 3 μm to 6 μm or about 6 μm, and fluorocarbon resin particles as an external additive; and a cleaning unit for cleaning the surface of the electrophotographic photoreceptor with a blade containing urethane rubber and disposed applying a pressure to the electrophotographic photoreceptor surface of 0.20 mN/mm or about 0.20 mN/mm or more, and is a material detachable from the image forming apparatus.

Figure 4:
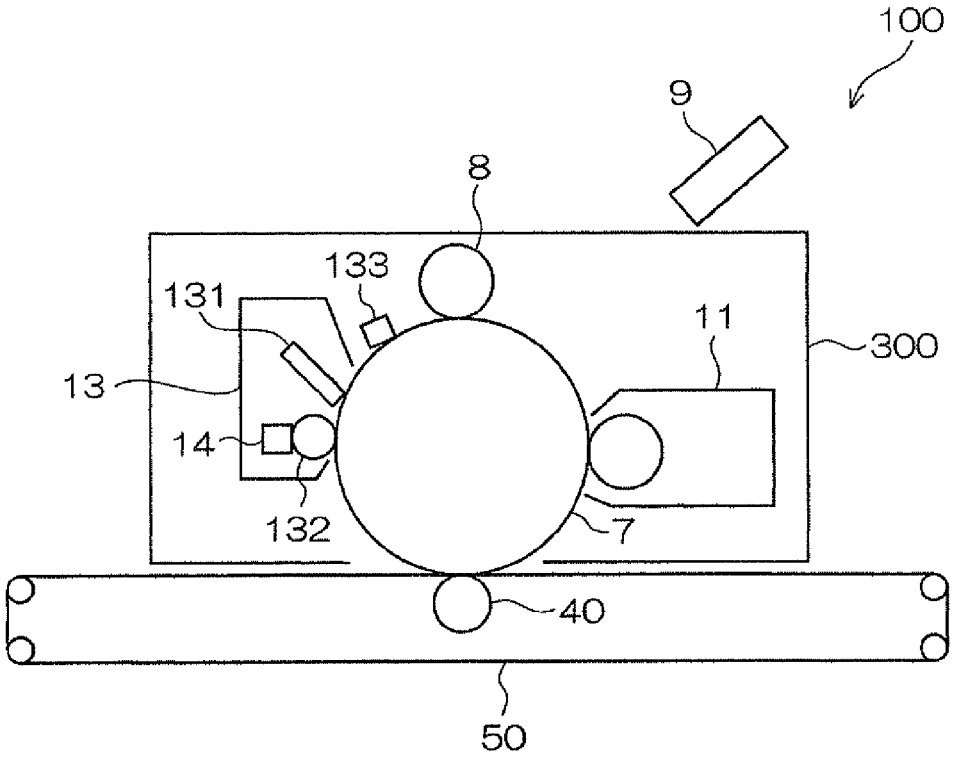
FIG. 4 is a schematic block diagram showing the image forming apparatus concerning an aspect of the invention.

FIG. 4 is a schematic block diagram showing an image forming apparatus 100 according to an exemplary embodiment of the invention. As shown in FIG. 4, the image forming apparatus 100 includes a processing cartridge 300 equipped with the electrophotographic photoreceptor 7, an exposure device (electrostatic latent image forming unit) 9, a transfer device (transfer unit) 40, and an intermediate transfer medium 50. In the image forming apparatus 100, the exposure device 9 is arranged so as to irradiate the electrophotographic photoreceptor 7 through the opening of the processing cartridge 300, the transfer device 40 is arranged so as to oppose the electrophotographic photoreceptor 7 via the intermediate transfer medium 50, and the intermediate transfer medium 50 is arranged so as to partially contact with the electrophotographic photoreceptor 7.

The processing cartridge 300 in FIG. 4 supports integrally an electrophotographic photoreceptor 7, a charging device (charging unit) 8, a developing device (developing unit) 11, and a cleaning device (cleaning unit) 13 in the housing.

The developing device 11 stores a developer containing a toner having toner particles containing a crystalline resin and having a shape factor SF1 of from 100 or about 100 to 150 or about 150 in addition to a volume average particle diameter of from 3 μm or about 3 μm to 6 μm or about 6 μm and fluorocarbon resin particles as an external additive (not shown).

The cleaning device 13 has a blade (cleaning blade) 131, and the blade 131 is disposed to be in contact with the surface of the electrophotographic photoreceptor 7 at an applied pressure of 0.20 mN/mm or about 0.20 mN/mm or more. In addition, the blade may be used in combination with a conductive or insulating fibrous member.

In FIG. 4, an example as cleaning device 13 is shown, which is equipped with fibrous member 132 (in the form of a roll) feeding lubricant 14 to the surface of photoreceptor 7, and using fibrous member 133 (in the form of a flat brush) as cleaning assist, and these members are used according to necessity.

Hereinbelow, each member will be described. Further, description will be made while the symbols are omitted.

As the charging device, for example, a contact-type charging device using a conductive or semi-conductive charging roll, charging brush, charging film, charging rubber blade, charging tube, or the like is used. In addition, a known charging device per se or the like using a non-contact roll charging device, a scorotoron charging device or corotoron charging device using employing corona discharge, and the like is also used.

Although not shown, in order to improve stability of the image, a photoreceptor heating member may be provided around the electrophotographic photoreceptor thereby increasing the temperature of the electrophotographic photoreceptor and reducing the relative temperature.

Examples of the exposure device include optical instruments which can expose the surface of the photoreceptor so that a desired image is formed by using light of a semiconductor laser, an LED, a liquid-crystal shutter light or the like. The wavelength of light sources to be used is in the range of the spectral sensitivity region of the photoreceptor. As the semiconductor laser light, near-infrared light having an oscillation wavelength in the vicinity of 780 nm is predominantly used. However, the wavelength of the light source is not limited to the above-described wavelength, and lasers having an oscillation wavelength on the order of 600 nm and blue lasers having an oscillation wavelength in the vicinity of 400 to 450 nm can also be used. Surface-emitting type laser light sources which are capable of multi-beam output are effective to form a color image.

As the developing device, for example, a common developing device, in which a magnetic or non-magnetic one- or two-component developer is contacted or not contacted for forming an image, can be used. Such developing device is not particularly limited as long as it has above-described functions, and can be appropriately selected according to the preferred use. Examples thereof include known developing device in which said one- or two-component developer is applied to the photoreceptor using a brush or a roller. Among these, the developing device using developing roller retaining developer on the surface thereof is preferable.

Hereinbelow, the toner stored in the developing device will be described.

The toner stored in the developing device contains a crystalline resin and has toner particles having a shape factor SF1 of from 100 or about 100 to 150 or about 150 in addition to a volume average particle diameter of from 3 μm or about 3 μm to 6 μm or about 6 μm, and fluorocarbon resin particles as an external additive.

The shape factor (SF1) can usually be measured as a numerical value by analyzing a microscopic image or scanning electronic microscopic image by means of an image analyzer, and determined, for example, by the following manner. For measurement of the shape factor (SF1), the shape factor is obtained by first placing an optical microscopic image of toners spread on a slide glass in a Ruzex image analyzer through a video camera, calculating the SF1 of 50 or more particles according to the following formula, and determining an average of the values.

$$SF1=(ML^2/A)\times(\pi/4)\times 100$$

wherein ML represents an absolute maximum length of the particles and A represents a projected area of the particles.

Further, the shape factor SF1 for the toner particles is preferably from 110 or about 110 to 145 or about 145, and preferably from 110 or about 110 to 140 or about 140.

Furthermore, the volume average particle diameter D50v of the toner is from 3 μm or about 3 μm to 6 μm or about 6 μm, but is preferably from 3.5 μm or about 3.5 μm to 5.8 μm or about 5.8 μm, from the viewpoint of obtaining higher developability and transferability, and a higher quality image. Within the above range, a toner can be provided with a high adhesive power and excellent developability. In addition, the resolution of the image is improved.

By using the toner satisfying the shape factor SF1 and the volume average particle diameter, each in the above ranges, an image having higher development, transferability, and higher image quality, as compared with other toners, is obtained.

Here, the volume average particle diameter D50v is measured by means of COULTER MULTISIZER II (trade name; manufactured by Beckman Coulter Co.) as a measuring instrument. An accumulative distribution is drawn from the smaller diameter side, with regard to the volume and the number thereof, according to a particle size range (channel) divided based on the particle size distribution, the particle diameter at a cumulative percentage of 16% is defined as the volume D16v and the number D16p, and the particle diameter at a cumulative percentage of 50% is defined as the volume D50v and the number D50p, and the particle diameter at a cumulative percentage of 84% is defined as the volume D84v and the number D84p. Using them, the volume average particle size distribution index (GSDv) is defined as $(D84v/D16v)^{1/2}$ and the number average particle size distribution index (GSDp) is defined as $(D84p/D16p)^{1/2}$.

Next, the components that can constitute the toner will be specifically described.

The toner according to the present aspect contains toner particles containing a crystalline resin as a binding resin, and fluorocarbon resin particles as an external additive.

If necessary, the toner particles may contain an internal additive such as a releasing agent, a colorant, and the like, and an external additive other than fluorocarbon resin particles as an external additive may be used.

—Binder Resin—

As the binder resin, a crystalline resin is used, but it is preferably used in combination with an amorphous polymer resin.

The crystalline resin refers to a resin having a distinct endothermic peak, rather than step-like changes in the endothermic amount, by means of differential scanning calorimetry (DSC), and specifically a resin having a half maximum width of the endothermic peak within 6° C. when measured at a temperature rise rate of 10° C./min.

The crystalline resin is not particularly restricted as long as it is a resin having the above-described physical properties, and specific examples thereof include a crystalline polyester resin and a crystalline vinyl-based resin. From the viewpoint of fixability or chargeability to a recording material such as paper and the like, and control of the melting temperature in a preferable range, a crystalline polyester is preferred. Also, an aliphatic crystalline polyester resin having a more suitable melting temperature is more preferable.

The crystalline polyester resin is synthesized from a polyvalent carboxylic acid component and a polyhydric alcohol component. The crystalline polyester resin to be used may be a commercially available product or a synthesized product.

Examples of the polyvalent carboxylic acid component include aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, 1,18-octadecanedicarboxylic acid, and the like, aromatic dicarboxylic acids including dibasic acids such as phthalic acid, isophthalic acid, terephthalic acid, naphthalene-2,6-dicarboxylic acid, malonic acid, mesaconic acid, and the like, etc., and anhydrides or lower alkyl esters thereof, but are not restricted thereto.

Examples of the trivalent or higher valent carboxylic acid include 1,2,4-benzenetricarboxylic acid, 1,2,5-benzenetricarboxylic acid, 1,2,4-naphthalenetricarboxylic acid, and the like, and anhydrides and lower alkyl esters thereof. These may be used singly or in combination of two or more kinds thereof.

Further, a sulfonic acid group-containing dicarboxylic acid component is preferably contained, in addition to the above-described aliphatic dicarboxylic acid or aromatic dicarboxylic acid as the acid component. The sulfonic acid group-containing dicarboxylic acid is effective for improvement of dispersion of the color materials such as a pigment and the like. Also, when emulsifying or suspending the all of the resins in water to prepare the particles, if there is a sulfonic acid group, it is possible to perform emulsification or suspension without using a surfactant.

Examples of the sulfonic acid group-containing dicarboxylic acid include, but are not restricted to, sodium 2-sulfoterephthalate, sodium 5-sulfoisophthalate, sodium sulfosuccinate, and the like. Examples also include lower alkyl esters and acid anhydrides of the above-mentioned sulfonic acid group-containing dicarboxylic acids. These sulfonic acid group-containing divalent or higher carboxylic acid components are preferably contained in an amount from 0% by mole to 20% by mole, and more preferably from 0.5% by mole to 10% by mole, with respect to the entire carboxylic acid components constituting the polyester. By incorporating the sulfonic acid group-containing divalent or higher carboxylic acid components in the above range, the stability over time of the emulsified particles is maintained, and therefore, reduction of the crystallinity of the polyester resin is inhibited and the average particle diameter of the toner particles is adjusted.

Furthermore, it is more preferable to incorporate a dicarboxylic acid component having a double bond between carbon atoms, in addition to the above-described aliphatic dicarboxylic acid or aromatic dicarboxylic acid. Since the dicarboxylic acid having a double bond can be crosslinked using the double bonds by a radical reaction, it is preferably used to prevent hot offset at the time of fixing. Examples of such a dicarboxylic acid include, but are not limited to, maleic acid, fumaric acid, 3-hexenedioic acid, 3-octenedioic acid, and the like. Examples also include lower alkyl esters and acid anhydrides of the above-mentioned dicarboxylic acids. Among these, fumaric acid, maleic acid, and the like are preferable from the viewpoint of cost.

As the polyhydric alcohol component, an aliphatic diol is preferable, and a linear aliphatic diol having main chain portions each having 7 to 20 carbons is more preferable. If the aliphatic diol is branched, the crystallinity of the polyester resin is reduced and the melting temperature is lowered, and therefore, the toner blocking resistance, the image preservability, and the low temperature fixability are deteriorated in some cases. In addition, if the number of carbons is less than 7, in the case of performing a polycondensation reaction with an aromatic dicarboxylic acid, the melting temperature is raised, and thus, the low temperature fixability becomes difficult in some cases, whereas if the number of carbons is more than 20, it may be difficult to obtain materials suitable for practical use. The number of carbons is more preferably 14 or less.

Specific examples of the aliphatic dial preferable include, but are not limited to, ethyleneglycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,14-eicosanedecanediol, and the like. Among these, in terms of easy availability, 1,8-octane dial, 1,9-nonanediol, and 1,10-decanediol are preferable.

Examples of the trivalent or higher valent alcohol include glycerin, trimethylolethane, trimethylolpropane, pentaerythritol, and the like. These may be used singly or in combination of two or more kinds thereof.

The content of the aliphatic dials in the polyhydric alcohol components is preferably 80% by mole or more, and more preferably 90% or more. If the content of the aliphatic dials is less than 80% by mole, the crystallinity of the polyester resin is reduced and the melting temperature is lowered, and therefore, the toner blocking resistance, the image preservability, and the low temperature fixability are deteriorated in some cases.

Furthermore, if necessary, for the purpose of adjustment of acid values or hydroxyl group values, and the like, monovalent acids such as acetic acid, benzoic acid, or the like or monovalent alcohol such as cyclohexanol benzyl alcohol, or the like may be used.

Further, the crystalline polyester has an ester concentration in the range from 0.01 to 0.12, as defined by the following formula.

$$M=K/A$$

wherein M represents an ester concentration, K represents the number of the ester groups in the crystalline polyester, and A represents the number of atoms constituting the polymer molecular chain of the crystalline polyester.

By inhibiting the ester concentration of the crystalline polyester to be from 0.01 to 0.12, the toner blocking resistance, the image preservability, and the low temperature fixability are excellent, and the chargeability can be further improved.

If the ester concentration of the crystalline polyester is less than 0.01, the chargeability is good but the melting temperature of the crystalline polyester becomes too high, and therefore, the low temperature fixability is deteriorated in some cases. The lower limit of the ester concentration is more preferably 0.04 or more.

On the other hand, if the ester concentration is more than 0.12, the melting temperature of the crystalline polyester becomes too low, in addition to the reduction of the chargeability, and as a result, the stability of the fixed image and the powder blocking property are deteriorated in some cases. The upper limit of the ester concentration is preferably 0.10 or less.

Furthermore, the "ester concentration" is one of the indices indicating the content ratio of the ester groups in the polymer of the crystalline polyester resin. In other words, the "number of the ester groups in the polymer" expressed by K in the above formula (M=K/A) represents the number of the ester bonds contained in the entire polymer.

The "number of atoms constituting the polymer chain of the polymer" expressed by A in the above formula (M=K/A) is a sum of the atoms constituting the polymer chain of the polymer, and this includes all of the numbers of the atoms participating in the ester bonds, but excludes the number of the atoms of the branched portion of the other constituent site.

That is, the carbon atoms and oxygen atoms derived from the carboxylic acid or alcohol group participating in the ester bonds (two carbon atoms in one ester bond), or six carbon atoms constituting the polymer chain, for example, in an aromatic ring, are considered for the calculation of the number of the atoms, but the hydrogen atoms constituting the polymer chain, for example, in the aromatic ring or alkyl group, the atom-to-atom group in the substituent are not considered for calculation of the number of the atoms.

The Amorphous Polymer Resin

On the other hand, examples of amorphous polymer resin include conventionally known thermoplastic binder resins, and the like, and specific examples thereof include homopolymers or copolymers of styrenes (styrenic resins), such as styrene, parachlorostyrene, α-methyl styrene, and the like; homopolymers or copolymers of vinyl group-containing esters (vinyl-based resins), such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, and the like; homopolymers or copolymers of vinylnitriles (vinyl-based resins), such as acrylonitrile, methacrylonitrile, and the like; homopolymers or copolymers of vinyl ethers (vinyl-based resins), such as vinyl methyl ether, vinyl isobutyl ether, and the like; homopolymers or copolymers of vinyl ketones (vinyl-based resins), such as vinyl methyl ketone, vinyl ethyl ketone, vinyl isopropenyl ketone, and the like; homopolymers or copolymers of olefins (olefin-based resins), such as ethylene, propylene, butadiene, isoprene, and the like; non-vinyl condensate resins such as an epoxy resin, a polyester resin, a polyurethane resin, a polyamide resin, a cellulose resin, a polyether resin, and the like, and a graft polymer of such a non-vinyl condensate resin and a vinyl-based monomer, and the like. These resins may be used singly or in combination of two or more kinds thereof. Among these resins, vinyl-based resins or polyester resins are particularly preferable.

The vinyl-based resin which is advantageous in the resin particle dispersion can be easily prepared by emulsion polymerization or seed polymerization using an ionic surfactant, or the like. Examples of the vinyl monomer include monomers that are raw materials for vinyl-based polymer acids or vinyl-based polymer bases, such as acrylic acid, methacrylic acid, maleic acid, cinnamic acid, fumaric acid, vinyl sulfonic acid, ethyleneimine, vinyl pyridine, vinylamine, and the like.

The resin particles preferably contain the vinyl-based monomers as a monomer component. Among the vinyl-based monomers, vinyl-based acid monomers are more preferred in terms of their advantages in the reactions of forming a vinyl-based resin, and the like, and specifically, dissociable vinyl-based monomers having a carboxylic acid as a dissociable group such as acrylic acid, methacrylic acid, maleic acid, cinnamic acid, fumaric acid, and the like are particularly preferred, in terms of control of the degree of polymerization and the glass transition temperature.

—Releasing Agent—

As the releasing agent, a substance having a primary maximum peak measured according to ASTMD 3418-8 in the range from 50° C. to 140° C. is preferable. If the primary maximum peak is fixed at 50° C. or higher, the offset does not easily occur when the releasing agent is fixed, whereas if the primary maximum peak is at 140° C. or lower, the fixing temperature is inhibited, thus, unevenness does not easily occur on the image surface, and therefore, the glossiness is not damaged.

The primary maximum peak may be measured using DSC-7 (trade name, manufactured by Perkin-Elmer). For the temperature calibration of the detective portion of this unit, the melting points of both indium and zinc are used, and for the calibration of calories, the melting heat of indium is used. The sample is measured, for example, by using an aluminum pan, an empty pan is set for a control and the temperature rise rate is set to 10° C./min for measurement.

As specific examples of the releasing agent, low molecular weight polyolefins such as polyethylene, polypropylene, polybutene, and the like, silicones having a softening point by heating, aliphatic acid amides such as oleic amide, erucamide, ricinoleic amide, stearic amide, and the like, plant waxes such as carnauba wax, rice wax, candelilla wax, Japan wax, jojoba oil, and the like, animal waxes such as bee wax, mineral, mineral petroleum waxes such as montane wax, ozokerite, ceresin, paraffin wax, microcrystalline wax, Fisher-Tropsch wax, and the like, or modifications thereof may be used.

These releasing agents are dispersed with polyelectrolytes such as polymer acids or polymer bases, ionic surfactants, and the like in water, and are made into particles by a high-shear homogenizer or a pressure discharge-type disperser while heating to a temperature no lower than the melting point, to prepare a releasing agent dispersion containing releasing agent particles having a particle diameter of 1 μm or less.

—Colorant—

As the colorant, various pigments are used.

As a black pigment, carbon black, a magnetic powder, or the like is used.

Examples of a yellow pigment include Hansa Yellow, Hansa Yellow 10G, Benzidine Yellow G, Benzidine Yellow GR, Threne Yellow, Quinoline Yellow, Permanent Yellow NCG, and the like.

Examples of a red pigment include red iron oxide, Watchung Red, Permanent Red 4R, Lithol Red, Brilliant Carmine 3B, Brilliant Carmine 6B, Du Pont Oil Red, Pyrazolone Red, Rhodamine B Lake, Lake Red C, Rose Bengal, Eosin Red, Alizarin Lake, and the like.

Examples of a blue pigment include iron blue, cobalt blue, Alkali Blue Lake, Victoria Blue Lake, Fast Sky Blue, Indanthrene Blue BC, Aniline Blue, Ultramarine Blue, Calco Oil Blue, Methylene Blue Chloride, Phthalocyanine Blue, Phthalocyanine Green, Malachite Green Oxalate, and the like. Further, these are mixed and used in a solid solution state.

—Other Internal Additive—

Further, a charge control agent may be added to the toner particles, if necessary. As a charge control agent, known charge control agents may be used, but for example, an azo metal complex compound, a salicylic acid metal complex compound, or a charge control agent of a resin type containing a polar group may be used. If the toner is prepared by a wet preparation process, it is desirable to use a material which is not easily soluble in water, so that it may be possible to control its ionic strength and prevent the contamination of waste water.

—External Additive—

The fluorocarbon-based resin as an external additive is not particularly limited, and selected from per se known fluorocarbon resins, but examples thereof include a polytetrafluoroethylene (PTFE), a tetrafluoroethylene-perfluoroalkyl biphenyl ether copolymer (PFA), a tetrafluoroethylene-hexafluoropropylene copolymer (FEP), and the like.

Among these, the fluorocarbon resin is preferably a polytetrafluoroethylene (PTFE).

Also, the molecular weight of the fluorocarbon-based resin is preferably from 3000 to 250,000, and more preferably from 6,000 to 200,000.

As the fluorocarbon resin, a synthesized product may be used or a commercially available product may be used.

The volume average particle diameter of the fluorocarbon resin particle is preferably from 0.1 μm to 4 μm. The fluorocarbon resin particles may be pulverized to regulate the particle diameter.

The volume average particle diameter of the fluorocarbon resin particles is determined by means of a scanning electron microscope (FE-SEM, trade name, manufactured by Hitachi: S-5500), by performing image analysis of the image taken at ×100,000 magnification using an image analyzer LUZEX AP (trade name, manufactured by Nireco Corporation). In addition, the number of the sampled fluorocarbon resin particles for the image analysis is 100. As the average particle diameter, a circle-equivalent diameter converted from the area is used.

The addition amount of the fluorocarbon resin particles is preferably from 0.05% by weight to 2.0% by weight, and more preferably from 0.1% by weight to 1.5% by weight, with respect to the total weight of the toner. If the addition amount is less than 0.05% by weight, the friction coefficient increases due to the friction between the electrophotographic photoreceptor and the blade of the cleaning device, which makes it easier to generate the ghost, whereas if the addition amount is more than 2.0% by weight, the charging characteristics of the toner is affected, which makes it easier to generate the opposite-polarity toner.

—Other External Additives—

As the external additives other than the fluorocarbon resin particles, for the purpose of improving the charging characteristics, the powder characteristics, the transfer characteristics, or the cleaning characteristics, external additives from known inorganic particles and/or resin particles, such as an inorganic charge control agent, a lubricant, an abrasive, a cleaning auxiliary agent, and the like can be externally added to the toner particles.

Examples of the lubricant include fatty acid amides such as an ethylene amide bisstearate, amide oleate, and the like, and fatty acid metal salts such as zinc stearate, calcium stearate, and the like.

—Method for Preparing Toner—

Next, the method for preparing a toner will be described.

The toner is obtained, for example, by preparing the particles, and then externally adding external additives to the obtained toner particles.

The toner particles are preferably prepared by a wet preparation method for preparing the toner particles in an acidic or basic aqueous medium, such as an aggregation coalescence method, a suspension polymerization method, a dissolution suspension granulation method, a dissolution suspension method, a dissolution emulsification aggregation coalescence method, and the like, but the aggregation coalescence method is particularly preferred.

Specifically, for example, if the toner particles contain a crystalline resin, an amorphous polymer resin, a colorant, and a releasing agent, toner particles are prepared, for example, by a method including a first aggregation step of mixing a resin dispersion in which crystalline resins are dispersed, a colorant dispersion in which colorants are dispersed, a releasing agent dispersion in which releasing agents are dispersed to form core aggregated particles containing the crystalline resin, the colorant particles, and the releasing agent, a second aggregation step of forming a shell layer containing an amorphous polymer resin on the surface of the core aggregated particles to obtain core/shell aggregated particles, and a fusion/integration step of heating the core/shell aggregated particles to a temperature of no lower than the glass transition temperature of the crystalline resin or the amorphous polymer resin for fusion/integration.

Next, the fluorocarbon resin particles are adhered to the obtained toner particle surface to prepare a toner.

Examples of the method for externally adding the external additives to the toner particles include a method for performing the mixing in a known mixer such as a V-type blender, a Henschel mixer, a Redige mixer, or the like. In addition, the toner particles and the fluorocarbon resin particles are mixed in the powder state to adhere the fluorocarbon resin particles strongly to the toner particle surface.

Particularly, a method for adhering the fluorocarbon resin particles to the toner particle surface using a shear force is preferable since the stress to the toner particles is small and the fluorocarbon resin particles are strongly adhered. Examples of the device for this method include NOBILTA (for example, NOBILTA NOB130: trade name, manufactured by Hosokawa Micron Corporation, and the like).

NOBILTA is a stirring device for stirring the particles while applying a high pressure to the particles by narrowing the free space (clearance) into which the particles are placed.

Further, if the toner is used after being mixed with a carrier, the carrier includes iron powders, glass beads, ferrite powders, nickel powders, or a coated one thereof, of which each surface is individually coated with a resin. Also, the blending ratio with the carrier is arbitrarily set.

Next, the cleaning device (cleaning unit) will be described.

For the cleaning device, a blade system is employed. The blade is disposed applying a pressure of 0.20 mN/mm (2.0 gf/mm) or more to the electrophotographic photoreceptor surface for cleaning the surface of the electrophotographic photoreceptor.

Herein, the "pressure applied to the electrophotographic photoreceptor surface" is a pressure for pressing the blade onto the electrophotographic photoreceptor surface, and is a value (N) calculated by the following formula.

$$N=dEt^3/4L^3$$

wherein d, E, t, and L are as follows.

d: Interference amount of the blade (Bite depth of the electrophotographic photoreceptor surface) [mm]

E: Young's modulus of the blade [(Pa)]

t: Thickness of the Young's modulus of the blade [mm]

L: Free length of the blade [mm]

Figure 5:
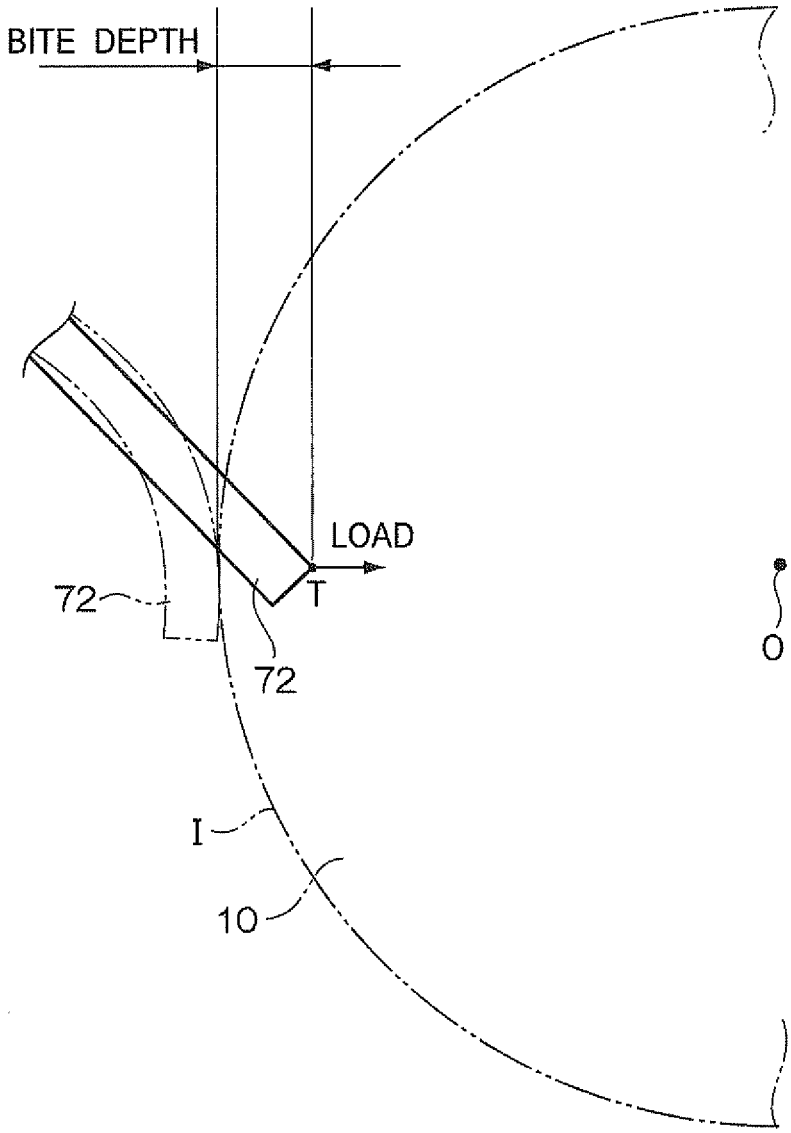
FIG. 5 is a schematic drawing showing the pressure applied to the electrophotographic photoreceptor surface of the blade.
Figure 6:
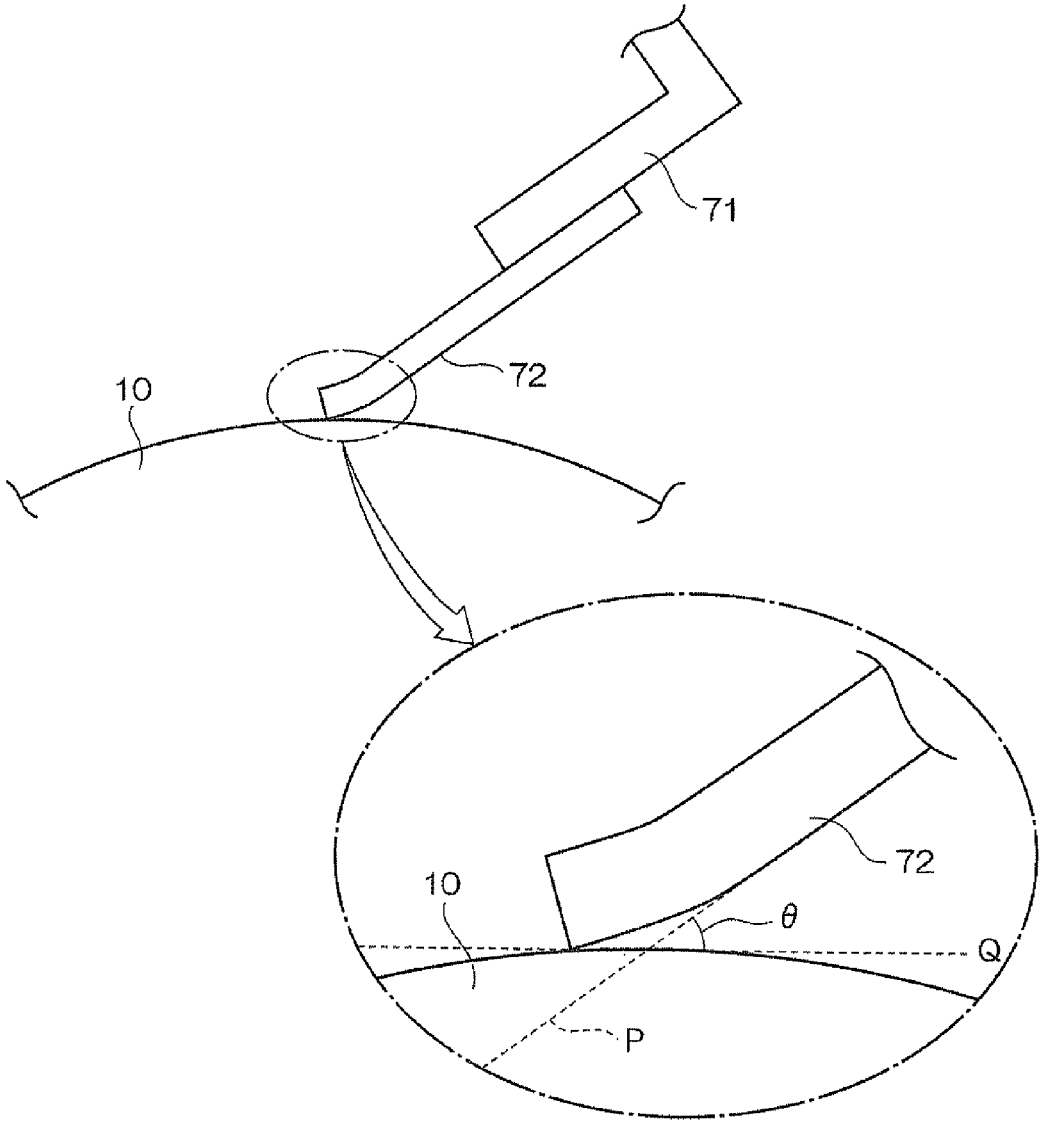
FIG. 6 is a schematic drawing showing the set angle of the blade.
Figure 7:
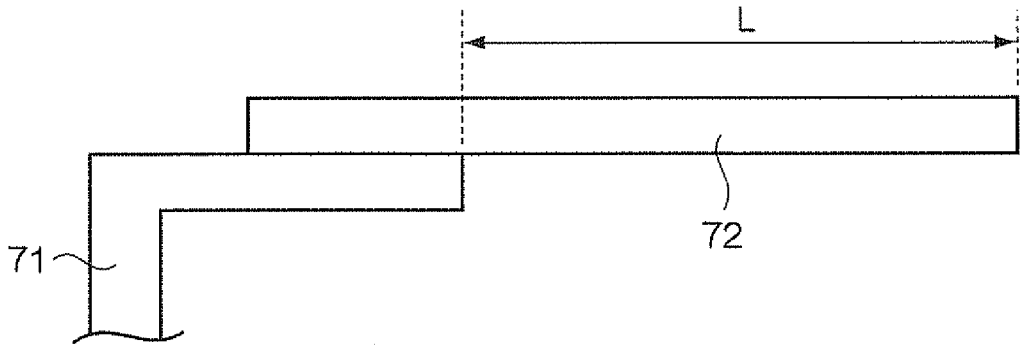
FIG. 7 is a schematic drawing showing the free length of the blade.

The calculation method based on the calculation formula of the pressure applied to the electrophotographic photoreceptor surface ($N=dEt^3/4L^3$) will be described with reference to FIGS. 5 to 7. FIG. 5 is a schematic diagram for illustrating the pressure applied to the electrophotographic photoreceptor surface of the blade. FIG. 6 is a schematic diagram for illustrating the set degrees of the blade angle. FIG. 7 is a schematic diagram for illustrating the free length of the blade.

The amount of the bite depth (d) of the blade 72 refers to a distance between the tip T and the virtual line I when the tip T of the blade 72 is put inside based on the virtual line T of the periphery of the electrophotographic photoreceptor 10 (a distance from the tip T to the rotation axis center O of the electrophotographic photoreceptor 10 connected therewith), assuming that there is no electrophotographic photoreceptor 10, as shown in FIG. 5.

Also, in FIG. 5, the blade 72 is represented by a solid line, assuming there is no electrophotographic photoreceptor 10, and the actual arrangement state of the blade 72 and the electrophotographic photoreceptor 10 in the device is represented by chain double-dashed lines. Further, the direction of the load in the tip T is a direction toward the rotation center O of the electrophotographic photoreceptor (represented by the arrows in FIG. 5).

The set angle θ of the blade 72 is, for example, in the case where the diameter of the electrophotographic photoreceptor 10 is 30 mm, is favorably from 14.5 degrees to 22.5 degrees, preferably from 16.5 degrees to 20.5 degrees, and more preferably from 17.5 degrees to 19.5 degrees.

This set angle θ means that, as shown in FIG. 6, when viewed from the axial direction of the electrophotographic photoreceptor 10, the blade 72 (its tip) is pressed against the surface of the electrophotographic photoreceptor 10 and the tip is in the bent state, an angle (sharp angle) formed between the virtual line P along the side facing the thickness direction of the blade 72 of the non-bent portion of the blade 72 and the tangent line Q at the intersection point where the virtual line P is contacted with the surface of the electrophotographic photoreceptor 10.

The free length L of the blade 72 is, for example, favorably from 5 mm to 16 mm, preferably from 6 mm to 15 mm, and more preferably from 7 mm to 14 mm.

This free length represents, as shown in FIG. 7, a distance L from the tip of the free end of the blade 72 to the support portion of the blade 72 (the boundary between the support region and the non-support region by the case 71 (or a support member provided separately)).

The Young's modulus E of the blade 72 is, for example, favorably from 5 MPa to 12 MPa, preferably from 6 MPa to 10 MPa, and more preferably from 6 MPa to 9 MPa.

This Young's modulus E is calculated from the following formula by measuring the force ΔS applied on the unit cross-sectional area and the growth Δa in the unit length.

Formula: $E=\Delta S/\Delta a$ wherein ΔS is calculated from the load F, the film thickness t of the blade 72, and the width w of the blade 72, and Δa is calculated from the standard length L of the sample and the sample growth ΔL at the time of load application, as follows, respectively.

Formula: $\Delta S=F/(w\times t)$

Formula: $\Delta a=\Delta L/L$

For measurement of the Young's modulus, a commercially available tensile tester may be used. For example, a tensile tester MODEL-1605N, trade name, manufactured by Aikoh Engineering Co., Ltd. is used.

The thickness t of the blade 72 is, for example, favorably from 1 mm to 3 mm, preferably from 1.5 mm to 2.5 mm, and more preferably from 1.8 mm to 2.2 mm.

The pressure of the blade, applied to the electrophotographic photoreceptor, is preferably from 0.20 mN/mm to 0.66 mN/mm (6.5 gf/mm), and more preferably from 0.20 mN/mm to 0.61 mN/mm (6.0 gf/mm). If the applied pressure is less than 0.20 mN/mm, failure of the cleaning of the toner easily occurs when a high-hardness blade is used, whereas if the applied pressure is too high, the friction with the photoreceptor increases, whereby increase in the torque, wear of the photoreceptor, generation of Streaks by the chipping of the blade angles, generation of a ghost due to friction with the photoreceptor, or the like easily occurs.

The blade contains urethane rubber.

By incorporating the urethane rubber, a blade can be provided with abrasion resistance for contact and friction with the electrophotographic photoreceptor surface, the toner, and the like. In particular, even when the electrophotographic photoreceptor surface (protective layer) is a surface containing chain polymerizable functional groups such as 4 or more methacryloyl groups, and the like, which is difficult to be abraded, the abrasion resistance can be exhibited.

To improve the abrasion resistance of the blade, it is preferable to employ a high-hardness and high-modulus material as a material for the portion in contact with the electrophotographic photoreceptor. When this high-modulus material is used for the monolayer urethane rubber blade, generally the resistance is improved, but the elasticity decreases. The decrease in the elasticity indicates that it is difficult to attain growth since the rubber-like property is lessened.

In addition, if the elasticity decreases, in the case of using a developer obtained by mixing the toner with the carrier as a developer, when foreign materials such as a piece of the carrier debris buried in the electrophotographic photoreceptor surface, and the like pass through an edge of the blade and a contact portion with the electrophotographic photoreceptor surface, the foreign materials follow the force of deforming the edge, and thus, the edge tip cannot be deformed and the blade angle is liable to have chipping in some cases, along with occurrence of a phenomenon commonly known as BCO (Bead Carry Over) in which a part of a magnetic carrier is transferred to the electrophotographic photoreceptor surface by an electrostatic attraction force.

As described above, in order to improve the abrasion resistance for the friction with the electrophotographic photoreceptor surface having a surface containing chain polymerizable functional groups such as 4 or more methacryloyl groups, and the like, which is difficult to be abraded, it is preferable that the blade includes a first layer in contact with the photoreceptor surface and a back layer not in contact with the photoreceptor surface and the material of the first layer satisfies Inequalities (A) to (C) below.

By such a constitution, the chipping of the blade angle can be inhibited.

$$3.92\leq M\leq 29.42 \quad \text{Formula (A)}$$

$$0<\alpha\leq 0.294 \quad \text{Formula (B)}$$

$$S\geq 250 \quad \text{Formula (C)}$$

In Formulae (A) to (C), M represents a 100% modulus (MPa), α represents the ratio {Δ stress/Δ amount of strain=(stress at 200% amount of strain-stress at 100% amount of strain)/(200−100)} (MPa/%) of the change in stress (Δ stress) to the change in amount of strain (Δ amount of strain) at an amount of strain from 100% to 200% in a stress-strain curve, and S represents the elongation at break (%) measured according to JIS K6251 (using a dumbbell type No. 3 test piece).

Here, the blade may have a bilayer constitution in which a second layer as a back layer is provided on the back side of the first layer in contact with the surface of a member to be cleaned, or a constitution in which a back layer including plural layers such as a second layer, a third layer, and the like is provided on the back side of the first layer. In addition, this will be described in detail by way of an example of a blade having a bilayer constitution including a first layer and a second layer as a black layer.

The material of the first layer in contact with the surface of the member to be cleaned satisfies the formula (A), and therefore, the blade is excellent in abrasion resistance while exhibiting a good cleaning property.

When the 100% modulus M is less than 3.92 MPa (40 kgf/cm$^2$), the abrasion resistance becomes insufficient, and therefore, it is difficult to maintain a good cleaning property over a long time. On the other hand, when the 100% modulus M is more than 29.42 MPa (300 kgf/cm$^2$), the first layer material is too hard, and therefore, the property of following the member to be cleaned is liable to be deteriorated, and a good cleaning property is hardly exerted. In addition, the surface of the member to be cleaned may be damaged in some cases.

In addition, the 100% modulus M is preferably in the range from 5 MPa to 20 MPa, and more preferably in the range from 6.5 MPa to 15 MPa.

Moreover, since the first layer material satisfies the inequalities (B) and (C), chipping resistance is excellent.

When α shown in the formula (B) is more than 0.294, the first layer material has inferior flexibility. Therefore, along with occurrence of BCO, when foreign materials existing in the surface of the member to be cleaned, particularly foreign materials buried and fixed in the surface, such as foreign materials buried and fixed in the electrophotographic photoreceptor surface, repeatedly pass the contact part of the member to be cleaned and the blade, high stress is thus repeatedly applied to the tip of the first layer of the blade, whereby the tip cannot be so deformed as to efficiently diffuse the stress and accordingly the edge is cracked within a relatively short period. Consequently, because of the cracking in an early stage, it is impossible to maintain a good cleaning property for a long duration.

Further, α is preferably 0.2 or less, and more preferably 0.1 or less, and it is better as α is closer to 0, which is the ultimate lower limit of the physical property.

Further, if the elongation at break S shown in the formula (C) is less than 250%, when foreign materials which exist in the surface of the member to be cleaned as described above come into collision with a high force against the first layer tip, the first layer tip is drawn and cannot follow the deformation, and accordingly, the edge chipping occurs within a relatively short time. Consequently, because of the generation of the chipping in an early stage, it is difficult to maintain a good cleaning property for a long duration.

Moreover, the elongation at break S is preferably 300% or more, and more preferably 350% or more. A larger elongation at break S is preferred from the viewpoint of the edge chipping. However, when the elongation at break S is more than 500%, the tracking property (adhesiveness) to the members to be cleaned increases and the friction force with the member to be cleaned increases, resulting in an increase in the friction force with the member to be cleaned, and consequently, an increase in the wear of the first layer tip (angle abrasion) in some cases. Accordingly, from the viewpoint of the edge abrasion, the elongation at break S is preferably 500% or less, more preferably 450% or less, and even more preferably 400% or less.

Furthermore, the ambient temperature, that is, the environmental temperature during use, around the blade of the image forming apparatus is thought to be in the range from 10° C. to 60° C. Accordingly, when the glass transition temperature Tg of the material of the first layer in contact with the surface of the member to be cleaned is higher than the environmental temperature during use, the blade loses its rubber-like property, and the contact pressure of the cleaning blade, thereby becoming unstable in some cases. Accordingly, the glass transition temperature Tg of the material of the first layer is preferably not more than the lower limit value (10° C.) of the environmental temperature during use.

On the other hand, when the glass transition temperature Tg of the material of the first layer in contact with the surface of the member to be cleaned is 10° C. or lower, the rebound resilience R of the material tends to decrease in terms of a rebound resilience at a low temperature. In particular, when the rebound resilience R is less than 10%, the stick & slip behavior at the first layer tip is slow, and there easily occurs a portion that rubs against the surface of the member to be cleaned while a certain deformed shape is maintained to be in contact with the surface in some cases.

When the deformed shape is not canceled by the stick-and-slip behavior, the first layer tip rubs against the surface while the shape of the first layer tip is maintained, whereby localized plastic deformation easily occurs. When such localized plastic deformation occurs, the adhesiveness between the first layer tip and the member to be cleaned is lowered, whereby cleaning failure occurs more easily in some cases. In order to suppress such localized plastic deformation, it is preferable that the stick and slip behavior always occurs at the first layer tip. In order that the stick and slip behavior always occurs at the first layer tip, the rebound resilience R is preferably 10% or more, more preferably 15% or more, and still more preferably 20% or more in an environment of a temperature of not lower than 10° C., which is substantially the lower limit value of the environmental temperature during use.

The rebound resilience R is measured in accordance with JIS K6255 (1996).

The 100% modulus M shown in the formula (A) is measured in accordance with JIS K6251 (1993) with a dumbbell No. 3 test piece at a tensile speed of 500 mm/min and obtained from the stress at 100% strain. Further, as a measurement device, STROGRAPH AE ELASTOMER (trade name, manufactured by Toyo Seiki Seisakusho, Ltd.) is used.

The α shown in the formula (B) is obtained from a stress-strain curve, and herein, the stress and the amount of strain are obtained by the procedure and method as described below. That is, measurement is carried out in accordance with JIS K6251 (1993), with a dumbbell No. 3 test piece at a tensile speed of 500 mm/min, and α is calculated from the stresses at 100% strain and 200% strain. Further, STROGRAPH AE ELASTOMER ((trade name, manufactured by Toyo Seiki Seisakusho, Ltd.) is used as a measurement device.

Furthermore, in an aspect of the invention, the glass transition temperature of the material of the first layer in contact with the surface of the member to be cleaned, and the glass transition temperatures of the soft segment material and the hard segment material are obtained as a peak temperature of tan δ (loss tangent) after the temperature dispersion is measured by means of a viscoelastometer.

Herein, the value, tan δ, is derived from the storage and loss elastic moduli as described below. When a sine-wave strain as a stationary vibration is applied to a linear elastic body, the stress is represented by the formula (D). Here, |E*| is called a complex elastic modulus. From rheological theory, the elastic component and the viscous component are represented by the formulas (E) and (F), respectively. In the formulae, E' represents a storage elastic modulus and E" represents a loss elastic modulus. Represents a phase difference angle between the stress and the strain, and is called a "mechanical loss angle".

The value, tan δ, is represented by E"/E' as shown in the formula (G), and is called a "loss tangent". As the loss tangent increases, the linear elastic body has a property closer to rubber elasticity.

$$\sigma=|E^*|\gamma\cos(\omega t) \quad \text{Formula (D)}$$

$$E'=|E^*|\cos\delta \quad \text{Formula (E)}$$

$$E''=|E^*|\sin\delta \quad \text{Formula (F)}$$

$$\tan\delta=E''/E' \quad \text{Formula (G)}$$

The value, tan δ, is measured with RHEOPECTROLER DVE-V4 (trade name, manufactured by Rheology Co., Ltd.) under a static strain of 5% and a 10 Hz sine-wave tensile vibration in the temperature range from −60° C. to 100° C.

As described above, the material for the first layer used in the blade (cleaning blade) according to the present aspect is excellent in both the abrasion resistance and the chipping resistance.

Accordingly, along with the occurrence of BCO, to cope with foreign materials existing in the surface of the member to be cleaned, particularly foreign materials buried and fixed in the surface, such as foreign materials buried and fixed in the electrophotographic photoreceptor surface, and the like, it is not necessary to newly provide a separate device for improving the abrasion resistance or the chipping resistance in the image forming apparatus as in the conventional art, and therefore, the tendency that the devices tend to be larger and more expensive can be inhibited.

Further, as the life of the blade becomes longer, it is easy to improve the life of and reduce the maintenance cost of a processing cartridge, a cleaning device, and an image forming apparatus, each equipped with the blade according to the present aspect, respectively. Particularly, for a processing cartridge or an image forming apparatus, each equipped with both an electrophotographic photoreceptor having the improved abrasion resistance of the surface and the blade according to the present aspect, the above-described merits can be further improved.

The material satisfying the inequalities (A) to (C) is not particularly limited as long as it is a urethane material. However, urethane rubber containing a hard segment and a soft segment is particularly preferable. When the urethane rubber contains both the hard segment and the soft segment, the urethane rubber may easily satisfy the physical properties defined by the inequalities (A) to (C), and may achieve both abrasion resistance and chipping resistance at high levels.

Moreover, the terms, "hard segments" and "soft segments", refer to the fact that the material constituting the former is relatively harder than the material constituting the latter and the material constituting the latter is relatively softer than the material constituting the former in the urethane rubber.

Herein, the glass transition temperature of the urethane rubber containing the hard segment and the soft segment is preferably in the range from −50° C. to 30° C., and more preferably in the range from −30° C. to 10° C. If the glass transition temperature is higher than 30° C., the blade becomes fragile in a temperature range for practical use in some cases, whereas if the glass transition temperature is lower than −30° C., the blade does not exhibit sufficient hardness and stress in the temperature range for practical use in some cases.

Consequently, in order to realize the above-mentioned glass transition temperature, the glass transition temperature of the material constituting the hard segment of the urethane rubber (hereinafter sometimes referred to as a hard segment material) is preferably in the range from 30° C. to 100° C., and more preferably in the range from 35° C. to 60° C., and the glass transition temperature of the material constituting the soft segment of the urethane rubber (hereinafter sometimes referred to as a soft segment material) is preferably in the range from −100° C. to −50° C., and more preferably in the range from −90° C. to −60° C.

Also, when the hard segment material and the soft segment material, each having such a glass transition temperature, are used, the weight ratio of the hard segment material to the total weight of the hard segment material and the soft segment material (hereinafter sometimes referred to as hard segment material ratio) is preferably from 46% by weight to 96% by weight, more preferably from 50% by weight to 90% by weight, and even more preferably from 60% by weight to 85% by weight.

If the ratio of the hard segment material is less than 46% by weight, the abrasion resistance of the first layer tip becomes insufficient and abrasion occurs in a short period of time, and therefore, a good cleaning property cannot be maintained over a long time in some cases. If the ratio of the hard segment material is more than 96% by weight, the first layer tip is too hard, and the flexibility and the tensibility becomes insufficient, and therefore, chipping occurs in a short period of time, and thus, a good cleaning property cannot be maintained over a long period of time in some cases.

The combination of the hard segment material and the soft segment material is not particularly limited, it may be any of combinations of urethane rubber having different glass transition temperatures or weight average molecular weights such that one material is relatively harder than the other and the other is relatively softer than the one.

For example, as a hard segment material, a urethane rubber having a weight average molecular weight of 1000 to 4000 is preferably used, and a urethane rubber having a weight average molecular weight of 1500 to 3500 is more preferably used.

When the weight average molecular weight is less than 1000, cleaning failure easily occurs upon use of the blade under a low temperature environment due to reduction of the elasticity of the urethane rubber constituting the hard segments in some cases. On the other hand, when the weight average molecular weight is more than 4000, the permanent strain of the polyurethane resin constituting the hard segments becomes significant, and the first layer tip cannot maintain the contact pressure against the member to be cleaned, and as a result, cleaning failures occur in some cases.

Furthermore, examples of the urethane rubber to be used as the hard segment material include PLACCEL 205 and PLACCEL 240, trade name, manufactured by Daicel Chemical Industries, Ltd., and the like.

To the cleaning device, a unit may be added for removing the discharge products for the purpose of improving the abrasion resistance of the blade or a unit for collecting the carriers for the purpose of collecting the powder carriers which are adhered to the electrophotographic photoreceptor surface together with occurrence of BCO, and which may sometimes be a cause of the clipping of the tip (edge) of the blade.

Examples of the transfer device include per se known transfer charging devices such as a contact type transfer charging device using a belt, a roller, a film, a rubber blade or the like, and a scorotron transfer charging device or a corotron transfer charging device using corona discharge, and the like.

As an intermediate transfer device (intermediate transfer belt), belt-like units such as polyimide, polyamideimide, polycarbonate, polyarylate, polyester, rubber, and the like, each having semiconductivity, are used. Further, as the shape of the intermediate transfer device 50, drum-like units can also be used besides the belt-like units.

The image forming apparatus may be equipped with, for example, a photo-destaticizing unit for performing photo-destaticization of the photoreceptor, besides the above various units.

Figure 8:
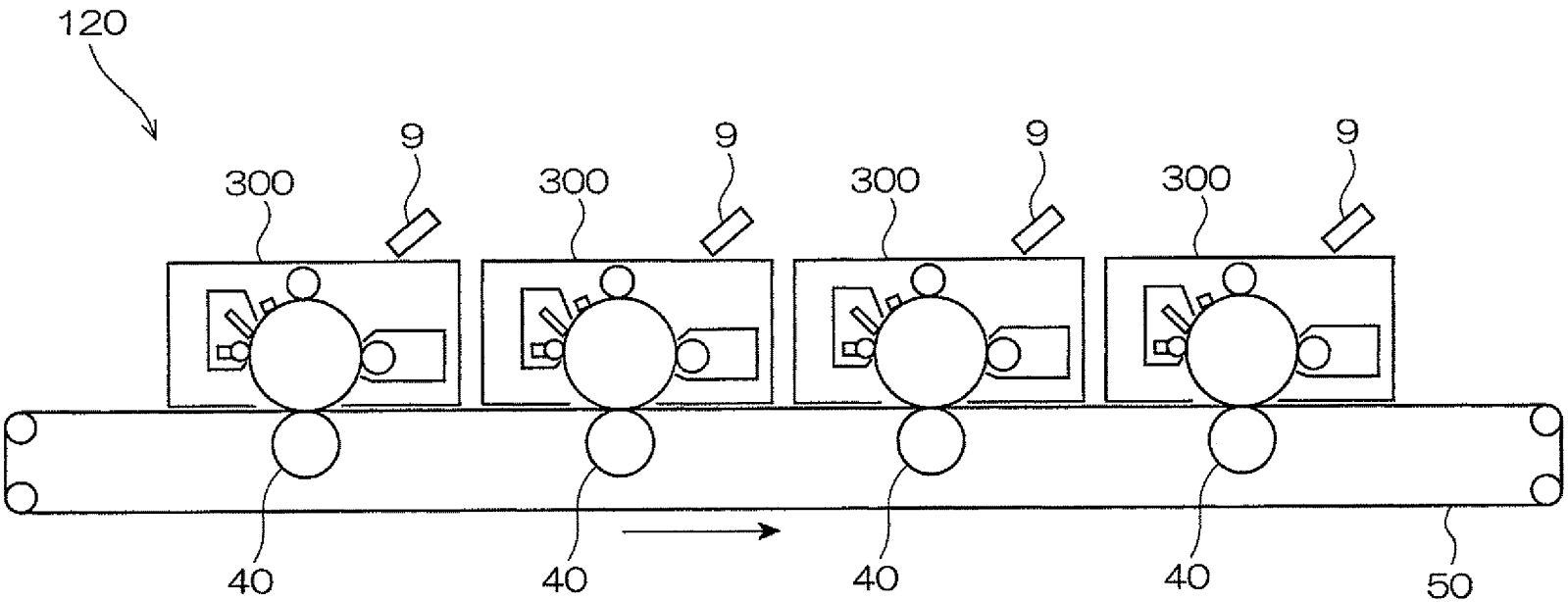
FIG. 8 is a schematic block diagram showing the image forming apparatus concerning another embodiment of the aspect of the invention.

FIG. 8 is a cross-sectional view showing the image forming apparatus 120 according to another aspect.

The image forming apparatus 120 shown in FIG. 8 is a tandem-type full color image forming apparatus with four processing cartridges 300.

In the image forming apparatus 120, four processing cartridges 300 are arranged in parallel on the intermediate transfer device 50, which is configured such that one electrophotographic photosensitive member is used for one color. Further, the image forming apparatus 120 has the same configuration as the image forming device 100, except that it is of a tandem type.

EXAMPLES

Hereinafter, exemplary embodiments of the invention will be described in detail with reference to Examples. However, the invention is not limited to these Examples.

Examples of Preparation of Color Developer

—Preparation of Crystalline Polyester Resin Dispersion (1)—

Dodecanedioic acid [acid component]: 92.5 mol %

Sodium 5-sulfoisophthalate [acid component]: 3 mol %

5-t-Butyl isophthalate [acid component]: 4.5 mol %

1,10-Decanediol: 100 mol %

$Ti(OBu)_4$ [catalyst]: 0.014% by weight based on the total weight of the acid components.

The above-described components are placed into a three-neck flask dried by heating, and then the pressure of the air in the vessel is reduced by a procedure for pressure reduction. In addition, a nitrogen gas is used to make an inert atmosphere, followed by performing reflux at 180° C. for 6 hours by mechanical stirring. Thereafter, the temperature is slowly raised to 220° C. by distillation under reduced pressure, followed by stirring the mixture for 2.5 hours. Further, when the mixture enters a viscous state, its molecular weight is confirmed by means of GPC, and when its weight average molecular weight reaches 11,000, distillation under reduced pressure is stopped and the mixture is air-cooled to obtain a crystalline polyester (1).

For the obtained crystalline polyester (1), the melting temperature is measured by means of a thermal analyzer of a differential scanning calorimeter (DSC3110, trade name, manufactured by Mack Science Co., thermal analysis system 001) (hereinafter simply referred to as "DSC"). Measurement is carried out from room temperature to 150° C. at a temperature rise rate of 10° C./minute and the melting temperature is obtained by analysis by means of JIS standard (see JIS K-7121). As measured by this method, the crystalline polyester has distinct peaks and a melting temperature of 80° C., and the ester concentration is 0.078.

After that, 80 g of the crystalline polyester (1) and 587 g of deionized water are added into a stainless beaker, which is then put into a hot bath and heated to 95° C. After the crystalline polyester resin (1) is dissolved therein, the mixture is stirred with a homogenizer (ULTRA-TURRAX T50; trade name, manufactured by IKA Works Inc.) at 8000 rpm and its pH is adjusted to 7.0 with the addition of diluted ammonia. Then, the mixture is emulsified and dispersed with the dropwise addition of 20 g of an aqueous solution in which 0.8 g of an anionic surfactant (NEOGEN RK; trade name, manufactured by Dai-ichi Kogyo Seiyaku Co., Ltd.) is diluted, thereby obtaining a crystalline polyester resin dispersion (1) having a volume average particle diameter of 0.21 μm [resin particle concentration: 12% by weight].

—Preparation of Crystalline Polyester Resin Dispersion (2)—

Sebacic acid [acid component]: 92.5 mol %

Sodium 5-sulfoisophthalate [acid component]: 3 mol %

5-t-Butyl isophthalate [acid component]: 5.5 mol %

1,10-Decanediol: 100 mol %

$Ti(OBu)_4$ [catalyst]: 0.014% by weight based on the total weight of the acid components.

The above-described components are put into a three-neck flask dried by heating, and then the pressure of the air in the vessel is reduced by a procedure for pressure reduction. In addition, a nitrogen gas is used to make an inert atmosphere, followed by performing reflux at 180° C. for 6 hours by mechanical stirring. Thereafter, the temperature is slowly raised to 220° C. by distillation under reduced pressure, followed by stirring the mixture for 2.5 hours. Further, when the mixture enters a viscous state, its molecular weight is confirmed by means of GPC, and when its weight average molecular weight reaches 12,000, distillation under reduced pressure is stopped and the mixture is air-cooled to obtain a crystalline polyester (2).

For the obtained crystalline polyester (2), the melting temperature is measured using the above-described method (DSC), and it is found that the crystalline polyester has distinct peaks and a melting temperature of 73° C., and the ester concentration is 0.084.

Next, the mixture is emulsified and dispersed in substantially the same manner as that for the crystalline polyester resin dispersion (1), whereby a crystalline polyester resin dispersion (2) having a volume average particle diameter of 0.20 μm [resin particle concentration: 12% by weight] is prepared.

—Preparation of Amorphous Polymer Dispersion (1)—

Non-ionic surfactant NONIPOL 400 (trade name, manufactured by Sanyo Chemical Co., Ltd.) 6 g Anionic surfactant NEOGEN SC (trade name, manufactured by Dai-ichi Kogyo Seiyaku Co., Ltd.) 10 g Ion-exchanged water 560 g.

The above-described components are mixed to obtain an aqueous surfactant solution. Next, the components below are mixed and dissolved to obtain a dissolved product.

Styrene: 370 g n-Butyl acrylate: 30 g

Acrylic acid: 4 g

Dodecanediol: 24 g

Carbon tetrabromide: 4 g.

The obtained dissolved product is put into an aqueous surfactant solution prepared in advance, and dispersed and emulsified in the flask. While slowly mixing them for 10 minutes, 50 g of ion-exchanged water in which 4 g of ammonium persulfate is dissolved is put into the flask, which is then substituted with nitrogen. Thereafter, the contents are heated in an oil bath while stirring in the flask until the temperature of the contents reaches 70° C., and the emulsion polymerization is continued as it is for 6 hours. In this manner, an amorphous polymer dispersion (1) in which resin particles having a volume average particle diameter of 0.11 μm, a glass transition temperature of 58° C., and a weight average molecular weight (Mw) of 21,000 are dispersed (resin particle concentration: 40% by weight) is prepared.

—Preparation of Amorphous Polymer Dispersion (2)—

Bisphenol A ethylene oxide adduct (average number of added moles 2.2): 386 g

Trimethylol propane: 428 g

Terephthalic acid: 1392 g.

Into a flask having an inner volume of 5 liters, equipped with a stirrer, a nitrogen inlet, a temperature sensor, and a rectifying column, the above-described monomers are put, and the temperature is raised to a temperature of 190° C. over one hour. After confirming that the mixture in the reaction system is being uniformly stirred, dibutyltin oxide (1.2 g) is introduced thereinto. Further, with removal of the produced water by evaporation, the temperature is raised from the same temperature to 240° C. for 6 hours, and the dehydration condensation reaction is further continued for 3 hours at 240° C., thereby performing a reaction until the acid value becomes 6.0 mgKOH/g and the softening point becomes 105° C. Then, the temperature is lowered to 190° C., 497 parts of anhydrous phthalic acid are slowly introduced, and the reaction is continued at the same temperature for one hour to obtain an amorphous polyester resin having an acid value of 51 mgKOH/g, a glass transition temperature of 67° C., and a weight average molecular weight of 29,000, Thereafter, the mixture is transferred to CABITRON CD 1010 (trade name, manufactured by Eurotech S.p.A.) in a molten state at a rate of 100 g/min. 0.37% by weight of diluted aqueous ammonia prepared by diluting reagent aqueous ammonia with ion-exchanged water is poured into a separately-prepared aqueous medium tank. The diluted aqueous ammonia is transferred to the CABITRON (trade name, manufactured by Eurotech Ltd.) at a rate of 0.1 liter/min while heating to 120° C. by a heat exchanger together with the polyester resin in a molten state.

The CABITRON is operated under the conditions of a rotator rotating speed of 60 Hz and a pressure of 5 kg/cm$^2$ to obtain an amorphous polymer dispersion (2) including polyester resins having a volume average particle diameter of 0.10 μm (resin particle concentration: 30% by weight).

—Preparation of Releasing Agent Dispersion (1)—

Paraffin wax HNP-9 (trade name, manufactured by Nippon Seiro Co., Ltd., melting point 75° C.): 50 g Anionic surfactant NEOGEN RK (trade name, manufactured by Dai-ichi Kogyo Seiyaku Co., Ltd.): 0.5 g Ion-exchanged water: 200 g.

The above-described components are heated to 95° C. and dispersed using a homogenizer ULTRA-TURRAX T50 (trade name, manufactured by IKA Works Inc.), and then subjected to a dispersion treatment with a Manton Gorin high-pressure homogenizer (Grin Corp.) to prepare a releasing agent dispersion (1) in which releasing agents having a volume average particle diameter of 230 nm are dispersed (releasing agent concentration: 20% by weight).

—Preparation of Releasing Agent Dispersion (2)—

Paraffin wax HNP-0190 (trade name, manufactured by Nippon Seiro Co., Ltd., melting point 90° C.): 50 g Anionic surfactant NEOGEN RK (trade name, manufactured by Dai-ichi Kogyo Seiyaku Co., Ltd.): 0.5 g Ion-exchanged water: 200 g.

The above-described components are heated to 95° C. and dispersed using a homogenizer ULTRA-TURRAX T50 (trade name, manufactured by IKA Works Inc.), and then subjected to a dispersion treatment with a Manton Gorin high-pressure homogenizer (Grin Corp.) to prepare a releasing agent dispersion (2) in which a releasing agents having a volume average particle diameter of 250 nm are dispersed (releasing agent concentration: 20% by weight).

—Preparation of Colorant Dispersion—

Cyan pigment Pigment Blue 15:3 (trade name, manufactured by Dainichiseika Color & Chemicals Mfg. Co., Ltd., copper phthalocyanine)): 1 kg Anionic surfactant NEOGEN RK (trade name, manufactured by Dai-ichi Kogyo Seiyaku Co., Ltd.): 15 g Ion-exchanged water: 9 kg.

The above-described components are mixed, dissolved, and dispersed for one hour using a high-pressure impact type disperser ultimizer HJP30006 (trade name, manufactured by Sugino Machine Ltd.) to obtain a coloring agent dispersion in which a colorant (cyan pigment) is dispersed.

A magenta pigment dispersion, a yellow pigment dispersion, and a black pigment dispersion are individually prepared in substantially the same manner as that for the cyan pigment dispersion, except that 1 kg of a cyan pigment of Pigment Blue 15:3 (trade name, manufactured by Dainichiseika Color & Chemicals Mfg. Co., Ltd., copper phthalocyanine) is respectively replaced with 1 kg of Magenta Pigment (C. I. Pigment Red 57:1, trade name), 1.3 kg of Yellow Pigment (C. I. Pigment Yellow 17, trade name), and 0.8 g of carbon black (Regal 330; trade name, manufactured by CABOT Co., Ltd.).

(Color Developer (1))

—Preparation of Toner Particles (1)—

Crystalline polyester resin dispersion (1): 833 g

Cyan pigment dispersion: 27.17 g

Releasing agent dispersion (1): 50 g

Releasing agent dispersion (2): 25 g

Non-ionic surfactant (IGEPAL CA897; trade name): 1.25 g.

The above-described raw materials are put into a 5-L cylindrical stainless steel vessel, and dispersed and mixed for 10 minutes by ULTRATURRAX (trade name) at 4000 rpm with the addition of a shear force. Then, 1.75 g of a 10% aqueous nitric acid solution of aluminum polychloride as an aggregating agent is slowly added dropwise thereto, and the mixture is dispersed and mixed for 15 minutes by ULTRATURRAX (trade name) at 5000 rpm to obtain a raw material dispersion.

Thereafter, the raw material dispersion is transferred to a polymerization vessel equipped with a stirrer and a thermometer, and starts to be heated in a mantle heater to promote the growth of the aggregated particles at 45° C. Further, at this time, it is preferable to control the pH of the raw material dispersion to a range from 2.2 to 3.5, and if necessary, the pH is adjusted with 0.3 N aqueous nitric acid or a 1 N aqueous sodium hydroxide solution. The dispersion is maintained in the above pH range for 2 hours to form core aggregated particles. The volume average particle diameter D50v of the core aggregated particles, as measured by means of COULTER MULTISIZER II (trade name, manufactured by Coulter Inc., aperture diameter: 50 μm), is 5.0 μm.

Then, 50 g of the amorphous polymer dispersion (1) is further added thereto, and the amorphous polymer particle (1) is adhered to the surface of the core aggregated particles. In addition, the temperature is raised to 60° C. and the aggregated particles are arranged with confirmation of the size and form of the particles by means of an optical microscope and COULTER MULTISIZER II (trade name). Thereafter, in order to fuse the aggregated particles, the pH is raised to 8.0 and the temperature is then raised to 90° C. After fusion of the particles is confirmed by a microscope, the pH is lowered to 6.0 while the temperature is maintained at 90° C. After one hour, heating is stopped and ice-water is introduced thereto for rapid cooling at a temperature lowering rate of 100° C./minute. Thereafter, powders are sieved with a 20-μm mesh, washed repeatedly with water, and then dried with a vacuum drier. The volume average particle diameter D50v of the toner particle (1) thus assembled is 5.8 μm.

In substantially the same manner except that a magenta pigment dispersion, a yellow pigment dispersion, and a black pigment dispersion are used instead of the pigment dispersion, a toner particle (1) of each color, having a volume average particle diameter D50v of 5.8 μm, is obtained. To the toner particles of each color, 1.2 parts by weight of titanium dioxide powders as an external additive and 1.0 part by weight of PTFE (LUBRON L2; trade name), based on 100 parts by weight of the toner, are added and mixed by a Henschel mixer to obtain a color toner (1) for developing an electrostatic charge image.

Next, 50 parts by weight of each toner and 1000 parts by weight of ferrite particles coated with the resin (volume average particle diameter 35 μm) are mixed to prepare a two-component developer.

(Color Developer (2))

—Preparation of Toner Particles (2)—

Under the same condition as the toner particles (1), core aggregated particles are formed. The volume average particle diameter D50v of the core aggregated particles is 5.1 μm. Next, the pH is raised to 4.0, 66.7 g of the amorphous polymer dispersion (2) is further added, and the amorphous polymer particles (2) are adhered to the core aggregated particle surface. In addition, the temperature is raised to 64° C. and the aggregated particles are arranged with confirmation of the size and form of the particles by means of an optical microscope and COULTER MULTISIZER II (trade name). Thereafter, in order to fuse the aggregated particles, the pH is adjusted to 8.0 and the temperature is then raised to 90° C. After fusion of the aggregated particles as adhered above is confirmed by a microscope, the pH is lowered to 6.5 again while the temperature is maintained at 90° C. After one hour, heating is stopped and ice-water is introduced thereto for rapid cooling at a temperature lowering rate of 100° C./minute. Thereafter, powders are sieved, washed, and then dried under the same condition as that in Example 1 to obtain toner particles (2) having a volume average particle diameter D50v of 5.5 μm.

By using this, in substantially the same manner as that in Color Developer (1), Color Developer (2) is obtained.

(Color Developer (3))

—Preparation of Toner Particles (3)—

In substantially the same manner as that in Example 1 except that the crystalline polyester resin dispersion (1) is replaced with the crystalline polyester resin dispersion (2), the core aggregated particles are formed. The volume average particle diameter D50v of the core aggregated particles is 4.7 μm. Next, 50 g of the amorphous polymer dispersion (1) is further added, and the amorphous polymer particles (1) are adhered to the core aggregated particle surface. Thereafter, powders are sieved, washed, and then dried under the same condition as in Example 1 to obtain toner particles (3) having a volume average particle diameter D50v of 4.9 μm, which is used to obtain Color Developer (3) in substantially the same manner as that in Color Developer (1).

(Color Developer (4))

—Preparation of Toner Particles (4)—

In substantially the same manner as that in Color Developer (3) except that controlling the growth and fusion of the aggregated particles of the toner particles (4) is performed with visual observation, toner particles (4) having a volume average particle diameter D50v of 3.5 μm are obtained, which are used to obtain Color Developer (4) in substantially the same manner as that in Color Developer (3).

(Color Developer (5))

—Preparation of Toner Particles (5)—

In substantially the same manner as that in Color Developer (3) except that controlling the growth and fusion of the aggregated particles of the toner particles (5) is performed with visual observation, toner particles (5) having a volume average particle diameter D50v of 2.8 μm are obtained, which are used to obtain (Color Developer (5)) in substantially the same manner as that in Color Developer (3).

(Color Developer (6))

—Preparation of Toner Particles (6)—

In substantially the same manner as that in Color Developer (3) except that controlling the growth and fusion of the aggregated particles of the toner particles (6) is performed with visual observation, toner particles (6) having a volume average particle diameter D50v of 7.0 μm are obtained, which are used to obtain Color Developer (6) in substantially the same manner as that in Color Developer (3).

(Color Developer (7))

—Preparation of Toner Particles (7)—

In substantially the same manner as that in Color developer (1) except that the amount of PTFE in Color developer (1) is changed to 0.3 parts by weight, Color developer (7) is obtained.

(Color Developer (8))

In substantially the same manner as that in Color developer (1) except that PTFE in Color developer (1) is not added, Color developer (8) is obtained.

(Color Developer (9))

In substantially the same manner as that in Color developer (1) except that the amount of PTFE in Color developer (1) is changed to 2.5 parts by weight, Color developer (9) is obtained.

(Color Developer (10))

100 parts by weight of a linear polyester resin (linear polyester obtained from terephthalic acid/bisphenol A ethylene oxide adduct/cyclohexane dimethanol; Tg=62° C., Mn=4,000, Mw=35,000, acid value=12, Hydroxyl value=25)

3 parts by weight of Magenta Pigment (C. I. Pigment Red 57).

The mixture of the above-described raw materials is kneaded with an extruder and ground using a grinder of a surface grinding type. Thereafter, the resulting mixture is classified into fine and coarse particles using a pneumatic classifier TURBO CLASSIFIER-TC-15N (trade name, manufactured by Nissin Engineering Inc.) to obtain a medium-sized magenta color toner particle having a volume average particle diameter D50v of 8 μm. The shape factor SF1 of this toner as determined by an image analyzer is 165.

The magenta pigments are each changed into cyan pigments (β-form phthalonic cyanine: C. I. Pigment Blue 15:3), Yellow Pigment (Disazo Yellow: C. I. Pigment Yellow 12), to individually obtain a cyan toner particle and a yellow toner particle in substantially the same manner as that in the magenta toner. The shape factors SF1 are 165 for of the cyan toner and 165 for the yellow toner, respectively.

In substantially the same manner as that in Color developer (1) except that each of the above-described toner particles is used instead of each of the toner particles used in the preparation of Color developer (1) and PTFE is not added, Color developer (10) is obtained.

Example of Blade Formation

<Cleaning Blade A1>

A member for the first layer was formed as following. At first, hard segment materials containing, as polyol components, polycaprolactone polyol (PLACCEL 205, trade name, an average molecular weight 529, hydroxyl value 212 mgKOH/g, manufactured by Daicel Chemical Industries, Ltd.) and polycaprolactone polyol (PLACCEL 240, trade name, an average molecular weight 4,155, hydroxyl value 27 mgKOH/g, manufactured by Daicel Chemical Industries, Ltd.) and a soft segment material comprising an acrylic resin containing two or more hydroxyl group (ACTFLOW UMB-2005B, trade name, manufactured by Soken Chemical Engineering Co., Ltd.) are mixed at 8:2 (by weight).

Next, the mixture 100 part by weight of the hard segment material and the soft segment material is mixed with, as an isocyanate compound, 4,4'-diphenylmethane diisocyanate (MILLIONATE MT, trade name, hereinafter referred to as MDI, manufactured by Nippon Polyurethane Industry Co., Ltd.) 6.26 part by weight and reaction is carried out at 70° C. for 3 hours in nitrogen atmosphere.

The isocyanate compound used in this reaction is selected so as to adjust the ratio (isocyanate group/hydroxyl group) of the isocyanate groups to the hydroxyl groups contains in the reaction system to be 0.5.

Successively, the above-mentioned isocyanate compound 34.3 part by weight is further added and reaction is carried out at 70° C. for 3 hours in nitrogen atmosphere to obtain a prepolymer.

The total amount of the isocyanate compound used at the time of using the prepolymer is 40.56 part by weight.

Next, the prepolymer is heated to 100° C. and defoamed for 1 hour under reduced pressure and then, the prepolymer 100 part by weight is mixed with a mixture 7.14 part by weight of 1,4-butanediol and trimethylolpropane (weight ratio=60/40) and sufficiently mixed for 3 minutes without entraining foams therein to prepare a composition A1 for forming the first layer.

Next, the above-described composition A1 for forming the first layer is poured into a centrifugal molding device having the mold adjusted to 140° C., and a curing reaction is carried out for one hour, thereby forming a first layer having a flat plate shape.

Further, the composition A1 for forming the second layer prepared by the method below as a member for the second layer is prepared.

To the polybutylene glycol, diphenyl methane-4,4-diisocyanate is mixed, and the reaction is carried out at 120° C. for 15 minutes. The composition obtained by using the resulting prepolymer in combination with 1,4-butanediol and trimethylolpropane as a curing agent is used.

Furthermore, the first layer and the second layer are adhered to each other by pouring the composition for forming the second layer into the centrifugal molding device after forming the first layer into a flat plate shape as described above, and curing it, and the second layer is formed on the back side of the first layer.

In addition, the physical properties of the first layer monolayer are measured, and the results are as follows.

100% Modulus=10.8 MPa $\alpha$=0.059 (MPa/%)

Elongation at break=420%

Rebound resilience=20%

Glass transition temperature=−10° C.

This flat plate is cooled after being crosslinked at 110° C. for 24 hours, then cooled, and cut into a predetermined dimension to obtain a cleaning blade (A1) having a thickness of the first layer thickness of 0.5 mm and a thickness of the second layer thickness of 1.5 mm (ratio of the thickness of the first layer relative to the total thickness: 25%).

In addition, the physical properties of the first layer monolayer are measured, and the results are as follows.

100% Modulus=7.4 MPa $\alpha$=0.09 (MPa/%)

Elongation at break=535%

Rebound resilience=35%

Glass transition temperature=−8° C.

<Cleaning Blade (A2)>

As a hard segment material, the same hard segment material as that used in the preparation of the cleaning blade (A1) is used, and as a soft segment material, a polybutadiene resin containing 2 or more hydroxyl groups (R-45HT; trade name, manufactured by Idemitsu Kosan Co., Ltd.) is used. The hard segment material and the soft segment material are mixed at a ratio of 8:2.

In substantially the same manner as that in the cleaning blade A1 except that the above mixture is used to prepare the composition for forming the first layer, the first layer and the second layer are formed, thereby obtaining a cleaning blade (A2).

In addition, the physical properties of the first layer monolayer are measured, and the results are as follows.

100% Modulus=7.4 MPa $\alpha$=0.09 (MPa/%)

Elongation at break=535%

Rebound resilience=35%

Glass transition temperature=−8° C.

<Electrophotographic Photoreceptor (B1)>

(Formation of Undercoating Layer)

100 parts by weight of zinc oxide (volume average particle diameter: 70 nm, manufactured by Tayca Corporation, specific surface area: 15 $m^2/g$) is stirred and mixed with 500 parts by weight of tetrahydrofuran, into which 1.3 parts by weight of a silane coupling agent (trade name: KBM503, manufactured by Shin-Etsu Chemical Co., Ltd.) is added and stirred for 2 hours. Subsequently, tetrahydrofuran is removed by distillation under reduced pressure, and baking is carried out at a temperature of 120° C. for 3 hours to obtain the zinc oxide having the surface treated with the silane coupling agent.

110 parts by weight of the surface-treated zinc oxide is stirred and mixed with 500 parts by weight of tetrahydrofuran, into which a solution in which 0.6 parts by weight of alizarin is dissolved in 50 parts by weight of tetrahydrofuran is added, then stirred at a temperature of 50° C. for 5 hours. Subsequently, the zinc oxide to which the alizarin is added is collected by filtration under a reduced pressure, and dried under reduced pressure at a temperature of 60° C. to obtain alizarin-added zinc oxide.

38 parts by weight of a solution prepared by dissolving 60 parts by weight of the alizarin-added zinc oxide, 13.5 parts by weight of a curing agent (blocked isocyanate, trade name: Sumidur 3175, manufactured by Sumitomo-Bayer Urethane Co., Ltd.) and 15 parts by weight of a butyral resin (trade name: S-Lec BM-1, manufactured by Sekisui Chemical Co., Ltd.) in 85 parts by weight of methyl ethyl ketone is mixed with 25 parts by weight of methyl ethyl ketone.

The mixture is dispersed using a sand mill with the glass beads having a diameter of 1 mm for 2 hours to obtain a dispersion.

0.005 parts by weight of dioctyltin dilaurate as a catalyst, and 40 parts by weight of silicone resin particles (trade name: Tospal 145, manufactured by GE Toshiba Silicone Co., Ltd.) are added to the dispersion to obtain a coating solution for a undercoating layer. A undercoating layer having a thickness of 18 μm is formed by applying the coating solution on an aluminum substrate having a diameter of 84 mm, a length of 340 mm and a thickness of 1 mm by dip coating, and drying to cure at a temperature of 170° C. for 40 minutes.

(Formation of Charge Generating Layer)

A mixture comprising 15 parts by weight of hydroxy gallium phthalocyanine having the diffraction peaks at least at 7.3°, 16.0°, 24.9° and 28.0° of Bragg angles (2θ±0.2°) in an X-ray diffraction spectrum of Cuk$\alpha$ X ray as a charge generating substance, 10 parts by weight of vinyl chloride-vinyl acetate copolymer resin (trade name: VMCH, manufactured by Nippon Unicar Co., Ltd.) as a binding resin, and 200 parts by weight of n-butyl acetate is dispersed using a sand mill with the glass beads of 1 mm diameter for 4 hours. 175 parts by weight of n-butyl acetate and 180 parts by weight of methyl ethyl ketone are added to the obtained dispersion, then stirred to obtain a coating solution for a charge generating layer. The coating solution for charge generating layer is applied to the undercoating layer by dip coating, and dried at an ordinary temperature (25° C.) to form a charge generating layer having a film thickness of 0.2 μm.

(Formation of Charge Transporting Layer)

45 parts by weight of N,N'-diphenyl-N,N-bis(3-methylphenyl)-[1,1']-biphenyl-4,4'-diamine and 55 parts by weight of bisphenol Z polycarbonate resin (viscosity average molecular weight: 55,000) are dissolved in 800 parts by weight of chlorobenzene to obtain a coating solution for a charge transporting layer. The coating solution is applied onto the charge generating layer, then dried at a temperature of 130° C. for 45 minutes to form a charge transporting layer having a film thickness of 15 μm as a charge transporting layer of the electrophotographic photoreceptor (B1).

(Preparation of Surface Layer)

20 parts by weight of N,N'-diphenyl-N,N'-bis(3-methylphenyl)-[1,1']-biphenyl 4,4'-diamine, 20 parts by weight of a bisphenol Z polycarbonate resin (viscosity average molecular weight: 55,000), 60 parts by weight of the compound A-16, 1 part by weight of OTAZO-15 (trade name, manufactured by Otsuka Chemical Co., Ltd., molecular weight 354.4) are dissolved in 500 parts by weight of cyclopentanone, and coated on a charge transporting layer by spray-coating. After drying with air at room temperature for 30 minutes, the mixture is subjected to a heat treatment at 150° C. for one hour under nitrogen at an oxygen concentration of 200 ppm and cured, to form a protective layer having a film thickness of 15 μm, thereby preparing a photoreceptor (B1). The surface of the electrophotographic photoreceptor layer (protective layer) is peeled off and immersed in tetrahydrofuran at 50° C. for 3 hours, and the amount of the eluted compound A-16 is measured by means of GPC, and found to be 0.3% by weight with respect to the total weight of the protective layer that is a cured film.

<Electrophotographic Photoreceptor (B2)>

In substantially the same manner as that for the electrophotographic photoreceptor (B1) except that a surface layer is formed with 50 parts by weight of the compound A-16, an electrophotographic photoreceptor (B2) is prepared. This surface of the electrophotographic photoreceptor layer (protective layer) is peeled off and immersed in tetrahydrofuran at 50° C. for 3 hours, and the amount of the eluted compound A-16 is measured by means of GPC, and found to be 0.6% by weight with respect to the total weight of the protective layer that is a cured film.

<Electrophotographic Photoreceptor (B3)>

In substantially the same manner as that for the electrophotographic photoreceptor (B1) except that a surface layer is formed with 80 parts by weight of the compound II-10 and 20 parts by weight of the polypropylene glycol diacrylate instead of 20 parts by weight of N,N'-diphenyl-N,N'-bis(3-methylphenyl)-[1,1']-biphenyl 4,4'-diamine, 20 parts by weight of a bisphenol Z polycarbonate resin (viscosity average molecular weight: 55,000), and 60 parts by weight of the compound A-16, an electrophotographic photoreceptor (B3) is prepared. This surface of the electrophotographic photoreceptor layer (protective layer) is peeled off and immersed in tetrahydrofuran at 50° C. for 3 hours, and the amount of the eluted compound II-10 is measured by means of GPC, and found to be 4.6% by weight with respect to the total weight of the protective layer that is a cured film.

<Electrophotographic Photoreceptor (B4)>

By the same procedure up to the charge transporting layer as the preparation of the electrophotographic photoreceptor (B1), preparation is carried out. On the charge transporting layer, 9.5 parts by weight of the compound (B) below, 25 parts by weight of 1-methoxy-2-propanol, 0.2 parts by weight of 3,5-di-t-butyl-4-hydroxytoluene (BHT), and 0.01 parts by weight of p-toluene sulfonic acid are added to 0.5 parts by weight of NIKALAC MW-30 HM (trade name, manufactured by Sanwa Chemical Co., Ltd., methylated melamine resin) to prepare a coating liquid for a protective layer, and this coating liquid is coated onto the charge transporting layer by an immersion coating method, dried at room temperature for 30 minutes, and then cured by a heat treatment at 150° C. for 1 hour, thereby preparing an electrophotographic photoreceptor (B4) having a film thickness of the protective layer of 7 μm. This surface of the electrophotographic photoreceptor layer (protective layer) is peeled off and immersed in tetrahydrofuran at 50° C. for 3 hours, and the amount of the eluted compound (B) is measured by means of GPC, and found to be 0.1% by weight with respect to the total weight of the protective layer that is a cured film.

[Chem. 33]

COMPOUND (B):

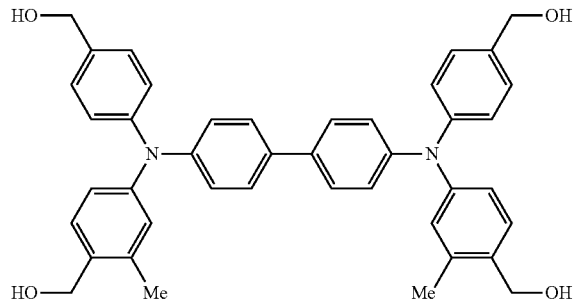

<Electrophotographic Photoreceptor (B5)>

In substantially the same manner as that for the electrophotographic photoreceptor (1) except that the layer is formed by using 60 parts by weight of III-1 instead of 20 parts by weight of N,N'-diphenyl-N,N'-bis(3-methylphenyl)-[1,1']-biphenyl 4,4'-diamine, 20 parts by weight of a bisphenol Z polycarbonate resin (viscosity average molecular weight: 55,000), and 60 parts by weight of the compound A-16, an electrophotographic photoreceptor (B5) having a film thickness of the protective layer of 5 μm is prepared. This surface of the electrophotographic photoreceptor layer (protective layer) is peeled off and immersed in tetrahydrofuran at 50° C. for 3 hours, and the amount of the eluted III-1 is measured by means of GPC, and found to be 0.6% by weight with respect to the total weight of the protective layer that is a cured film.

Examples 1 to 14 and Comparative Examples 1 to 8

Evaluation of Image Quality

The color developer, the cleaning blade, and the electrophotographic photoreceptor, each of which is prepared as described above, are used in the combinations shown in Table 1, using a commercially available electrophotographic copier (DOCUCOLOR 1257 GA; trade name, manufactured by Fuji Xerox Co., Ltd.) to carry out image printing, and subsequently, the following evaluations are carried out at normal temperature and normal humidity (20° C., 50% RH) and at high temperature and high humidity (28° C., 85% RH).

That is, with regards to the image quality of the 100,000$^{th}$ sheet, after conducting the image formation test of 100,000 sheets under an environment of ambient temperature and normal humidity (20° C., 50% RH), and the first image quality of the second image formation test, after conducting the image formation test of 100,000 sheets and then leaving it for 24 hours under an environment of low temperature and low humidity (8° C., 20% RH), the ghost, the fog, the streaks, and the image degradation are evaluated.

The results are shown in Table 1.

Following to the evaluation of the image quality under an environment of low temperature and low humidity, with regards to the image quality of the 100,000$^{th}$ sheet, after conducting the image formation test of 100,000 sheets under an environment of high temperature and high humidity (28° C., 85% RH), and with regards to the image quality of the first sheet of the second image formation test, after conducting the image formation test of 100,000 sheets and then leaving it for 24 hours under an environment of high temperature and high humidity (28° C., 85% RH), the ghost, the fog, the streaks, and the image degradation are evaluated. In addition, the abrasion amount of the photoreceptor surface layer after completion of all the print tests is measured.

The results are shown in Table 1.

<Ghost Evaluation>

Figure 9A:
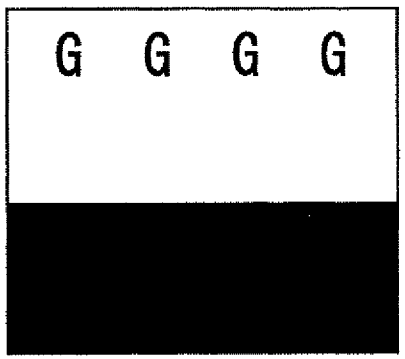
FIGS. 9A to 9C are each a drawing showing the image pattern used in the image evaluation.

Regarding the ghost, a chart of the pattern having G shown in FIG. 9A and black areas is printed, and the state where the character G is expressed in the black areas is visually evaluated.

A: Good as in FIG. 9A.

B: A negligible level that is slightly more noticeable than that in FIG. 9A.

Figure 9B:
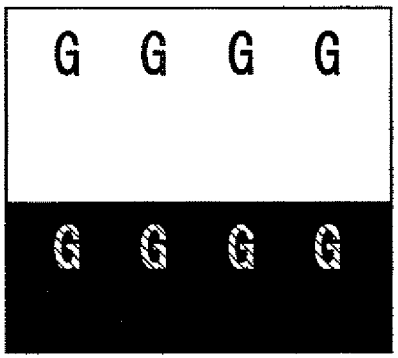

C: Slightly noticeable level as in FIG. 9B.

Figure 9C:
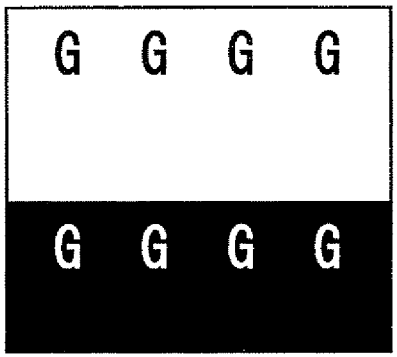

D: Intermediate level between that of FIG. 9B and that of FIG. 9C.

E: Clearly shown as that in FIG. 9C.

<Evaluation of Fogs>

The degree of toner adhesiveness to the white area is evaluated by visual observation using the same sample with the evaluation of ghost of image quality.

A: Good.

B: Light fog is developed.

C: Fog having a damaging effect of image quality is developed.

<Evaluation of Streaks>

Development of streaks is evaluated by visual observation using the same sample with the evaluation of ghost of image quality.

A: Good.

B: Streaks are partially developed.

C: Streaks having a damaging effect on image quality are developed.

<Evaluation of Granularity>

For the granularity, a chart of the pattern having G shown in FIG. 9A and black areas is printed, and the uniformity of the image at the black areas is visually evaluated.

A: Good.

B: Neglectable.

C: Clearly observed.

D: Noticeable.

E: Very noticeable.

<Evaluation of Image Flow>

The image flow is visually evaluated using the same samples as those of the above-described ghost evaluation.

A: Good.

B: While the printing tests are continuously carried out, there is no problem, but after leaving for one day (24 hours), a problem occurs.

C: Even while the printing tests are continuously carried out, a problem occurs.

TABLE 1

| | | Example No. | | | | | | | | | | |
|---|---|---|---|---|---|---|---|---|---|---|---|---|
| | | 1 | 2 | 3 | 4 | 5 | 6 | 7 | 8 | 9 | 10 | 11 |
| Color Developer | | 1 | 1 | 1 | 2 | 2 | 2 | 3 | 3 | 3 | 4 | 7 |
| V.A.P.D (μm) | | 5.8 | 5.8 | 5.8 | 5.5 | 5.5 | 5.5 | 4.9 | 4.9 | 4.9 | 3.5 | 5.8 |
| SF1 | | 130 | 130 | 130 | 125 | 125 | 125 | 120 | 120 | 120 | 110 | 110 |
| PTFE Amount (%) | | 1 | 1 | 1 | 1 | 1 | 1 | 1 | 1 | 1 | 1 | 0.30 |
| Cleaning Blade | | A1 | A1 | A1 | A2 | A2 | A2 | A1 | A1 | A1 | A2 | A2 |
| Applying Pressure (mN/mm) | | 0.3 | 0.3 | 0.3 | 0.3 | 0.3 | 0.3 | 0.3 | 0.3 | 0.3 | 0.5 | 0.5 |
| Photoreceptor | | B1 | B2 | B3 | B1 | B2 | B3 | B1 | B2 | B3 | B1 | B2 |
| A.M.E. (%) | | 0.30 | 0.60 | 4.60 | 0.30 | 0.60 | 4.60 | 0.30 | 0.60 | 4.60 | 0.30 | 0.60 |
| L.T.L.H | Ghost | A | A | A | A | A | A | A | A | A | A | B |
| | Fog | A | A | A | A | A | A | A | A | A | A | A |
| | Streaks | A | A | A | A | A | A | A | A | A | A | B |
| | Granularity | B | A | B | B | A | B | A | A | A | A | A |
| | Image degradation | A | A | A | A | A | A | A | A | A | A | A |
| H.T.H.H | Ghost | A | A | A | A | A | A | A | A | A | A | B |
| | Fog | A | A | A | A | A | A | A | A | A | A | A |
| | Streaks | A | A | A | A | A | A | A | A | A | A | B |
| | Granularity | B | A | B | B | A | B | A | A | A | A | A |
| | Image degradation | A | A | A | A | A | A | A | A | A | A | A |
| Abrasion amount of Photoreceptor (μm) | | 0.4 | 0.5 | 1.0 | 0.4 | 0.6 | 1.3 | 0.6 | 0.8 | 1.8 | 1.0 | 1.2 |

| | | Example No. | | | Comparative Example No. | | | | | | | |
|---|---|---|---|---|---|---|---|---|---|---|---|---|
| | | 12 | 13 | 14 | 1 | 2 | 3 | 4 | 5 | 6 | 7 | 8 |
| Color Developer | | 9 | 9 | 9 | 8 | 8 | 8 | 5 | 5 | 5 | 6 | 10 |
| V.A.P.D (μm) | | 5.8 | 5.8 | 5.8 | 5.8 | 5.8 | 5.8 | 2.8 | 2.8 | 2.8 | 7.0 | 8 |
| SF1 | | 130 | 130 | 130 | 130 | 130 | 130 | 105 | 105 | 105 | 150 | 165 |
| PTFE Amount (%) | | 2.40 | 2.40 | 2.40 | 0.00 | 0.00 | 0.00 | 1 | 1 | 1 | 1 | 0.00 |
| Cleaning Blade | | A2 | A2 | A2 | A1 | A2 | A1 | A1 | A1 | A1 | A1 | A1 |
| Applying Pressure (mN/mm) | | 0.20 | 0.20 | 0.20 | 0.3 | 0.3 | 0.3 | 0.7 | 0.7 | 0.7 | 0.2 | 0.3 |
| Photoreceptor | | B3 | B4 | B5 | B1 | B2 | B3 | B1 | B2 | B3 | B1 | B4 |
| A.M.E. (%) | | 4.60 | 0.10 | 0.60 | 0.30 | 0.60 | 4.60 | 0.30 | 0.60 | 4.60 | 0.30 | 0.10 |
| L.T.L.H | Ghost | A | A | A | C | E | C | B | B | B | A | A |
| | Fog | A | A | A | A | A | A | B | B | B | A | A |
| | Streaks | A | A | A | B | B | B | C | C | C | C | B |
| | Granularity | A | B | A | B | C | B | A | A | A | E | B |
| | Image degradation | A | A | A | A | A | A | A | A | A | A | A |
| H.T.H.H | Ghost | A | A | A | C | E | C | B | B | B | A | A |
| | Fog | A | A | A | A | A | A | B | B | B | A | A |
| | Streaks | A | A | A | A | A | A | C | C | C | C | A |

TABLE 1-continued

| | | | | | | | | | | | |
|---|---|---|---|---|---|---|---|---|---|---|---|
| Granularity | A | B | A | B | C | B | A | A | A | E | B |
| Image degradation | A | B | A | A | A | A | A | A | A | C | C |
| Abrasion amount of Photoreceptor (μm) | 1.5 | 2.0 | 0.9 | 0.4 | 0.7 | 1.3 | 1.8 | 1.9 | 3.5 | 0.2 | 2.3 |

In Table 1, "%" denotes "% by weight". The abbreviation "V.A.P.D" denotes the volume average particle diameter D50v of the toner particles, and the abbreviation SF1 denotes the shape factor SF1 of the toner. The abbreviation "L.T.L.H." denotes a condition of low temperature and low humidity (20° C., 50% RH) and the abbreviation "H.T.H.H." denotes a condition of high temperature and high humidity (28° C., 85% RH).

The abbreviation "A.M.E" denotes the amount of the compound eluted based on the total weight of the protective layers of the electrophotographic photoreceptors B1 to B5 [% by weight]. For the electrophotographic photoreceptors B1 and B2, the amount of the monomers to be eluted refers to the amount of the exemplary compound A-16 eluted [% by weight], and for the electrophotographic photoreceptor B3, the amount of the monomers to be eluted refers to the amount of the exemplary compound II-10 eluted [% by weight]. For the electrophotographic photoreceptor B4, the amount of the monomers to be eluted refers to the amount of the exemplary compound (B) eluted [% by weight], and for the electrophotographic photoreceptor B5, the amount of the monomers to be eluted refers to the amount of the exemplary compound III-1 eluted [% by weight].

From the above-described results, in the present Examples, it can be seen that under the conditions of low temperature and low humidity or of high temperature and high humidity, image defects such as a ghost are inhibited, as compared with Comparative Examples. This is believed to be caused by the fact that in the present Examples, the friction between the cleaning blade and the electrophotographic photoreceptor surface is inhibited, and thus, the generation of the friction charging is inhibited, as compared with Comparative Examples.

The foregoing description of the exemplary embodiments of the present invention has been provided for the purposes of illustration and description. It is not intended to be exhaustive or to limit the invention to the precise forms disclosed. The embodiments were chosen and described in order to best explain the principles of the invention and its practical applications, thereby enabling others skilled in the art to understand the invention for various embodiments and with the various modifications as are suited to the particular use contemplated.

All publications, patent applications, and technical standards mentioned in this specification are herein incorporated by reference to the same extent as if such individual publication, patent application, or technical standard was specifically and individually indicated to be incorporated by reference. It will be obvious to those having skill in the art that many changes may be made in the above-described details of the preferred embodiments of the present invention. It is intended that the scope of the invention be defined by the following claims and their equivalents.

What is claimed is:

1. An image forming apparatus comprising: an electrophotographic photoreceptor having an outermost layer configured to comprise at least a cured product including a charge transporting skeleton; a charging unit that charges the electrophotographic photoreceptor; an electrostatic latent image forming unit that forms an electrostatic latent image at the charged electrophotographic photoreceptor; a developing unit that develops the electrostatic latent image formed at the electrophotographic photoreceptor by a developer to form a toner image, the developing unit storing a developer comprising a toner having toner particles including a crystalline resin and having a shape factor SF1 of from about 100 to about 150 in addition to a volume average particle diameter of from about 3 μm to about 6 μm, and fluorocarbon-based resin particles as an external additive; a transfer unit that transfers the toner image to a medium to be transferred; and a cleaning unit that cleans a surface of the electrophotographic photoreceptor with a blade comprising urethane rubber, the blade disposed applying a pressure to the electrophotographic photoreceptor surface of about 0.20 mN/mm or more, wherein: the charge transporting skeleton is derived from a nitrogen-containing compound selected from the group consisting of a triarylamine-based compound, a benzidine-based compound and a hydrazone-based compound, and the nitrogen-containing compound is represented by the following Formula (A):

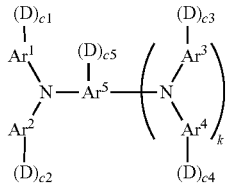

wherein, in Formula (A), each of $Ar^1$, $Ar^2$, $Ar^3$ and $Ar^4$ independently represents a substituted or unsubstituted aryl group; $Ar^5$ represents a substituted or unsubstituted aryl group or a substituted or unsubstituted arylene group; D represents a chain polymerizable functional group including at the terminal at least one selected from the group consisting of a methacryloyl group, a derivative of a methacryloyl group and a vinylphenyl group; each of c1, c2, c3, c4 and c5 independently represents 0, 1 or 2; k represents 0 or 1; and the total number of D is 4 or more, wherein the chain polymerizable functional group comprises four or more methacryloyl groups.

2. The image forming apparatus according to claim 1, wherein, in Formula (A), D is $—(CH_2)_d—(O—CH_2—CH_2)_e—O—CO—C(CH_3)=CH_2$, $—CH=CH_2$, or $—(CH_2)_d—(C=O)_f—O—C_6H_4—CH=CH_2$, wherein d represents an integer of 1 to 5, e represents 0 or 1, and f represents 0 or 1; and the total number of D is 4 or more.

3. A processing cartridge comprising: an electrophotographic photoreceptor having an outermost layer configured to comprise at least a cured product including a charge transporting skeleton; a charging unit that charges the electrophotographic photoreceptor; an electrostatic latent image forming unit that forms an electrostatic latent image at the charged electrophotographic photoreceptor; a developing unit that develops the electrostatic latent image formed at the electrophotographic photoreceptor by a developer to form a toner image, the developing unit storing a developer comprising a toner having toner particles including a crystalline resin and having a shape factor SF1 of from about 100 to about 150 in addition to a volume average particle diameter of from about 3 μm to about 6 μm, and fluorocarbon-based resin particles as an external additive; a transfer unit that transfers the toner image to a medium to be transferred; and a cleaning unit that cleans a surface of the electrophotographic photoreceptor with a blade comprising urethane rubber, the blade disposed applying a pressure to the electrophotographic photoreceptor surface of about 0.20 mN/mm or more, wherein: the charge transporting skeleton is derived from a nitrogen-containing compound selected from the group consisting of a triarylamine-based compound, a benzidine-based compound and a hydrazone-based compound, and the nitrogen-containing compound is represented by the following Formula (A):

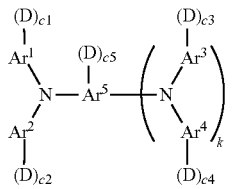

wherein, in Formula (A), each of $Ar^1$, $Ar^2$, $Ar^3$ and $Ar^4$ independently represents a substituted or unsubstituted aryl group; $Ar^5$ represents a substituted or unsubstituted aryl group or a substituted or unsubstituted arylene group; D represents a chain polymerizable functional group including at the terminal at least one selected from the group consisting of a methacryloyl group, a derivative of a methacryloyl group and a vinylphenyl group; each of c1, c2, c3, c4 and c5 independently represents 0, 1 or 2; k represents 0 or 1; and the total number of D is 4 or more, wherein the chain polymerizable functional group comprises four or more methacryloyl groups.

4. The processing cartridge according to claim 3, wherein, in Formula (A), D is $—(CH_2)_d—(O—CH_2—CH_2)_e—O—CO—C(CH_3)=CH_2$, $—CH=CH_2$, or $—(CH_2)_d—(C=O)_f—O—C_6H_4—CH=CH_2$, wherein d represents an integer of 1 to 5, e represents 0 or 1, and f represents 0 or 1; and the total number of D is 4 or more.

5. The image forming apparatus according to claim 1, wherein the blade applies a pressure to the electrophotographic photoreceptor surface in a range of from 0.20 mN/mm to 0.66 mN/mm.

6. The processing cartridge according to claim 3, wherein the blade applies a pressure to the electrophotographic photoreceptor surface in a range of from 0.20 mN/mm to 0.66 mN/mm.

* * * * *